US010220590B2

(12) United States Patent
Baines

(10) Patent No.: US 10,220,590 B2
(45) Date of Patent: Mar. 5, 2019

(54) PACKAGING MATERIALS AND METHODS

(71) Applicant: Michael Baines, Batavia, IL (US)

(72) Inventor: Michael Baines, Batavia, IL (US)

( * ) Notice: Subject to any disclaimer, the term of this patent is extended or adjusted under 35 U.S.C. 154(b) by 0 days.

(21) Appl. No.: 15/489,213

(22) Filed: Apr. 17, 2017

(65) Prior Publication Data

US 2018/0036989 A1 Feb. 8, 2018

Related U.S. Application Data

(63) Continuation of application No. 13/152,109, filed on Jun. 2, 2011, now Pat. No. 9,623,622, which is a continuation-in-part of application No. PCT/US2010/025230, filed on Feb. 24, 2010.

(60) Provisional application No. 61/431,284, filed on Jan. 10, 2011, provisional application No. 61/350,821, filed on Jun. 2, 2010.

(51) Int. Cl.

| | |
|---|---|
| ***B65D 81/03*** | (2006.01) |
| ***B31D 5/00*** | (2017.01) |
| ***B65D 81/05*** | (2006.01) |

(52) U.S. Cl.

CPC ..... *B31D 5/0073* (2013.01); *B65D 81/052* (2013.01)

(58) Field of Classification Search

CPC ..... B31D 5/0073; B65D 81/052; B65D 81/03
USPC ..... 206/522, 521
See application file for complete search history.

(56) References Cited

U.S. PATENT DOCUMENTS

| | | | |
|---|---|---|---|
| 556,019 | A | 3/1896 | Morse et al. |
| 3,398,501 | A | 8/1968 | Aninger |
| 3,938,299 | A | 2/1976 | Lerner |
| 3,948,015 | A | 4/1976 | Lerner |
| 3,956,866 | A | 5/1976 | Lattur |

(Continued)

FOREIGN PATENT DOCUMENTS

| | | | |
|---|---|---|---|
| DE | 202004006032 | U1 | 9/2004 |
| EP | 0306207 | A1 | 3/1989 |

(Continued)

OTHER PUBLICATIONS

International Search Report and Written Opinion from PCT Application No. PCT/SU2010/025230, dated Apr. 20, 2010.).

*Primary Examiner* — Jacob K Ackun
*Assistant Examiner* — Jenine Pagan
(74) *Attorney, Agent, or Firm* — Banner & Witcoff, Ltd.

(57) ABSTRACT

An inflatable packaging material includes two outer films, a plurality of valve films, and a non-sealable material positioned between the valve films. The films are sealed together by a plurality of seals, including a valve seal extending across the material. The seals define a plurality of air columns and an inflation passage in communication with the columns. The non-sealable material is arranged to form valve portions positioned along the valve seal and spaced passage portions positioned along the inflation passage. The valve portions provide valve passages through the valve seal, to allow airflow into each air column. The passage portions are arranged such that one side seal passes through a space between the passage portions to seal one end of the inflation passage, and the other side seal passes through one of the passage portions to create an open inflation port. The valve films allow air to pass through from the inflation passage to the columns, and prevent reverse flow of air from the columns into the inflation passage.

25 Claims, 52 Drawing Sheets

(56) References Cited

U.S. PATENT DOCUMENTS 4,014,154 A 3/1977 Lerner
4,018,034 A 4/1977 Keren
4,018,946 A 4/1977 Klein
4,041,846 A 8/1977 Lerner
4,074,505 A 2/1978 Keren et al.
4,095,723 A 6/1978 Lerner
4,111,613 A 9/1978 Sperry
4,155,453 A 5/1979 Ono
4,159,079 A 6/1979 Phillips, Jr.
4,190,158 A 2/1980 Ambrose
4,196,160 A 4/1980 Sperry
4,201,029 A 5/1980 Lerner et al.
4,202,153 A 5/1980 Lerner et al.
4,240,556 A 12/1980 Field
4,247,019 A 1/1981 Lerner
4,262,801 A 4/1981 Avery
4,267,684 A 5/1981 Ambrose
4,310,182 A 1/1982 Vandenbossche
4,337,058 A 6/1982 Lerner
4,337,257 A 6/1982 Junggren et al.
4,344,557 A 8/1982 Lerner
4,350,243 A 9/1982 Weyandt
4,353,356 A 10/1982 Vandenbossche
4,354,618 A 10/1982 Weyandt
4,382,527 A 5/1983 Lerner
4,387,550 A 6/1983 Lerner
4,390,337 A 6/1983 Gately
4,392,056 A 7/1983 Weyandt
4,401,213 A 8/1983 Lerner
4,401,769 A 8/1983 Malwitz
4,412,876 A 11/1983 Lerner et al.
4,425,446 A 1/1984 Malwitz et al.
4,426,023 A 1/1984 Sperry et al.
4,430,840 A 2/1984 Malwitz
4,465,188 A 8/1984 Soroka et al.
4,467,207 A 8/1984 Lerner et al.
4,467,978 A 8/1984 Farrington
4,469,251 A 9/1984 Sperry et al.
D279,165 S 6/1985 Smith
4,565,592 A 1/1986 Wehrmann et al.
4,568,003 A 2/1986 Sperry et al.
4,575,901 A 3/1986 Lerner
4,576,283 A 3/1986 Fafoumoux
4,584,822 A 4/1986 Fielding et al.
4,589,165 A 5/1986 Lerner et al.
4,613,320 A 9/1986 Lerner
4,620,888 A 11/1986 Easter et al.
4,627,947 A 12/1986 Voss
4,640,080 A 2/1987 Wright
4,651,506 A 3/1987 Lerner et al.
4,654,375 A 3/1987 Malwitz
4,674,268 A 6/1987 Gavronsky et al.
4,680,205 A 7/1987 Lerner et al.
4,680,324 A 7/1987 Malwitz
4,754,658 A 7/1988 Gutknecht
4,759,891 A 7/1988 Reichental
4,761,257 A 8/1988 Bunn
4,785,044 A 11/1988 Kannankeril
4,793,123 A 12/1988 Pharo
4,800,708 A 1/1989 Sperry
RE32,963 E 6/1989 Lerner et al.
4,858,109 A 8/1989 Webber
4,872,558 A 10/1989 Pharo
4,874,093 A 10/1989 Pharo
4,877,334 A 10/1989 Cope
4,898,327 A 2/1990 Sperry et al.
4,899,520 A 2/1990 Lerner et al.
4,901,506 A 2/1990 Weyandt
4,918,904 A 4/1990 Pharo
4,925,453 A 5/1990 Kannankeril
4,926,048 A 5/1990 Lerner et al.
4,927,010 A 5/1990 Kannankeril
4,928,455 A 5/1990 Gereby et al.
4,938,007 A 7/1990 Sperry
4,941,754 A 7/1990 Murdock
4,944,825 A 7/1990 Gifford et al.
4,945,252 A 7/1990 Lerner et al.
4,949,530 A 8/1990 Pharo
4,956,951 A 9/1990 Kannankeril
4,969,310 A 11/1990 Lerner et al.
4,970,040 A 11/1990 Voss
4,983,138 A 1/1991 McGrath
5,009,318 A 4/1991 Lepinoy
5,027,583 A 7/1991 Chelak
5,028,470 A 7/1991 Reichenecker
5,035,104 A 7/1991 Helling et al.
5,041,148 A 8/1991 Gereby et al.
5,055,272 A 10/1991 Wheeler et al.
5,059,114 A 10/1991 Stout et al.
5,070,674 A 12/1991 Lerner et al.
5,072,637 A 12/1991 Reichental et al.
5,077,958 A 1/1992 Peppard et al.
5,089,535 A 2/1992 Malwitz et al.
5,108,673 A 4/1992 Wegmann
5,116,444 A 5/1992 Fox
5,118,720 A 6/1992 Wheeler et al.
5,129,519 A 7/1992 David et al.
5,134,833 A 8/1992 Lerner et al.
5,139,151 A 8/1992 Chelak
5,150,490 A 9/1992 Busch et al.
5,174,449 A 12/1992 Ball
5,176,930 A 1/1993 Kannankeril et al.
5,186,905 A 2/1993 Bertram et al.
5,190,706 A 3/1993 Knaus
5,203,761 A 4/1993 Reichental et al.
5,215,226 A 6/1993 Bertram et al.
5,232,541 A 8/1993 Gifford
5,240,112 A 8/1993 Newburger
5,255,847 A 10/1993 Sperry et al.
5,259,172 A 11/1993 Peppard et al.
5,263,587 A 11/1993 Elkin et al.
5,265,402 A 11/1993 Lerner et al.
5,269,122 A 12/1993 Reichental et al.
5,272,856 A 12/1993 Pharo
5,287,968 A 2/1994 Ridgeway
5,289,671 A 3/1994 Lerner et al.
5,297,919 A 3/1994 Reichental et al.
5,301,889 A 4/1994 Ball
5,304,264 A 4/1994 Wehrmann
5,310,056 A 5/1994 Ball
5,314,924 A 5/1994 Lee
5,322,234 A 6/1994 Robert et al.
5,327,805 A 7/1994 Reichental et al.
5,335,483 A 8/1994 Gavronsky et al.
5,339,602 A 8/1994 Landers et al.
5,341,625 A 8/1994 Kramer
5,348,984 A 9/1994 Lee
5,371,521 A 12/1994 Wehrmann
5,372,877 A 12/1994 Kannankeril
5,376,219 A 12/1994 Sperry et al.
5,381,902 A 1/1995 Dumser et al.
5,388,701 A 2/1995 Ridgeway
5,394,674 A 3/1995 Peppard et al.
5,394,676 A 3/1995 Lerner et al.
5,411,627 A 5/1995 Lerner et al.
5,411,689 A 5/1995 Lee et al.
5,413,855 A 5/1995 Kolaska et al.
5,417,639 A 5/1995 Cronauer
5,426,918 A 6/1995 Ball
5,428,346 A 6/1995 Franklin
5,447,235 A 9/1995 Pharo
5,454,642 A 10/1995 De Luca
5,462,974 A 10/1995 Lee
5,469,966 A 11/1995 Boyer
5,474,208 A 12/1995 Ball
5,487,470 A 1/1996 Pharo
D368,215 S 3/1996 Dye
5,499,485 A 3/1996 Lerner et al.
5,515,975 A 5/1996 Jarvis et al.
5,552,169 A 9/1996 Kannankeril et al.
5,568,718 A 10/1996 Lerner et al.
5,570,568 A 11/1996 Kramer
5,573,168 A 11/1996 Kannankeril et al.
5,575,435 A 11/1996 Sperry et al.

(56) References Cited

U.S. PATENT DOCUMENTS 5,586,708 A 12/1996 Lerner et al.
5,588,532 A 12/1996 Pharo
5,588,533 A 12/1996 Farison et al.
5,590,816 A 1/1997 Bertram et al.
5,598,684 A 2/1997 Aarts
5,600,360 A 2/1997 Lerner et al.
5,617,812 A 4/1997 Balderson et al.
5,619,839 A 4/1997 Peppard et al.
5,620,096 A 4/1997 Pozzo
5,626,004 A 5/1997 Gates et al.
5,640,834 A 6/1997 Lerner et al.
5,665,456 A 9/1997 Kannankeril et al.
5,667,728 A 9/1997 Lee
5,671,787 A 9/1997 Wehrmann
5,678,695 A 10/1997 Ridgeway et al.
5,679,208 A 10/1997 Sperry et al.
5,690,855 A 11/1997 Nichols et al.
5,709,069 A 1/1998 Cronauer
5,709,317 A 1/1998 Bertram et al.
5,711,691 A 1/1998 Damask et al.
5,722,218 A 3/1998 Lerner
5,743,070 A 4/1998 Lerner et al.
5,765,688 A 6/1998 Bertram et al.
5,772,565 A 6/1998 Weyandt
5,776,510 A 7/1998 Reichental et al.
5,791,522 A 8/1998 Lee et al.
5,794,406 A 8/1998 Reichental et al.
5,798,169 A 8/1998 Smith
5,801,208 A 9/1998 Lee
5,803,263 A 9/1998 Pozzo
5,806,276 A 9/1998 Lerner et al.
5,813,585 A 9/1998 Kannankeril et al.
5,829,492 A 11/1998 Gavronsky et al.
5,830,780 A 11/1998 Dennison et al.
5,839,582 A 11/1998 Strong et al.
5,849,594 A 12/1998 Balderson et al.
5,862,914 A 1/1999 Farison et al.
5,873,221 A 2/1999 Sperry et al.
5,875,897 A 3/1999 Duncan et al.
5,881,881 A 3/1999 Carrington
5,887,412 A 3/1999 Lerner et al.
5,890,346 A 4/1999 Guess
5,893,462 A 4/1999 Ridgeway
5,899,325 A 5/1999 Bertram et al.
5,902,842 A 5/1999 Balderson et al.
5,913,603 A 6/1999 Sperry et al.
5,915,555 A 6/1999 Ball
5,927,336 A 7/1999 Tanaka et al.
5,934,535 A 8/1999 Kannankeril et al.
5,942,076 A 8/1999 Salerno et al.
5,944,424 A 8/1999 Lerner et al.
5,950,875 A 9/1999 Lee et al.
5,957,824 A 9/1999 Lerner et al.
5,986,239 A 11/1999 Corrigan, III et al.
5,987,856 A 11/1999 Lerner
5,996,319 A 12/1999 Lerner et al.
5,996,782 A 12/1999 Sperry et al.
6,003,288 A 12/1999 Sperry et al.
6,004,637 A 12/1999 Reichenecker
6,005,015 A 12/1999 Malwitz et al.
6,010,006 A 1/2000 Ridgeway et al.
6,030,696 A 2/2000 Lee
6,034,197 A 3/2000 Mahon et al.
6,035,611 A 3/2000 Lerner
6,053,361 A 4/2000 Hills
6,055,796 A 5/2000 Lerner et al.
6,065,636 A 5/2000 Sperry et al.
6,066,393 A 5/2000 Lee
6,076,677 A 6/2000 Pozzo
RE36,759 E 7/2000 Hoover et al.
6,093,466 A 7/2000 Steinke et al.
6,096,793 A 8/2000 Lee et al.
6,103,355 A 8/2000 Mehta
6,131,375 A 10/2000 Sperry
6,148,590 A 11/2000 Ridgeway et al.
6,148,591 A 11/2000 Ridgeway et al.
6,156,813 A 12/2000 Malwitz et al.
6,170,227 B1 1/2001 Kovacs et al.
6,170,238 B1 1/2001 Lerner
6,176,613 B1 1/2001 Chen
6,183,838 B1 2/2001 Kannankeril
6,199,349 B1 3/2001 Lerner
6,207,254 B1 3/2001 Lee et al.
6,232,355 B1 5/2001 Malwitz et al.
6,244,440 B1 6/2001 Tschantz et al.
6,245,266 B1 6/2001 Ramesh et al.
6,253,806 B1 7/2001 Sperry et al.
6,253,919 B1 7/2001 Sperry et al.
6,264,033 B1 7/2001 Kannabiran et al.
6,270,256 B1 8/2001 Todman
6,270,873 B1 8/2001 Darnett
6,271,275 B1 8/2001 Malwitz
6,272,813 B1 8/2001 Sperry et al.
6,276,532 B1 8/2001 Sperry et al.
6,283,174 B1 9/2001 Sperry et al.
6,283,296 B1 9/2001 Newman
6,289,649 B1 9/2001 Cherfane
6,289,655 B1 9/2001 Ridgeway et al.
6,296,424 B1 10/2001 Eckel et al.
6,297,463 B1 10/2001 Hills
6,300,469 B1 10/2001 Freundlich et al.
6,302,274 B1 10/2001 Ridgeway
6,311,844 B1 11/2001 Ridgeway et al.
6,323,245 B1 11/2001 Ramesh et al.
6,334,537 B1 1/2002 Tepper
6,341,473 B1 1/2002 Kovacs et al.
6,351,926 B1 3/2002 Hodge et al.
6,367,975 B1 4/2002 Cronauer et al.
6,378,272 B1 4/2002 Archibald et al.
6,386,850 B1 5/2002 Salerno et al.
6,391,438 B1 5/2002 Ramesh et al.
6,398,029 B1 6/2002 Farison et al.
6,398,460 B1 6/2002 Eckel et al.
6,406,645 B1 6/2002 Malwitz et al.
6,428,093 B1 8/2002 Farmont et al.
6,435,348 B1 8/2002 Pasquesi
6,436,521 B1 8/2002 Lee
6,447,826 B1 9/2002 Matthews
6,453,644 B1 9/2002 Baker
6,454,981 B1 9/2002 Lee et al.
6,462,101 B1 10/2002 Ramesh et al.
6,471,058 B2 10/2002 Kannabiran et al.
6,472,638 B1 10/2002 Sperry et al.
6,478,181 B1 11/2002 Krupa et al.
6,492,013 B1 12/2002 Ramesh
6,499,278 B2 12/2002 Cronauer et al.
6,508,611 B2 1/2003 Eckel et al.
6,518,320 B1 2/2003 Malwitz et al.
6,520,333 B1 2/2003 Tschantz
6,527,147 B2 3/2003 Wehrmann
6,543,201 B2 4/2003 Cronauer et al.
6,550,229 B2 4/2003 Sperry et al.
6,559,194 B2 5/2003 Malwitz et al.
6,561,236 B1 5/2003 Sperry et al.
6,569,283 B1 5/2003 Sperry et al.
6,571,954 B2 6/2003 Nadler
6,583,190 B2 6/2003 Lee et al.
6,592,919 B1 7/2003 Matthews et al.
6,593,386 B1 7/2003 Malwitz et al.
6,598,373 B2 7/2003 Sperry et al.
6,617,367 B1 9/2003 Gervais et al.
6,629,599 B2 10/2003 Sperry et al.
6,629,777 B2 10/2003 Tanaka et al.
6,632,403 B1 10/2003 Barmore et al.
6,651,406 B2 11/2003 Sperry et al.
6,672,037 B2 1/2004 Wehrmann
6,673,412 B2 1/2004 Ramesh et al.
6,675,557 B2 1/2004 Sperry et al.
6,712,201 B1 3/2004 Bertram et al.
6,716,914 B2 4/2004 Malwitz et al.
H2104 H 5/2004 Ramesh
6,729,110 B2 5/2004 Sperry et al.
6,742,317 B2 6/2004 Cronauer et al.
6,742,703 B2 6/2004 Esakov et al.

(56) References Cited

U.S. PATENT DOCUMENTS

| | | | |
|---|---|---|---|
| 6,764,756 | B1 | 7/2004 | Ramesh |
| 6,770,342 | B2 | 8/2004 | Buongiomo |
| 6,770,683 | B2 | 8/2004 | Ramesh et al. |
| 6,773,798 | B2 | 8/2004 | Ramesh |
| 6,800,162 | B2 | 10/2004 | Kannankeril et al. |
| 6,804,933 | B2 | 10/2004 | Sperry et al. |
| 6,805,659 | B2 | 10/2004 | Bohrer |
| 6,809,125 | B1 | 10/2004 | Lee et al. |
| 6,811,059 | B2 | 11/2004 | Piucci, Jr. et al. |
| 6,820,835 | B2 | 11/2004 | Cavaliere et al. |
| 6,852,391 | B2 | 2/2005 | Kannankeril |
| 6,862,868 | B2 | 3/2005 | Sperry et al. |
| 6,872,756 | B2 | 3/2005 | Bandolini et al. |
| 6,872,757 | B2 | 3/2005 | Lee et al. |
| 6,887,912 | B2 | 5/2005 | Malwitz et al. |
| 6,889,739 | B2 | 5/2005 | Lerner et al. |
| 6,889,871 | B2 | 5/2005 | Gervais et al. |
| 6,895,732 | B2 | 5/2005 | Sperry et al. |
| 6,899,229 | B2 | 5/2005 | Dennison et al. |
| 6,913,147 | B2 | 7/2005 | Mueller et al. |
| 6,913,389 | B2 | 7/2005 | Kannankeril et al. |
| 6,913,803 | B2 | 7/2005 | Peper |
| 6,929,193 | B2 | 8/2005 | Ruddy |
| 6,932,751 | B1 | 8/2005 | Ward et al. |
| 6,948,296 | B1 | 9/2005 | Lerner et al. |
| 6,953,148 | B2 | 10/2005 | Esakov et al. |
| 6,955,846 | B2 | 10/2005 | Lerner |
| 6,971,221 | B2 | 12/2005 | Sperry et al. |
| 6,974,025 | B2 | 12/2005 | Bertram et al. |
| 6,982,113 | B2 | 1/2006 | Kannankeril et al. |
| 6,983,839 | B2 | 1/2006 | Bertram et al. |
| 6,996,948 | B2 | 2/2006 | Koke et al. |
| 6,996,955 | B2 | 2/2006 | White, Jr. et al. |
| 6,996,956 | B2 | 2/2006 | Sperry et al. |
| 6,997,319 | B2 | 2/2006 | Mahon et al. |
| 7,013,615 | B2 | 3/2006 | Piucci, Jr. et al. |
| 7,018,495 | B2 | 3/2006 | Kannankeril et al. |
| 7,048,025 | B2 | 5/2006 | Sperry et al. |
| 7,066,331 | B2 | 6/2006 | Koyanagi et al. |
| 7,086,534 | B2 | 8/2006 | Roesel et al. |
| 7,106,202 | B2 | 9/2006 | Dickinson |
| 7,125,463 | B2 | 10/2006 | Lerner et al. |
| 7,128,211 | B2 | 10/2006 | Nishi et al. |
| 7,160,096 | B2 | 1/2007 | Knaak et al. |
| 7,165,375 | B2 | 1/2007 | O'Dowd |
| 7,168,566 | B2 | 1/2007 | Anderson et al. |
| 7,173,069 | B2 | 2/2007 | Swennen |
| 7,201,273 | B2 | 4/2007 | Chen et al. |
| 7,201,958 | B2 | 4/2007 | Stimler et al. |
| 7,204,278 | B2 | 4/2007 | Koyanagi et al. |
| 7,220,476 | B2 | 5/2007 | Sperry et al. |
| 7,223,461 | B2 | 5/2007 | Kannankeril et al. |
| 7,225,599 | B2 | 6/2007 | Sperry et al. |
| 7,228,969 | B2 | 6/2007 | Nakano |
| 7,231,749 | B2 | 6/2007 | Garceau et al. |
| 7,247,219 | B2 | 7/2007 | O'Dowd |
| 7,254,932 | B2 | 8/2007 | Tanaka et al. |
| 7,257,935 | B1 | 8/2007 | Wehrmann |
| 7,258,656 | B2 | 8/2007 | Lerner et al. |
| 7,273,142 | B2 | 9/2007 | Huis et al. |
| 7,296,390 | B2 | 11/2007 | Koke et al. |
| 7,297,387 | B2 | 11/2007 | Koyanagi |
| 7,299,103 | B1 | 11/2007 | Dye |
| 7,311,204 | B2 | 12/2007 | Nishi et al. |
| 7,323,665 | B2 | 1/2008 | Sperry et al. |
| 7,328,541 | B2 | 2/2008 | Garceau et al. |
| 7,331,153 | B1 | 2/2008 | Sperry et al. |
| 7,347,911 | B2 | 3/2008 | Selle et al. |
| 7,386,968 | B2 | 6/2008 | Sperry et al. |
| 7,389,626 | B2 | 6/2008 | Sperry et al. |
| 7,392,637 | B2 | 7/2008 | Koke |
| 7,410,057 | B2 | 8/2008 | Yoshifusa |
| 7,422,108 | B2 | 9/2008 | Yoshifusa |
| 7,422,109 | B2 | 9/2008 | Yoshifusa |
| 7,429,304 | B2 | 9/2008 | McNamara, Jr. et al. |
| 7,445,117 | B2 | 11/2008 | Kojima et al. |
| 7,448,185 | B2 | 11/2008 | Zeedyk et al. |
| 7,464,520 | B2 | 12/2008 | Nishi et al. |
| 7,464,521 | B2 | 12/2008 | Koke et al. |
| 7,482,051 | B2 | 1/2009 | Tanaka et al. |
| 7,507,311 | B2 | 3/2009 | O'Dowd |
| 7,510,359 | B2 | 3/2009 | Sperry et al. |
| 7,513,090 | B2 | 4/2009 | Wehrmann |
| 7,521,111 | B2 | 4/2009 | Matarasso |
| 7,533,772 | B2 | 5/2009 | Yoshifusa et al. |
| 7,550,191 | B2 | 6/2009 | Lerner |
| 7,552,571 | B2 | 6/2009 | Lerner et al. |
| 7,553,437 | B2 | 6/2009 | Thompson et al. |
| D596,031 | S | 7/2009 | Wehrmann |
| 7,571,584 | B2 | 8/2009 | Lerner et al. |
| 7,571,589 | B2 | 8/2009 | Shaw |
| 7,578,333 | B2 | 8/2009 | Greenwood et al. |
| 7,585,528 | B2 | 9/2009 | Ferri et al. |
| 7,603,831 | B2 | 10/2009 | Sperry et al. |
| 7,603,833 | B2 | 10/2009 | Koke |
| 7,607,911 | B2 | 10/2009 | Sperry et al. |
| D603,705 | S | 11/2009 | Wehrmann |
| 7,621,104 | B2 | 11/2009 | Piucci et al. |
| 7,631,762 | B2 | 12/2009 | Liao et al. |
| 7,641,459 | B2 | 1/2010 | Sperry et al. |
| 7,651,757 | B2 | 1/2010 | Jones et al. |
| 7,654,064 | B2 | 2/2010 | Riccardi et al. |
| 7,681,379 | B2 | 3/2010 | Nishi et al. |
| 7,694,495 | B2 | 4/2010 | Wehrmann |
| 7,694,701 | B2 | 4/2010 | Koyanagi |
| 7,694,820 | B2 | 4/2010 | Liao et al. |
| 7,718,028 | B2 | 5/2010 | Lerner et al. |
| 7,721,781 | B2 | 5/2010 | Sperry et al. |
| 7,744,519 | B2 | 6/2010 | Wetsch et al. |
| 7,757,459 | B2 | 7/2010 | Wehrmann |
| 7,767,288 | B2 | 8/2010 | Lerner |
| 7,770,731 | B2 | 8/2010 | Jian |
| 7,771,338 | B2 | 8/2010 | Wetsch et al. |
| 7,775,717 | B2 | 8/2010 | DeLuca |
| 7,779,613 | B2 | 8/2010 | Tanaka et al. |
| 7,789,819 | B2 | 9/2010 | Slovencik |
| 7,807,253 | B2 | 10/2010 | Kannankeril |
| 7,823,729 | B2 | 11/2010 | Lee |
| 7,828,146 | B2 | 11/2010 | Frayne |
| 7,913,848 | B2 | 3/2011 | Liao et al. |
| 2001/0000719 | A1 | 5/2001 | Lerner et al. |
| 2001/0001921 | A1 | 5/2001 | Sperry et al. |
| 2001/0034376 | A1 | 10/2001 | Malwitz et al. |
| 2002/0061233 | A1 | 5/2002 | Eckel et al. |
| 2002/0070241 | A1 | 6/2002 | Wehrmann |
| 2002/0092278 | A1 | 7/2002 | Sperry et al. |
| 2002/0092279 | A1 | 7/2002 | Sperry et al. |
| 2002/0106503 | A1 | 8/2002 | Monk et al. |
| 2002/0117421 | A1 | 8/2002 | Baker |
| 2002/0136608 | A1 | 9/2002 | Eckel et al. |
| 2002/0139092 | A1 | 10/2002 | Wehrmann |
| 2002/0174629 | A1 | 11/2002 | Cronauer et al. |
| 2003/0046902 | A1 | 3/2003 | Cronauer et al. |
| 2003/0052786 | A1 | 3/2003 | Dickinson |
| 2003/0106285 | A1 | 6/2003 | Cronauer et al. |
| 2003/0109369 | A1 | 6/2003 | Lerner et al. |
| 2003/0113527 | A1 | 6/2003 | Lee et al. |
| 2003/0139271 | A1 | 7/2003 | Vangedal-Nielsen et al. |
| 2003/0161999 | A1 | 8/2003 | Kannankeril et al. |
| 2003/0162856 | A1 | 8/2003 | Ramesh et al. |
| 2003/0192897 | A1 | 10/2003 | Stapleton |
| 2003/0207955 | A1 | 11/2003 | Malwitz et al. |
| 2003/0212153 | A1 | 11/2003 | Gervais et al. |
| 2003/0219582 | A1 | 11/2003 | Ramesh et al. |
| 2004/0000581 | A1 | 1/2004 | Brandolini et al. |
| 2004/0045261 | A1 | 3/2004 | Sperry et al. |
| 2004/0083680 | A1 | 5/2004 | Compton et al. |
| 2004/0097606 | A1 | 5/2004 | Lee et al. |
| 2004/0104298 | A1 | 6/2004 | Cavaliere et al. |
| 2004/0120611 | A1 | 6/2004 | Kannankeril et al. |
| 2004/0126560 | A1 | 7/2004 | Brandolini et al. |
| 2004/0137210 | A1 | 7/2004 | Ochoa et al. |
| 2004/0137212 | A1 | 7/2004 | Ochoa et al. |
| 2004/0138322 | A1 | 7/2004 | Malwitz et al. |

(56) References Cited

U.S. PATENT DOCUMENTS

2004/0140243 A1 7/2004 Roesel et al.
2004/0163991 A1 8/2004 Koyanagi et al.
2004/0197544 A1 10/2004 Ramesh et al.
2004/0200561 A1 10/2004 Lerner et al.
2004/0202804 A1 10/2004 Lerner
2004/0211697 A1 10/2004 Nakano
2004/0229030 A1 11/2004 Owensby
2005/0011807 A1 1/2005 Dennison et al.
2005/0031832 A1 2/2005 Kannankeril et al.
2005/0060960 A1 3/2005 Sperry et al.
2005/0087048 A1 4/2005 Knaak et al.
2005/0103676 A1 5/2005 Lee
2005/0106378 A1 5/2005 Rives et al.
2005/0109656 A1 5/2005 Ishizaki
2005/0126941 A1 6/2005 Ferri et al.
2005/0158517 A1 7/2005 Rives et al.
2005/0172577 A1 8/2005 Oltrogge
2005/0189257 A1 9/2005 Chen et al.
2005/0210838 A1 9/2005 Mahon et al.
2005/0210839 A1 9/2005 Sadakierski et al.
2005/0218030 A1 10/2005 Mak
2005/0247592 A1 11/2005 Peper et al.
2005/0263205 A1* 12/2005 Koyanagi ..... B31D 5/0073 141/10
2005/0263530 A1 12/2005 Owensby
2005/0266189 A1 12/2005 Wehrmann
2005/0281997 A1 12/2005 Grah
2006/0000184 A1 1/2006 Kannankeril et al.
2006/0011291 A1 1/2006 O'Dowd
2006/0024495 A1 2/2006 Romling et al.
2006/0042190 A1 3/2006 Garceau et al.
2006/0070909 A1 4/2006 Mahon et al.
2006/0086064 A1 4/2006 Wehrmann
2006/0090421 A1 5/2006 Sperry et al.
2006/0090845 A1* 5/2006 Shimowaki ..... B29C 66/723 156/292
2006/0093765 A1 5/2006 Mueller
2006/0108256 A1 5/2006 Bussey et al.
2006/0169753 A1 8/2006 Piucci et al.
2006/0191817 A1* 8/2006 Nishi ..... B31D 5/0073 206/522
2006/0194892 A1 8/2006 Ramesh et al.
2006/0201960 A1 9/2006 Frayne
2006/0218879 A1 10/2006 Garceau et al.
2006/0218880 A1 10/2006 Sperry et al.
2006/0218881 A1 10/2006 Sperry et al.
2006/0218884 A1 10/2006 Sperry et al.
2006/0222842 A1 10/2006 Thezier et al.
2006/0226175 A1 10/2006 Sledzieski et al.
2006/0272288 A1 12/2006 Kannankeril
2006/0289108 A1 12/2006 McNamara et al.
2007/0008144 A1 1/2007 Dickinson
2007/0053615 A1 3/2007 Liu et al.
2007/0056647 A1 3/2007 Frayne
2007/0062139 A1 3/2007 Jones et al.
2007/0065047 A1 3/2007 Kojima et al.
2007/0068353 A1 3/2007 Piucci et al.
2007/0080092 A1 4/2007 DeLuca
2007/0084745 A1 4/2007 Yoshifusa
2007/0090013 A1 4/2007 Yoshifusa et al.
2007/0095693 A1 5/2007 De Luca
2007/0095711 A1 5/2007 Thompson et al.
2007/0117703 A1 5/2007 Cavaliere et al.
2007/0122575 A1 5/2007 Slovencik et al.
2007/0163916 A1 7/2007 Yoshifusa
2007/0170084 A1 7/2007 Chen et al.
2007/0172326 A1 7/2007 Sperry et al.
2007/0235443 A1 10/2007 Sperry et al.
2007/0246394 A1 10/2007 Yoshifusa
2007/0251631 A1 11/2007 Garceau et al.
2007/0252297 A1 11/2007 Sperry et al.
2007/0252298 A1 11/2007 Sperry et al.
2007/0270991 A1 11/2007 Dye
2007/0295633 A1 12/2007 Liao et al.
2008/0010955 A1 1/2008 Lerner et al.
2008/0035519 A1 2/2008 Swartz et al.
2008/0051277 A1 2/2008 Slovencik et al.
2008/0053041 A1 3/2008 Sperry et al.
2008/0058191 A1 3/2008 Slovencik et al.
2008/0073238 A1 3/2008 Liao et al.
2008/0080792 A1 4/2008 Liao et al.
2008/0095474 A1 4/2008 Liao et al.
2008/0107362 A1 5/2008 Yoshifusa
2008/0114091 A1 5/2008 Malwitz et al.
2008/0116101 A1 5/2008 Snyder
2008/0122575 A1 5/2008 Lavian et al.
2008/0156420 A1* 7/2008 Liao ..... B29C 65/02 156/182
2008/0250753 A1 10/2008 Sperry et al.
2008/0272131 A1 11/2008 Roberts et al.
2008/0313996 A1 12/2008 Liao et al.
2008/0314783 A1 12/2008 Yoshifusa
2009/0031675 A1 2/2009 Zeedyk et al.
2009/0032429 A1 2/2009 Morris et al.
2009/0038270 A1 2/2009 Mahon et al.
2009/0050509 A1 2/2009 Liao et al.
2009/0050510 A1 2/2009 Kojima et al.
2009/0061153 A1 3/2009 De Luca et al.
2009/0064637 A1 3/2009 Riccardi et al.
2009/0075800 A1 3/2009 Wetsch et al.
2009/0094939 A1 4/2009 Wetsch
2009/0098996 A1 4/2009 Metta et al.
2009/0108491 A1 4/2009 Frayne
2009/0110864 A1 4/2009 Wehrmann et al.
2009/0126319 A1 5/2009 Sperry et al.
2009/0127153 A1 5/2009 Kim
2009/0155507 A1 6/2009 Liao et al.
2009/0158691 A1 6/2009 Wehrmann
2009/0186175 A1 7/2009 Lerner
2009/0208685 A1 8/2009 Rivers et al.
2009/0223389 A1 9/2009 De Luca et al.
2009/0239006 A1* 9/2009 Liao ..... B29C 65/02 428/34.1
2009/0243135 A1 10/2009 Sperry et al.
2009/0277139 A1 11/2009 Eckel
2009/0283541 A1 11/2009 Compton et al.
2009/0293427 A1 12/2009 Lerner et al.
2009/0294501 A1 12/2009 Shaw et al.
2009/0302085 A1 12/2009 Wetsch et al.
2009/0308965 A1 12/2009 Piucci et al.
2010/0024961 A1 2/2010 Wetsch et al.
2010/0038380 A1 2/2010 Compton
2010/0043353 A1 2/2010 Piucci et al.
2010/0051202 A1 3/2010 Greenwood et al.
2010/0054636 A1 3/2010 Owensby et al.
2010/0092758 A1 4/2010 Slovencik
2010/0096290 A1 4/2010 Frayne et al.
2010/0101970 A1 4/2010 Frayne et al.
2010/0122512 A1 5/2010 Riccardi et al.
2010/0136299 A1* 6/2010 Liao ..... B65D 81/052 428/188
2010/0183248 A1 7/2010 Tanaka
2010/0192526 A1 8/2010 Wehrmann
2010/0221466 A1 9/2010 Wehrmann
2010/0230032 A1 9/2010 Allen et al.
2010/0239189 A1 9/2010 Kim
2010/0251665 A1 10/2010 Sperry
2010/0251668 A1 10/2010 Sperry et al.
2010/0281828 A1 11/2010 Wehrmann
2010/0281831 A1 11/2010 Kannankeril et al.
2010/0282824 A1 11/2010 Kannankeril et al.
2011/0127189 A1* 6/2011 Liao ..... B65D 81/03 206/521
2011/0300320 A1* 12/2011 Kim ..... B65D 81/052 428/35.2

FOREIGN PATENT DOCUMENTS

EP 1251080 A1 10/2002
FR 291114 6/1976
JP 8034478 2/1996
WO 9301106 A1 1/1993
WO 03104089 A2 12/2003

(56) References Cited

FOREIGN PATENT DOCUMENTS

| | | | |
|---|---|---|---|
| WO | 2005003016 | A2 | 1/2005 |
| WO | 2007008021 | A1 | 1/2007 |
| WO | 2007047774 | A2 | 4/2007 |
| WO | 2007053152 | A1 | 5/2007 |
| WO | 2007070163 | A2 | 6/2007 |
| WO | 2007127184 | A2 | 11/2007 |
| WO | 2009009320 | A1 | 1/2009 |
| WO | 2009017774 | A1 | 2/2009 |

* cited by examiner

PACKAGING MATERIALS AND METHODS

CROSS-REFERENCE TO RELATED APPLICATIONS

This application is a continuation of U.S. patent application Ser. No. 13/152,109, filed Jun. 2, 2011, which is a continuation-in-part of International Application No. PCT/US2010/025230, with an international filing date of Feb. 24, 2010, and claims priority thereto and the benefit thereof, and also claims priority to and the benefit of U.S. Provisional Patent Application No. 61/350,821, filed Jun. 2, 2010, and U.S. Provisional Patent Application No. 61/431,284, filed Jan. 10, 2011, which applications are all incorporated by reference herein in their entireties and made part hereof.

TECHNICAL FIELD

The invention relates generally to a packaging material. Certain aspects of this invention relate to inflatable packaging materials and methods of production and use thereof.

BACKGROUND

Inflatable packaging materials are used for packaging a variety of articles for shipping, storage, and other purposes, to protect the articles from damage. Increases in the speed, efficiency, and effectiveness of packaging such articles can prove advantageous. Accordingly, a need exists to provide an inflatable packaging material that is quickly and easily inflatable and provides effective cushioning and protection for articles packaged using the packaging material. The present device and method are provided to address the problems discussed above and other problems, and to provide advantages and aspects not provided by prior packaging materials of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to an inflatable packaging material that includes two outer films positioned in confronting relation to each other, and a valve assembly positioned between the outer films and including an upper valve film, a lower valve film, and a non-sealable material positioned between the upper and lower valve films. The valve assembly may further contain a middle valve film positioned between the upper and lower valve films, and the non-sealable material is then positioned between the middle valve film and the upper and lower valve films. The outer films are sealed together by a perimeter seal including at least a top seal and a bottom seal, and a plurality of border seals located inward of the perimeter seal, such that the border seals define a plurality of air columns. A valve seal extends across the material, parallel to the top seal and spaced from the top seal. The valve seal connects the outer films and the upper and lower valve films, such that the top seal and the valve seal define an inflation passage therebetween, and the valve seal forms a top end of each of the air columns. The non-sealable material is arranged to form a plurality of valve portions positioned along the valve seal and a plurality of passage portions positioned in spaced relation along the inflation passage, with each air column having one of the valve portions located at the top end thereof to provide a valve passage through the valve seal, to allow airflow into each air column. The material is further configured to be sealed by two side seals extending between the top and bottom seals. The passage portions are arranged such that one side seal is configured to pass through the outer films and the valve films at a space between the passage portions to seal one end of the inflation passage, and the other side seal is configured to pass through the outer films and the valve films at one of the passage portions to prevent sealing together of the valve films, creating an open inflation port for introduction of air into the inflation passage at the opposite end of the inflation passage. The valve films form a one-way valve, such that airflow from the inflation passage through the valve passages is permitted, and the valve films cooperate to obstruct reverse airflow from the air columns through the valve passages.

According to one aspect, the lengths of the upper and lower valve films are substantially equal, and the length of the middle valve film is greater than the lengths of the upper and lower valve films, such that the bottom ends of the upper, middle, and lower valve films are substantially contiguous with each other, the top ends of the upper and lower valve films are substantially contiguous with each other, and the top end of the middle valve film extends beyond the top ends of the upper and lower valve films to form a free portion of the middle valve film extending outside the upper and lower valve films. The free portion of the middle valve film extends into the inflation passage.

According to another aspect, the non-heat sealable material is a non-heat sealable ink printed on at least a portion of the valve assembly. In one embodiment, the non-heat sealable ink is printed on at least one of the upper, lower, and middle valve films.

According to a further aspect, the passage portions of the non-sealable material are connected to alternate ones of the valve portions and are positioned more proximate than the valve portions to the top seal.

According to yet another aspect, alternate ones of the border seals each have at least one air conduit therethrough, such that the air columns are arranged in a plurality of pairs of communicating air columns. Each pair of air columns includes a main air column and an auxiliary air column in communication with each other via the air conduits, and the main air columns each have widths that are greater than the widths of each of the auxiliary air columns. In one embodiment, the passage portions of the non-heat sealable material are located adjacent the auxiliary air columns.

Additional aspects of the invention relate to an inflatable packaging material that includes first and second outer films positioned in confronting relation to each other and a valve assembly positioned between the first and second outer films, the valve assembly including an upper film, a lower film, a middle film positioned between the upper and lower films, and a non-sealable material positioned between the middle film and the upper and lower films. The top end of the middle film extends beyond respective top ends of the upper and lower films to form a free portion of the middle film extending outside the upper and lower films. A plurality of seals define a plurality of air columns between the first and second outer films and an inflation passage in communication with all of the air columns. The non-sealable material forms a plurality of valve passages from the inflation passage to the air columns and an inflation port for introduction of air into the inflation passage. The free portion of the middle film extends farther into the inflation passage than the top ends of the upper and lower films. Additionally, the films of the valve assembly form a one-way valve, such that airflow from the inflation passage through the valve passages is permitted, and the upper, lower, and middle films cooperate to obstruct airflow from the air columns through the valve passages.

According to one aspect, the length of the middle film is greater than the lengths of the upper and lower valve films to form the free portion of the middle valve film. Additionally, in one embodiment, the lengths of the upper and lower valve films are substantially equal, and the bottom ends of the upper, middle, and lower valve films are substantially contiguous with each other, the top ends of the upper and lower valve films are substantially contiguous with each other, and the top end of the middle valve film extends beyond the top ends of the upper and lower valve films to form the free portion of the middle valve film.

According to another aspect, the material further includes a plurality of airflow seals connecting one of the first and second outer films with the upper, lower, and middle valve films, the airflow seals positioned adjacent the top end of each air column.

According to a further aspect, the first and second outer films form a top flap extending upwardly from the inflation passage and a bottom flap extending downwardly from bottom ends of the air columns. The material is configured to be folded upon itself to form a bag having an open top defined by the top and bottom flaps, wherein the open top is configured for vacuum sealing across the top and bottom flaps.

According to yet another aspect, the non-sealable material is arranged to form a plurality of valve portions extending between the inflation passage and the air columns and a plurality of passage portions positioned in spaced relation along the inflation passage. The packaging material is configured to be heat sealed at a space between the passage portions to create a sealed end of the inflation passage, and one of the passage portions is configured to prevent heat sealing to create an open end of the inflation passage opposite the sealed end.

According to a still further aspect, alternate ones of the border seals each have at least one air conduit therethrough, such that the air columns are arranged in a plurality of pairs of air columns. Each pair of air columns includes a main air column and an auxiliary air column in communication with each other via the air conduits, and the main air columns each have a width that is greater than a width of each auxiliary air column.

Further aspects of the invention relate to an inflatable packaging material that includes two outer films positioned in confronting relation to each other and sealed together by a perimeter seal and a plurality of alternating primary and secondary border seals located inward of the perimeter seal, and a valve assembly positioned between the outer films and including an upper film, a lower film, a middle film positioned between the upper and lower films, and a non-sealable material positioned between the middle film and the upper and lower films. The perimeter seal includes a top seal, a bottom seal, and two side seals extending between the top and bottom seals. The primary and secondary border seals extend parallel to the side seals to define a plurality of alternating main air columns and auxiliary air columns. Each of the secondary border seals has an air conduit therethrough to permit air communication between each main air column and an adjacent one of the auxiliary air columns to create a plurality of pairs of communicating air columns, each pair including one main air column and the adjacent auxiliary air column. The lengths of the upper and lower films of the valve assembly are substantially equal, and the length of the middle film is greater than the lengths of the upper and lower films, such that the bottom ends of the upper, middle, and lower films are substantially contiguous with each other, the top ends of the upper and lower films are substantially contiguous with each other, and the top end of the middle film extends beyond the top ends of the upper and lower films to form a free portion of the middle film extending outside the upper and lower films. A valve seal extends across the material parallel to the top seal and spaced from the top seal, the valve seal connecting the outer films and the films of the valve assembly, such that the top seal, the side seals, and the valve seal define an inflation passage therebetween, and the valve seal forms a top end of each of the main and auxiliary air columns. The non-sealable material is arranged to form a plurality of valve portions positioned along the valve seal and a plurality of passage portions positioned in spaced relation along the inflation passage, with each main air column and each auxiliary air column having one of the valve portions located at the top end thereof to provide a valve passage through the valve seal to allow airflow into each main and auxiliary air column. One side seal passes through the material at a space between the passage portions to seal one end of the inflation passage, and the other side seal passes through the material at one of the passage portions to prevent complete sealing of the material, creating an open inflation port for introduction of air into the inflation passage. A plurality of airflow seals connect one of the outer films with the upper, lower, and middle films of the valve assembly, with the airflow seals positioned adjacent the top end of each main and auxiliary air column. The films of the valve assembly form a one-way valve, such that airflow from the inflation passage through the valve passages is permitted, and the upper, lower, and middle films cooperate to obstruct reverse airflow from the air columns through the valve passages.

According to one aspect, the packaging material is folded upon itself to form a package having an inner cavity configured for receiving an article. At least a portion of each of the side seals join a first portion of the packaging material to a second portion of the packaging material to define the inner cavity.

According to another aspect, at least one of the main and auxiliary air columns contains a constriction seal connecting the first and second outer films, wherein the constriction seal is configured to form a joint in the packaging material after inflation.

According to a further aspect, the main air columns each have a width that is greater than a width of each auxiliary air column, and the passage portions of the non-heat sealable material are located adjacent the auxiliary air columns.

Still further aspects of the invention relate to method for use with a packaging bag having an inner cavity and an open top and being formed from a rectangular sheet of packaging material folded over and heat sealed together on two opposed sides to form the inner cavity and the open top. The packaging material includes two outer films positioned in confronting relation to each other, a valve assembly positioned between the first and second outer films, and a plurality of seals defining a plurality of air columns between the first and second outer films and an inflation passage in communication with all of the air columns. The valve assembly includes a plurality of one-way valve passages from the inflation passage to the air columns and an inflation port for introduction of air into the inflation passage. An article is inserted into the inner cavity of the packaging bag through the open top. The packaging bag is vacuum-sealed around the article, including substantially evacuating air from the inner cavity and forming a vacuum seal line across the bag at a location between the open top and the valve assembly. After vacuum-sealing, the air columns of the packaging bag are inflated by applying air flow through the inflation passage.

According to one aspect, the method further includes opening the packaging bag at a point between the valve assembly and the top of the packaging bag, providing access to the inner cavity, while the air columns remain inflated.

According to another aspect, the packaging bag can be opened by peeling apart the vacuum seal line. At least one of the first and second outer films of the packaging bag may contain a peeling additive to facilitate peeling apart the vacuum seal line.

According to a further aspect, the packaging bag can be opened by tearing the packaging bag at a point between the valve assembly and the vacuum seal line.

According to yet another aspect, the inflation passage has one sealed end and one open end, and the air flow is applied to the inflation passage by inserting an air nozzle into the open end of the inflation passage.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
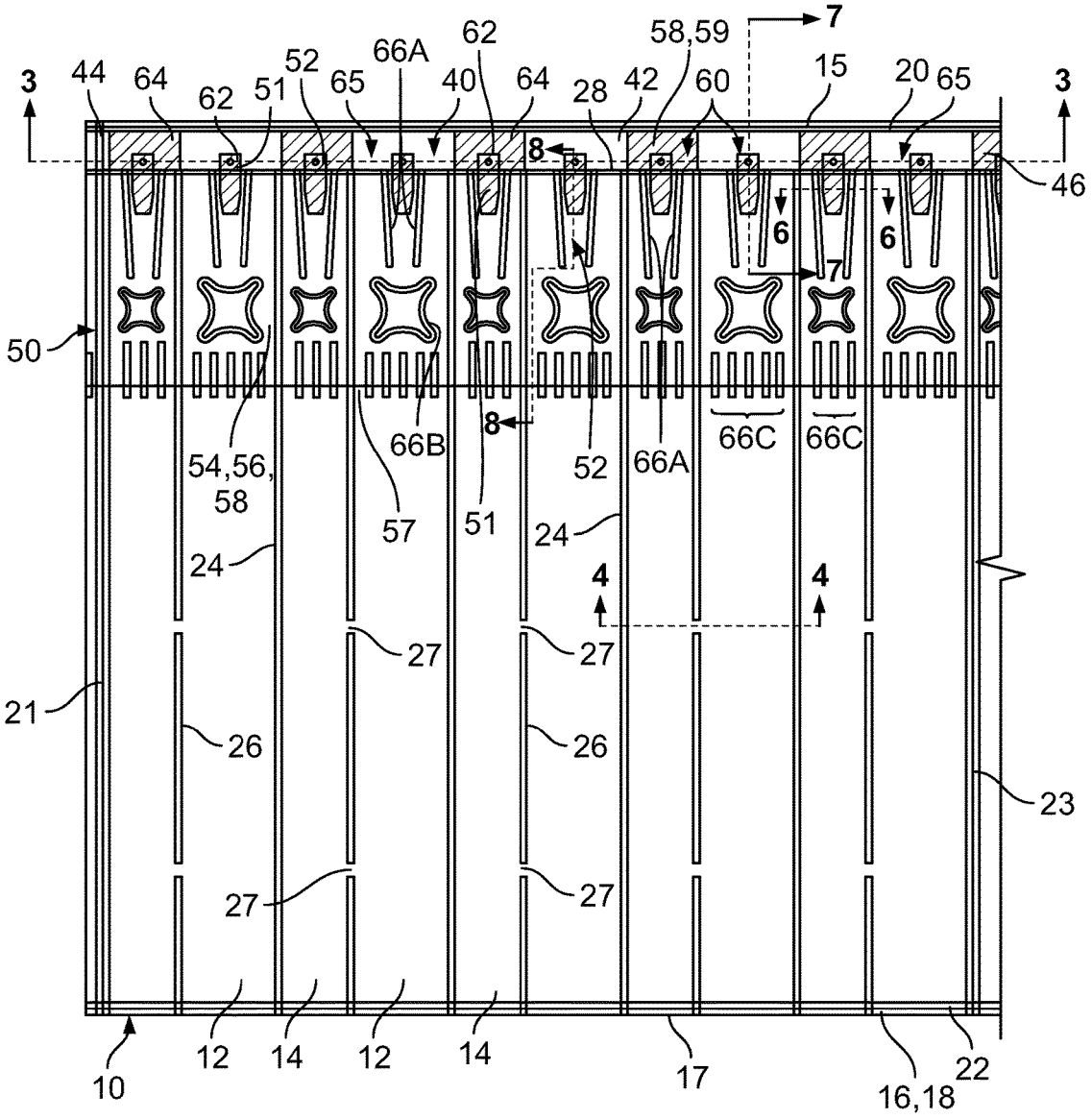
FIG. 1 is a plan view of one embodiment of a packaging material according to the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "upper," "lower," "side," "inner," "outer," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

A packaging material 10 according to one embodiment of the invention is illustrated in FIGS. 1-10. The material 10 as shown in FIGS. 1-10 is an inflatable packaging material having a plurality of air columns 12, 14 that are configured to be filled with air to form a protective structure. The material 10 is formed of a plurality of plastic films, including outer films 16, 18 positioned in confronting relation to each other, defining the inner and outer surfaces of the material 10. The outer films 16, 18 may also be referred to as an upper film 16 and a lower film 18. In the embodiment illustrated, the outer films 16, 18 are two separate sheets that are sealed together by a plurality of heat seals, including a top seal 20 extending proximate the top edge 15 of the material 10 and a bottom seal 22 extending proximate the bottom edge 17 of the material 10, as well as a plurality of border seals 24, 26 located inwardly of the outer periphery of the material 10. It is understood that the outer films 16, 18 may be formed by a single sheet folded over upon itself in another embodiment. The material 10 contains a number of other seals, which are described in further detail below. The material 10 also includes an inflation assembly 40, containing a valve assembly 50 including a plurality of check valves 52, as also described in further detail below.

Figure 4:
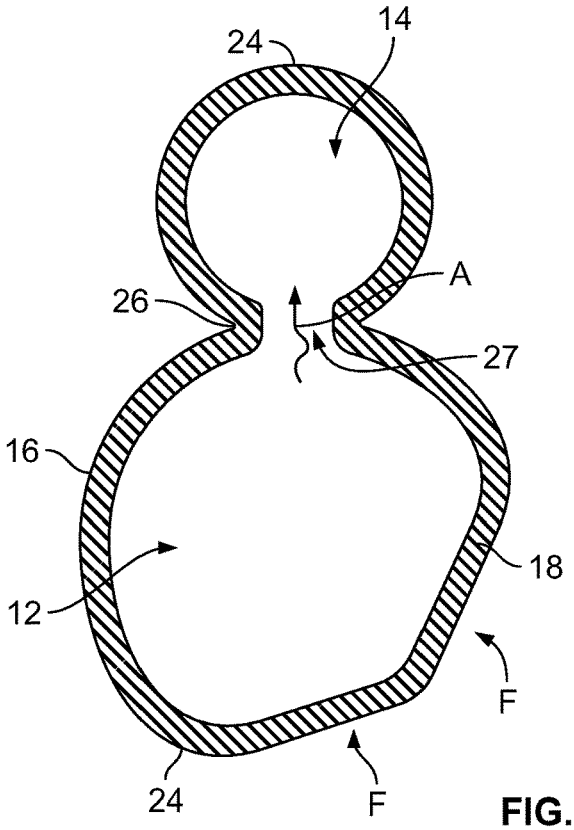
FIG. 4 is a cross-sectional view of the packaging material taken along lines 4-4 of FIG. 1, having an external force exerted thereon.
Figure 5:
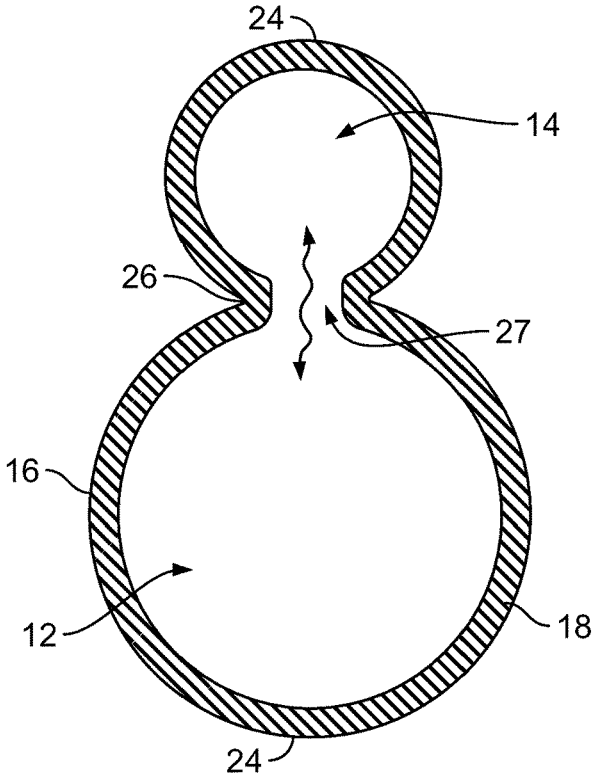
FIG. 5 is a cross-sectional view of the packaging material as illustrated in FIG. 4, absent the external force.
Figure 6:
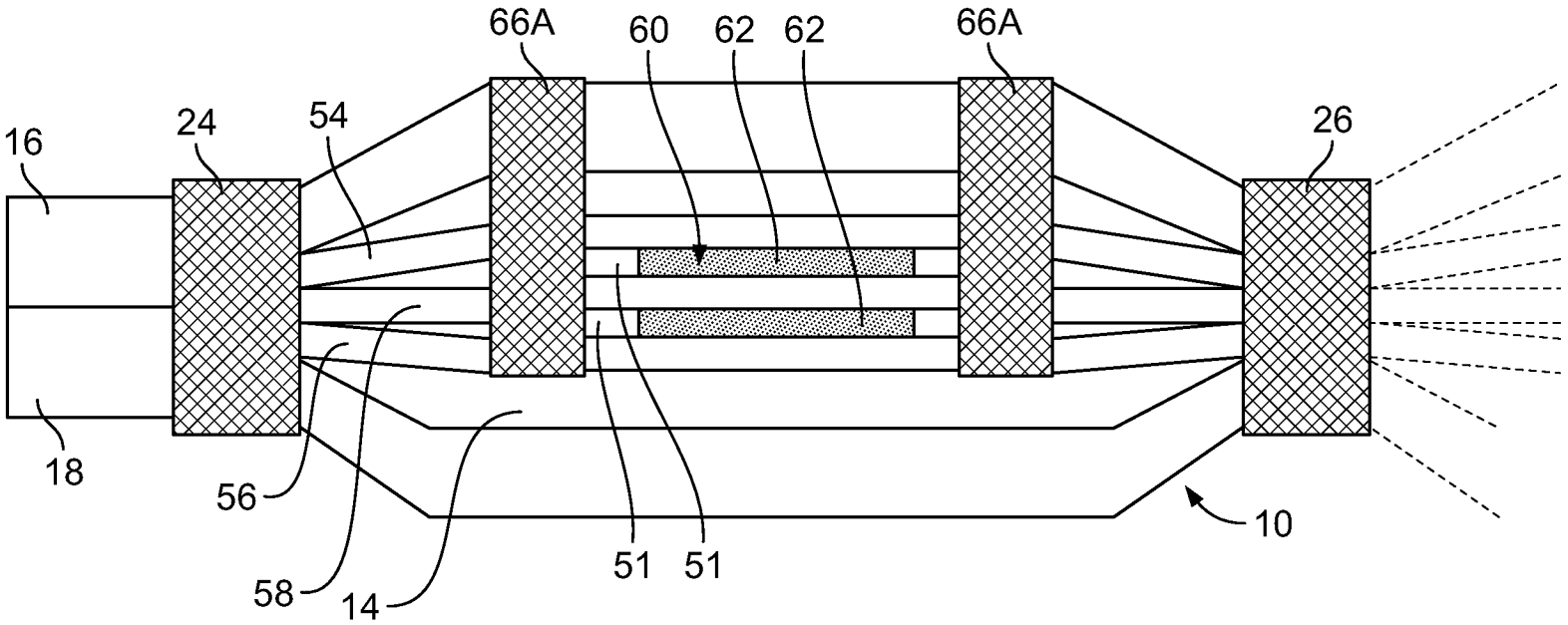
FIG. 6 is a cross-sectional view taken along lines 6-6 of FIG. 1.

The outer films 16, 18 have a plurality of air columns 12, 14 formed therebetween, and a plurality of border seals 24, 26 define the boundaries of the air columns 12, 14. Each column 12, 14 is defined by the bottom seal 22, the border seals 24, 26, and a valve seal 28 extending across the material 10 and spaced from the top seal 20. In this embodiment, the valve seal 28 is parallel or substantially parallel to the top seal 20, but other embodiments may not share this configuration. The border seals include primary or unbroken border seals 24 that are solid and unbroken, running continuously from the valve seal 28 to the bottom seal 22 and secondary or broken border seals 26 running from the valve seal 28 to the bottom seal 22 and having one or more broken or unsealed portions forming air conduits 27 therethrough. In the embodiment shown in FIGS. 1-10, the primary and secondary border seals 24, 26 are positioned in alternating arrangement to create a plurality of alternating primary and secondary air columns 12, 14 arranged into pairs of interconnected air columns. Each pair of air columns 12, 14 includes one main air column 12 and one auxiliary air column 14 that are separated by a secondary border seal 26 and are in fluid communication with each other through the air conduits 27 in the secondary border seal 26. The separate pairs of air columns 12, 14 are separated by the primary border seals 24. In the embodiment illustrated, the main air columns 12 have a larger width and a larger cross-sectional volume than the auxiliary air columns 14, as illustrated in FIGS. 4-6. However, in another embodiment, the main and auxiliary air columns 12, 14 may have sizes that are more similar or even equal. In further embodiments, the air columns 12, 14 may be differently configured. For example, the main and auxiliary air columns 12, 14 may not alternate, and may follow another repetitive pattern, such as "M-A-A-M" (where M=main and A=auxiliary). As another example, the air columns 12, 14 may be arranged into larger numbers of interconnected columns 12, 14, such as triplets or quadruplets instead of pairs.

In the embodiment shown in FIGS. 1-10, the configurations of the main and auxiliary air columns 12, 14 can create more effective cushioning function for the packaging material. As illustrated in FIG. 4, when an external force or pressure is exerted on one of a pair of air columns 12, 14, air can flow from the affected column 12, 14 into the other column 12, 14 of the pair to reduce the pressure increase within the affected column 12, 14, as excessive pressure increases could rupture the column 12, 14. For example, as shown in FIG. 4, an external force F, such as an impact with an external object, acting on the main column 12 increases the pressure in the main column 12, which causes airflow A into the auxiliary column 14 to distribute the pressure over a greater area and volume. Consequently, the total internal pressure on the main and auxiliary columns 12, 14 is lower than the pressure that would result within the main column 12 if the air could not flow into the auxiliary column 14, and the chance of rupture is decreased. As shown in FIG. 5, once the force F is removed, the air columns 12, 14 return to their original states.

Additionally, each air column 12, 14 includes a plurality of constriction seals 25, which are generally formed at or near the center of the width of each column 12, 14. Examples of constriction seals 25 are illustrated in FIGS. 11-30. The constriction seals 25 constrict the local volume of the column 12, 14 to prevent full expansion, while allowing air to pass by the constriction seal 25 on one or both sides. In one embodiment, the constriction seals 25 can be used to form joint areas where the inflated material is configured for bending or folding, particularly when multiple constriction seals 25 for multiple different columns 12, 14 are properly aligned or otherwise positioned relative to each other to form such a joint. Constriction seals 25 functioning in this way may alternately be referred to as joint seals, and FIGS. 11-30 illustrate several different embodiments of packaging materials having different shapes that may be formed by properly positioned constriction seals 25, as described in greater detail below. The constriction seals 25 can additionally or alternately be used to create a multi-cellular structure for the air column 12, 14.

The material 10 includes an inflation assembly 40 configured for inflation of the air columns 12, 14, and the inflation assembly 40 contains a valve assembly 50 that permits air to flow into the air columns 12, 14 and resists or prevents air from flowing out of the inflated air columns 12, 14. The inflation assembly 40 includes an inflation passage 42 defined between the top seal 20 and the valve seal 28, which allows air to flow between the outer films 16, 18 and across the top of the material 10 to be distributed to a plurality of check valves 52 of the valve assembly 50 that are in communication with the inflation passage 42. In the finished packaging product, the inflation passage 42 typically has one closed end 44 and one open end 46 that functions as an inflation port, as described in greater detail below.

The valve assembly 50 includes a plurality of valve films positioned between the outer films 16, 18, and creates a plurality of one-way check valves 52. Each of the air columns 12, 14 has a check valve 52 located at the top end thereof, adjacent the valve seal 28. In the embodiment shown in FIGS. 1-10, the material 10 includes three valve films: an upper valve film 54, a lower valve film 56, and a middle valve film 58 positioned between the upper and lower films 54, 56. The three valve films 54, 56, 58 are positioned in surface-to-surface contact with each other, and areas of a non-sealable material 60 are positioned between the valve films 54, 56, 58, as shown in FIGS. 1-10. The non-sealable material 60 is generally not heat-sealable under normal conditions, and may be a non-sealable ink, a refractory coating, or other non-sealable material. As shown in FIG. 6, the non-sealable material 60 is positioned on either side of the middle valve film 58, and may be applied by printing on both sides of the middle valve film 58 before assembly of the valve assembly 50. It is understood that the non-sealable material 60 may be applied in another manner in another embodiment.

In the embodiment shown in FIGS. 1-10, the non-sealable material is arranged in at least a plurality of valve portions 62 positioned along the valve seal 28 and a plurality of passage portions 64 positioned along the inflation passage 42. In this embodiment, the valve portions 62 extend through the check valves 52, from the inflation passage 42 through the valve seal 28 and into the top ends of the air columns 12, 14. These valve portions 62 prevent the check valves 52 from being completely sealed shut during the sealing action that produces the valve seal 28. The passage portions 64 are positioned in spaced relation to one another along the inflation passage 42, with gaps 65 between the passage portions 64. In the embodiment illustrated, the passage portions 64 are positioned adjacent the top ends of the auxiliary air columns 14 and are connected to the valve portions 62 of each auxiliary air column 14. The resultant configuration forms an alternating pattern, where each primary air column 12 has little or no non-sealable material 60 positioned in the adjacent areas of the inflation passage 42, and each auxiliary air column 14 has the non-sealable material positioned in the adjacent areas of the inflation passage 42, in the form of the passage portions 64. Additionally, each passage portion 64 is approximately equal in width to the adjacent air column 14. In other embodiments, the passage portions 64 may be arranged in a different spaced, intermittent, and/or disconnected pattern within the inflation passage 42, and such pattern may have no relation to the sizes or positions of the air columns 12, 14. As described in greater detail below, the passage portions 64 prevent sealing of the inflation passage 42 to create the open end 46 of the passage 42, and the gaps 65 between the passage portions 64 allow the inflation passage 42 to be sealed to create the closed end 44 of the inflation passage 42.

Figure 7:
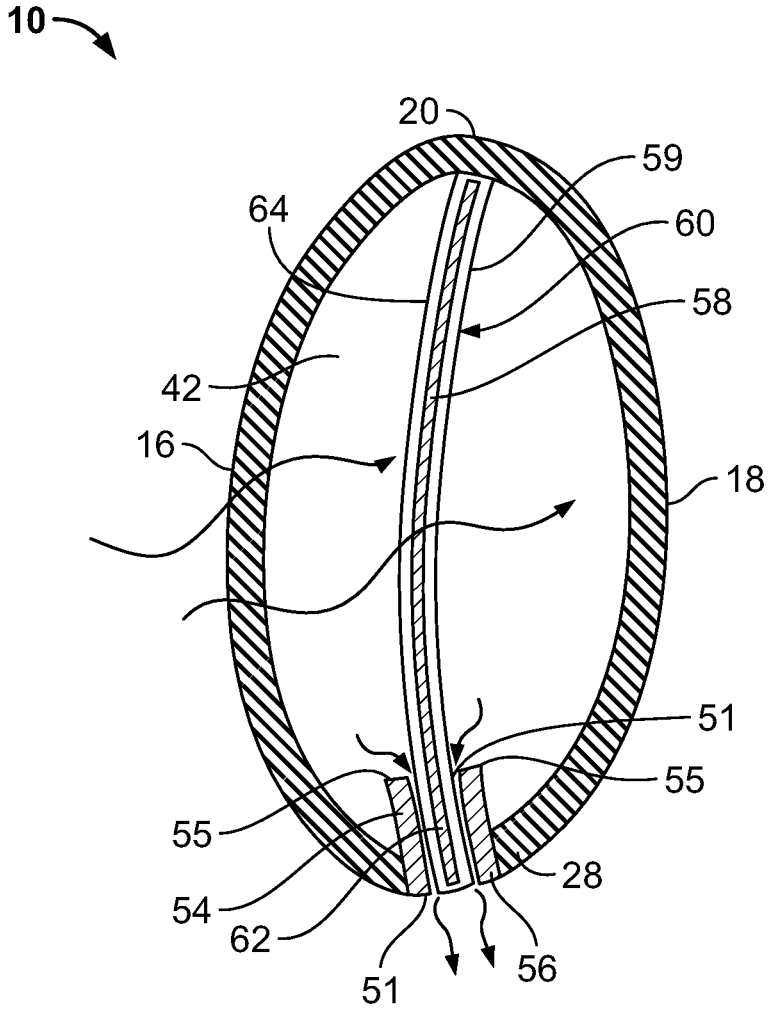
FIG. 7 is a cross-sectional view taken along lines 7-7 of FIG. 1.
Figure 8:
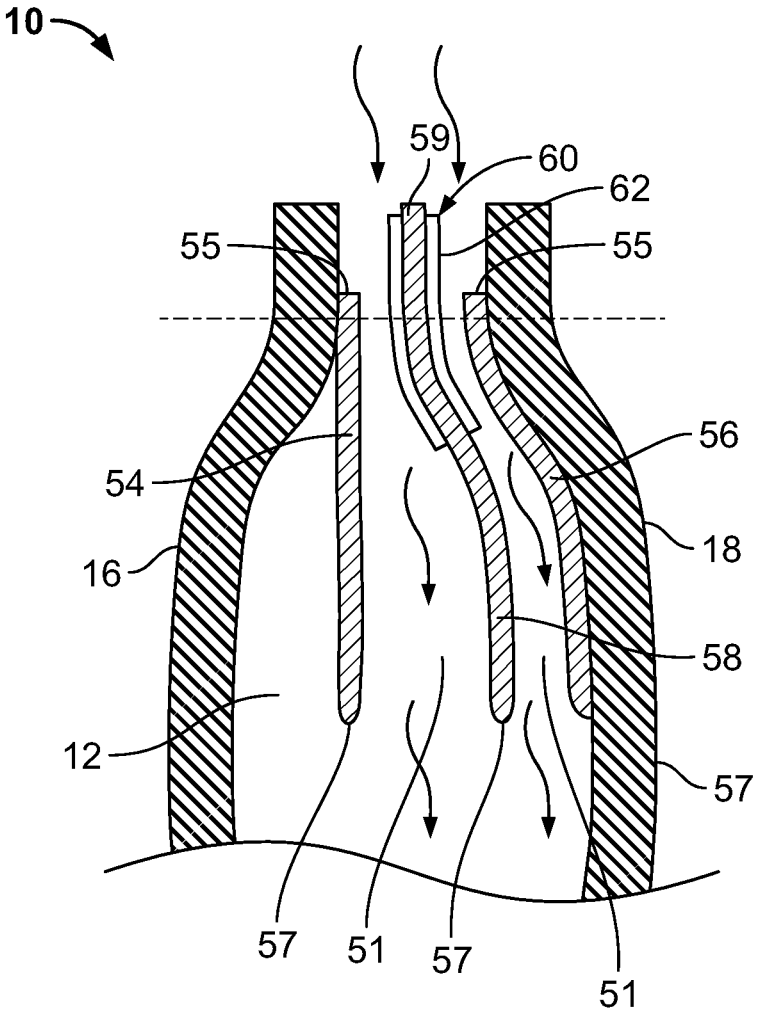
FIG. 8 is a cross-sectional view taken along lines 8-8 of FIG. 1, shown during inflation.
Figure 9:
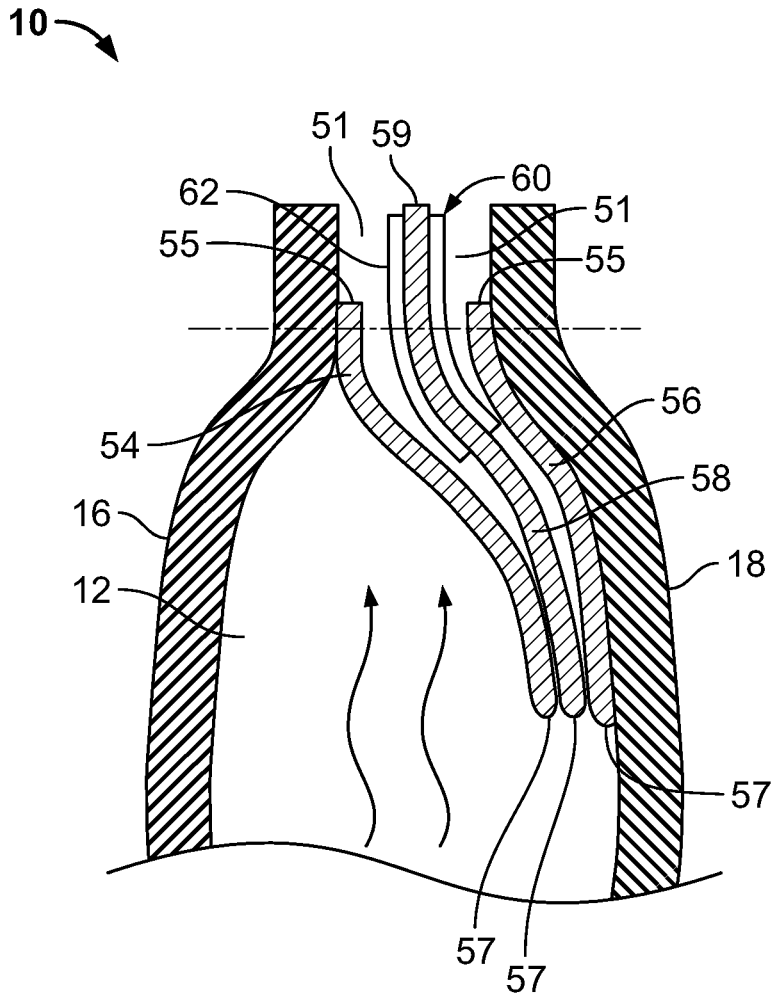
FIG. 9 is a cross-sectional view of the packaging material as illustrated in FIG. 8, shown after inflation is complete.

The valve films 54, 56, 58 are positioned between the outer films 16, 18 and are sealed together with the upper and lower films 16, 18 by the valve seal 28 that extends across the material 10. As stated above, the valve portions 62 of the non-sealable material 60 disrupt the valve seal 28. Additionally, in this embodiment, the middle valve film 58 extends further into the inflation passage 42 than the upper and lower valve films 54, 56. As shown in FIGS. 7-9, the middle film 58 has an extending portion 59 that extends beyond the top ends 55 of the upper and lower films 54, 56. This configuration can assist in keeping at least one of the air passages 51 open between the films 54, 56, 58 to further ensure successful inflation. As also shown in FIG. 6, the extending portion 59 of the middle film 58 provides a surface for connection of the passage portions 64 of the non-sealable material 60. The extending portion 59 may hang loosely within the inflation passage 42 or may extend into the top seal 20 to be fixed in place, in different embodiments. Further, in the embodiment of FIGS. 7-9, the extending portion 59 is created by the middle film 58 having a greater length (measured in the direction between the top and bottom seals 20, 22) than the upper and lower films 54, 56, which have substantially the same length. The bottom ends 57 of all three valve films 54, 56, 58 are contiguous or substantially contiguous with each other, and the greater length of the middle film 58 creates the extending portion 59 in this embodiment. In another embodiment, the extending portion 59 may be created in whole or in part by displacing the bottom end 57 of the middle film 58 from the bottom ends 57 of the upper and lower films 54, 56. In a further embodiment, the middle film 58 may have no extending portion.

The valve films 54, 56, 58 are also sealed to one or both of the upper and lower films 16, 18 within the top ends of the air columns 12, 14 by the border seals 24, 26, as well as a plurality of airflow seals 66A-C. In the embodiment illustrated in FIGS. 1-10, the border seals 24, 26 connect the outer films 16, 18 and the valve films 54, 56, 58 from the valve seal 28 to the bottom ends 57 of the valve films 54, 56, 58, and the airflow seals 66A-C connect the valve films 54, 56, 58 to only one of the outer films 16, 18 (in this example, the upper film 16 only). In another embodiment, the airflow seals 66A-C may additionally or alternately connect the valve films 54, 56, 58 to the lower outer film 18. The airflow seals 66A-C guide the flow of air between the valve passages 51 and the interiors of the air columns 12, 14, and include several different forms of seals. In this embodiment, the airflow seals 66A-C include elongated seals 66A forming a tapered tunnel adjacent the valve passages 51, a central seal 66B positioned adjacent the ends of the elongated seals 66A, and a plurality of parallel seals 66C near the bottom ends 57 of the valve films 54, 56, 58. These airflow seals 66A-C may have various different shapes. For example, as shown in FIG. 1, the central seal 66B may be in the shape of a logo or other symbol. It is understood that various embodiments may contain various types and arrangements of airflow seals 66A-C. The airflow seals 66A-C allow air to flow from the air passages 51 through the check valves 52 and into the air columns 12, 14, and also keeps the valve films 54, 56, 58 near the outer film 16 so that air pressure within the columns 12, 14 forces the check valves 52 closed to seal the columns 12, 14, as described in greater detail below. Additionally, the airflow seals 66A-C can serve to control the flow of air through the check valves 52 between the air passages 51 and the columns 12, 14.

FIGS. 7-9 illustrate the functioning of the check valves 52 of the valve assembly 50. As shown in FIG. 7, air flows along the inflation passage 42 and through the air passages 51 between the valve films 54, 56, 58 created by the non-sealable material 60. Additionally, as shown in FIG. 8, the air flows through the air passages 51 between the valve films 54, 56, 58 and into the air column 14. After the inflation airflow is ceased, the air columns 12, 14 are pressurized, and the air pressure within the columns 12, 14 forces the valve films 54, 56, 58 against the lower outer film 18 to prevent air from escaping back through the air passages 51, as shown in FIG. 9. The airflow seals 66A-C may assist in guiding the flow of any air that may enter between the valve films 54, 56, 58 away from the air passages 51, so that the air becomes trapped in pockets 67 between the elongated seals 66A and the border seals 24, 26, rather than passing through the air passages 51. It is understood that FIGS. 7-9 are conceptual drawings and are not drawn to scale, and in particular, that the degree or extent of movement of the films 54, 56, 58 in FIGS. 7-9 may be exaggerated.

Figure 31:
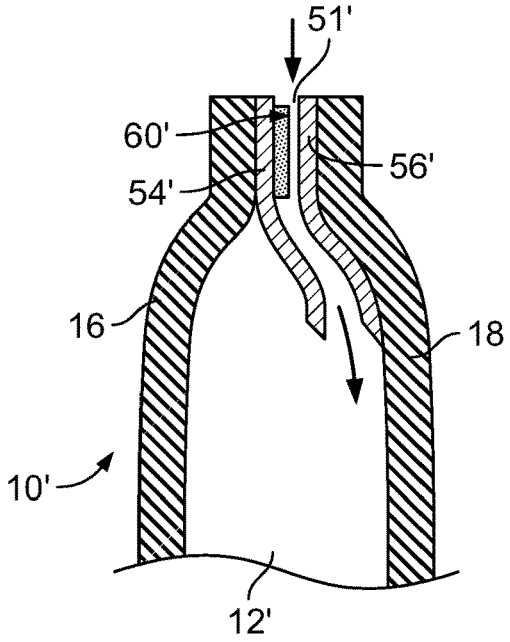
FIG. 31 is a cross-sectional view of another embodiment of a packaging material according to the present invention, shown during inflation.
Figure 32:
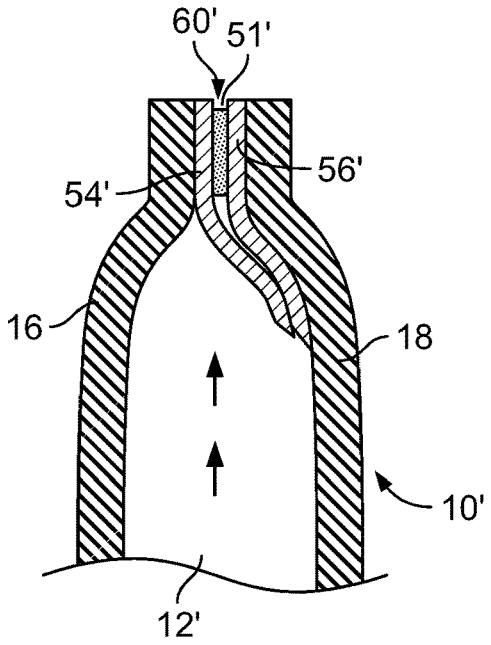
FIG. 32 is a cross-sectional view of the packaging material as illustrated in FIG. 31, shown after inflation is complete.
Figure 33:
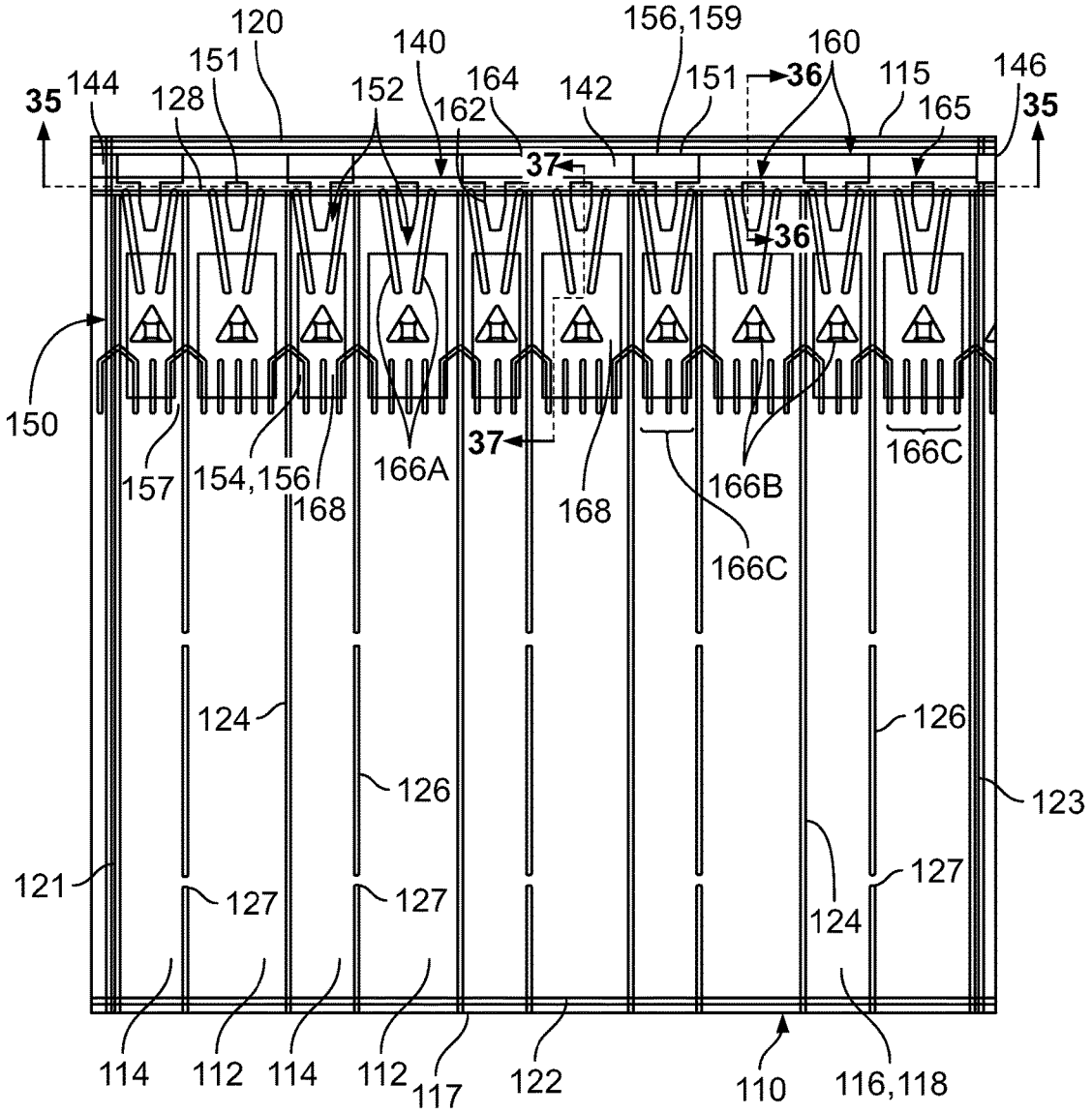
FIG. 33 is a plan view of another embodiment of a packaging material according to the present invention.

In an alternate embodiment, illustrated in FIGS. 31-32, the material 10' may have only two valve films 54', 56', with the non-sealable material 60' positioned between them. In this embodiment, only a single air passage 51' is formed for introduction of air into the column 12'. Additionally, the non-sealable material 60' may be arranged in the same or a similar pattern to the non-sealable material 60 described above and shown in FIGS. 1-10. Further, other features of the material 10 described above may be incorporated into the embodiment of the material 10' in FIGS. 31-32, including any variations or alternate embodiments described herein.

Figure 10:
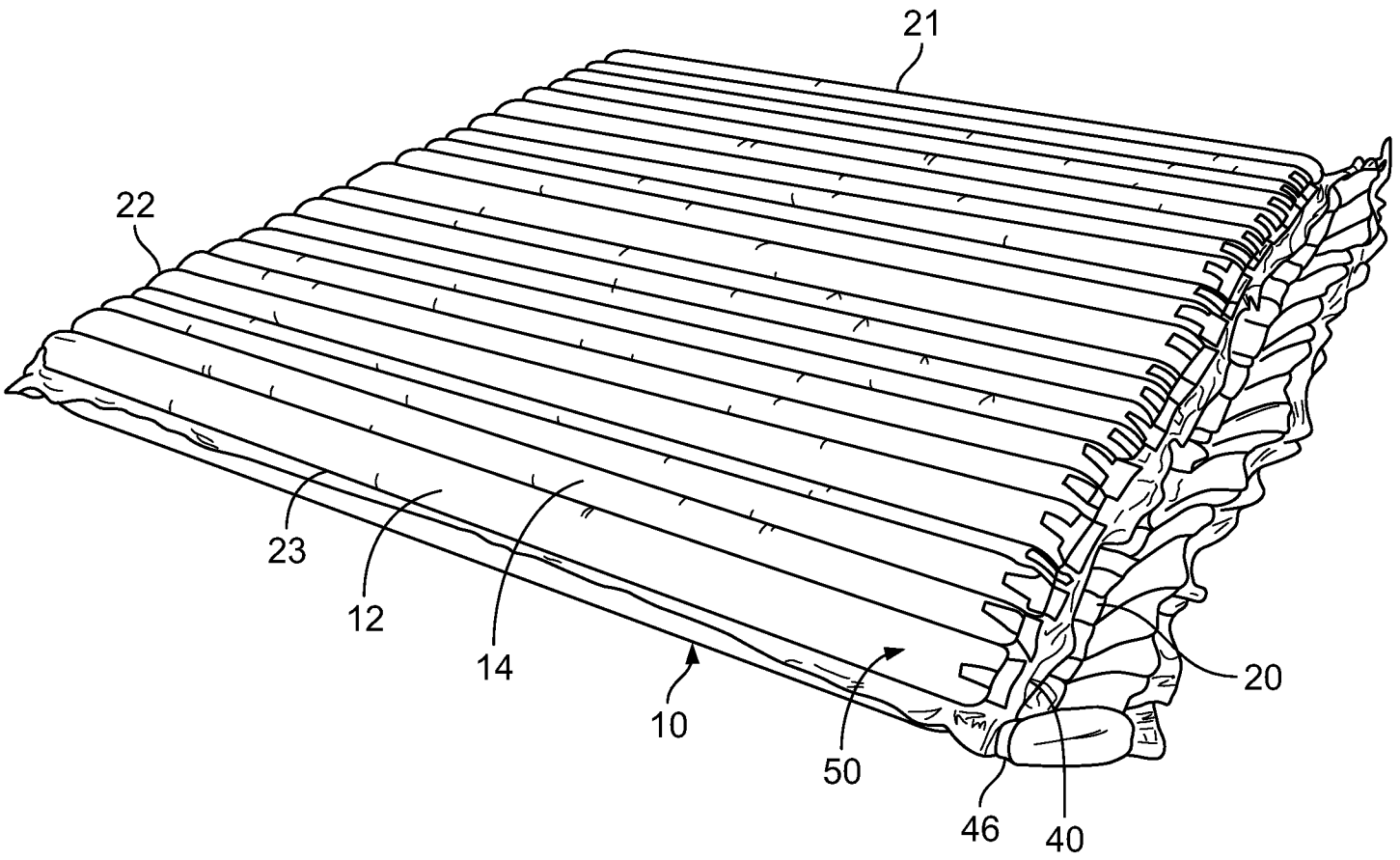
FIG. 10 is a perspective view of the packaging material of FIG. 1, shown after inflation.

Various embodiments of an inflatable packaging material, such as the material 10 described above, can be provided as a roll of sheet material that can be cut to a proper width and also cut and/or heat-sealed in additional places to create a packaging material of a desired shape for one or more desired applications. In general, the material 10 will at least be further sealed along the edges between the top and bottom seals 20, 22 to create a perimeter seal on the material 10, such as by side seals 21, 23, as shown in FIGS. 1 and 10. The spaced configuration of the passage portions 64 of the non-sealable material 60 allow the material 10 to be cut to any of a plurality of different widths. As shown in FIGS. 1 and 10, the material 10 can be cut and the side seals 21, 23 can be formed so that one side seal 21 passes through one of the gaps 65 between the passage portions 64 of the non-sealable material and the other side seal 23 passes through one of the passage portions 64 of the non-sealable material 60. As a result, the first side seal 21 seals completely through the inflation passage 42 to create the closed end 44, and the second side seal 23 is prevented by the non-sealable material 60 from closing off the inflation passage 42 to create the open end 46, which can be used as an inflation port. If a material 10 having a different width is desired, the material 10 can be cut to substantially any desired length, by cutting one side at a point between the passage portions 64 and the other side at a point that travels through one of the passage portions 64. The packaging material can then be inflated through the open end 46 of the inflation passage 42, such as by using an inflation nozzle or other such device. In one embodiment, a high-velocity, low-pressure inflation nozzle is used for this purpose. FIG. 10 illustrates an example of the material 10 of FIGS. 1-9 in an inflated state.

Figure 11:
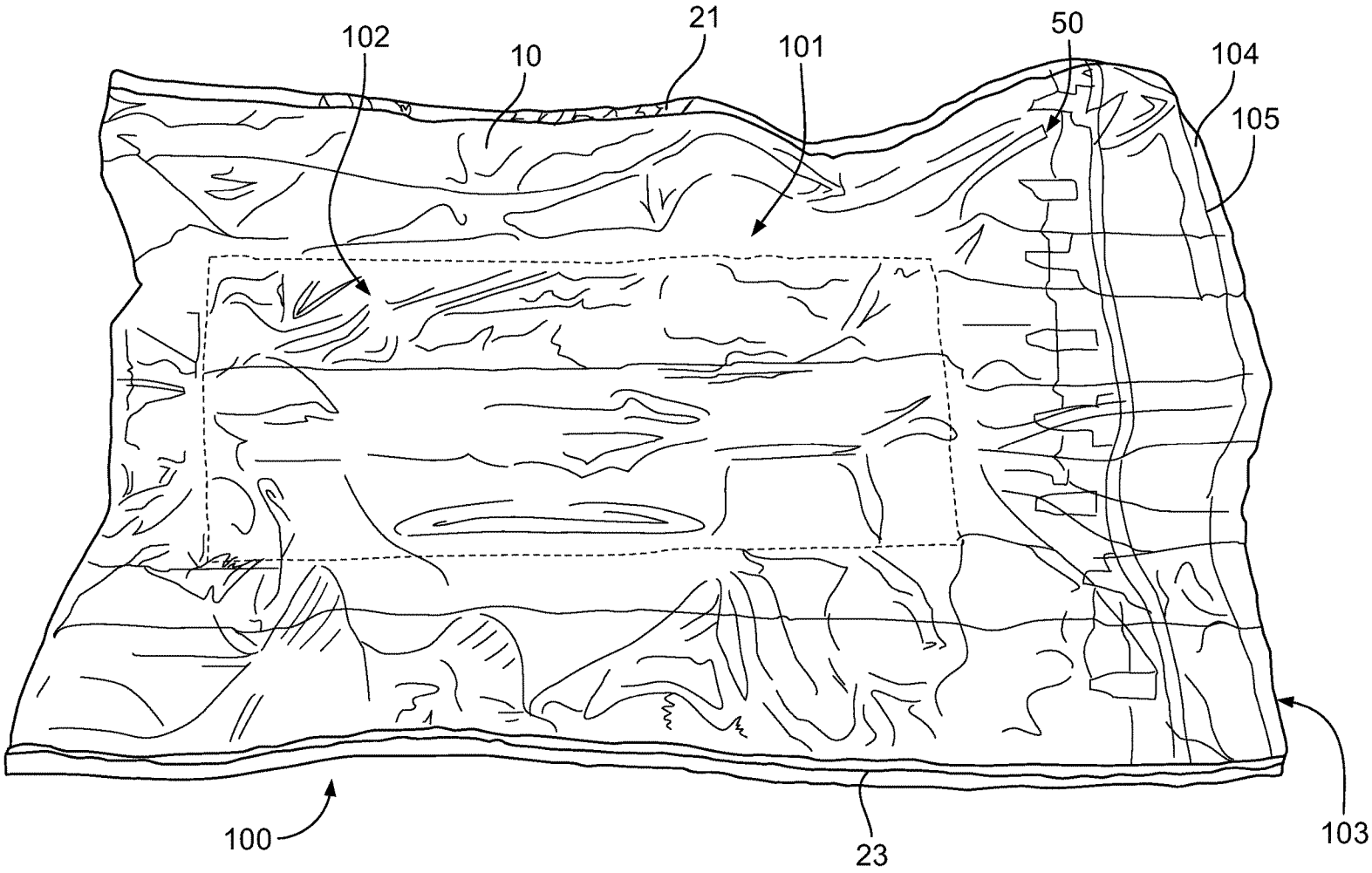
FIG. 11 is a perspective view of one embodiment of a packaging bag formed using a packaging material as illustrated in FIG. 1, shown after vacuum sealing, with an article contained within the bag.
Figure 12:
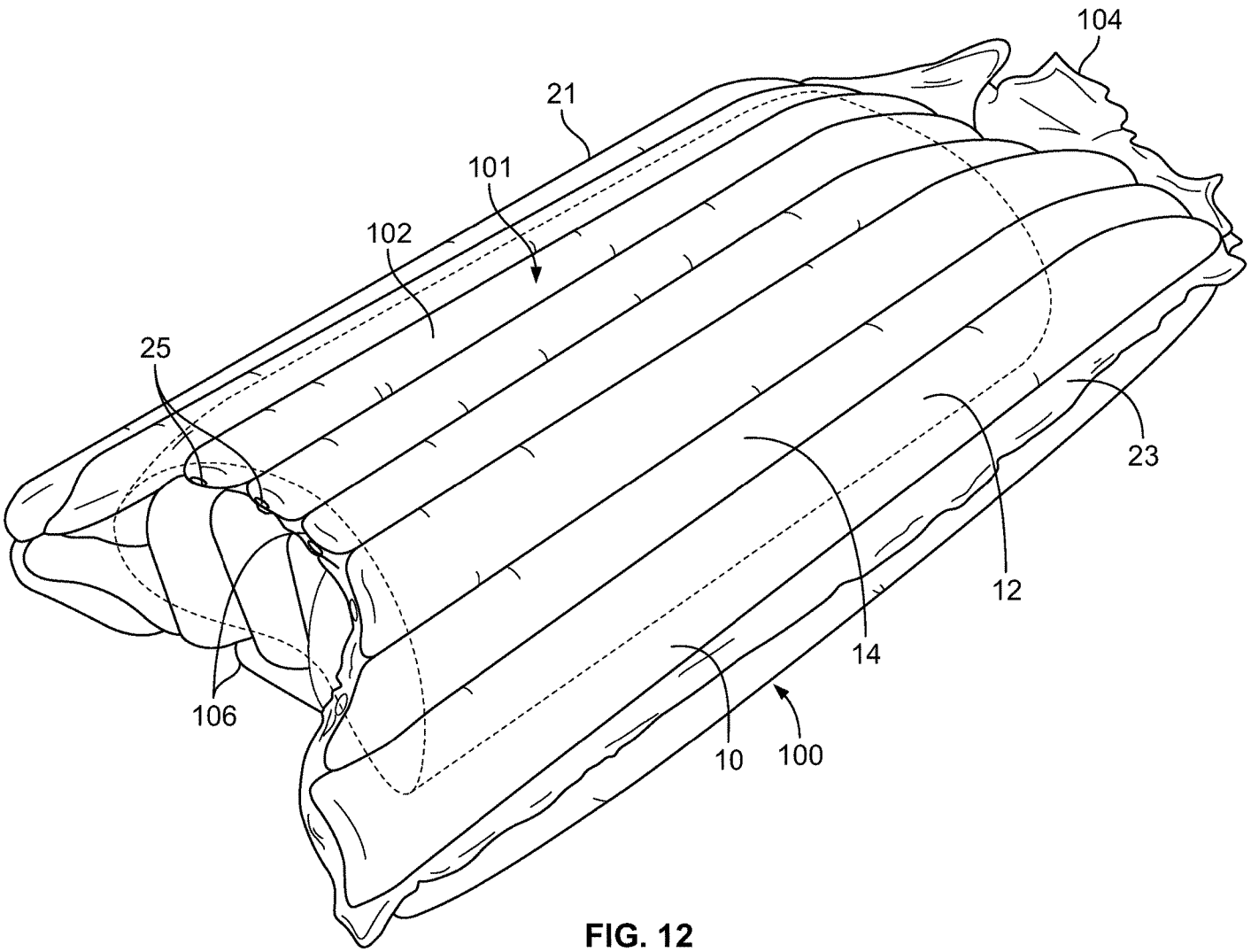
FIG. 12 is a perspective view of the packaging bag of FIG. 11, shown after vacuum sealing and inflation.
Figure 13:
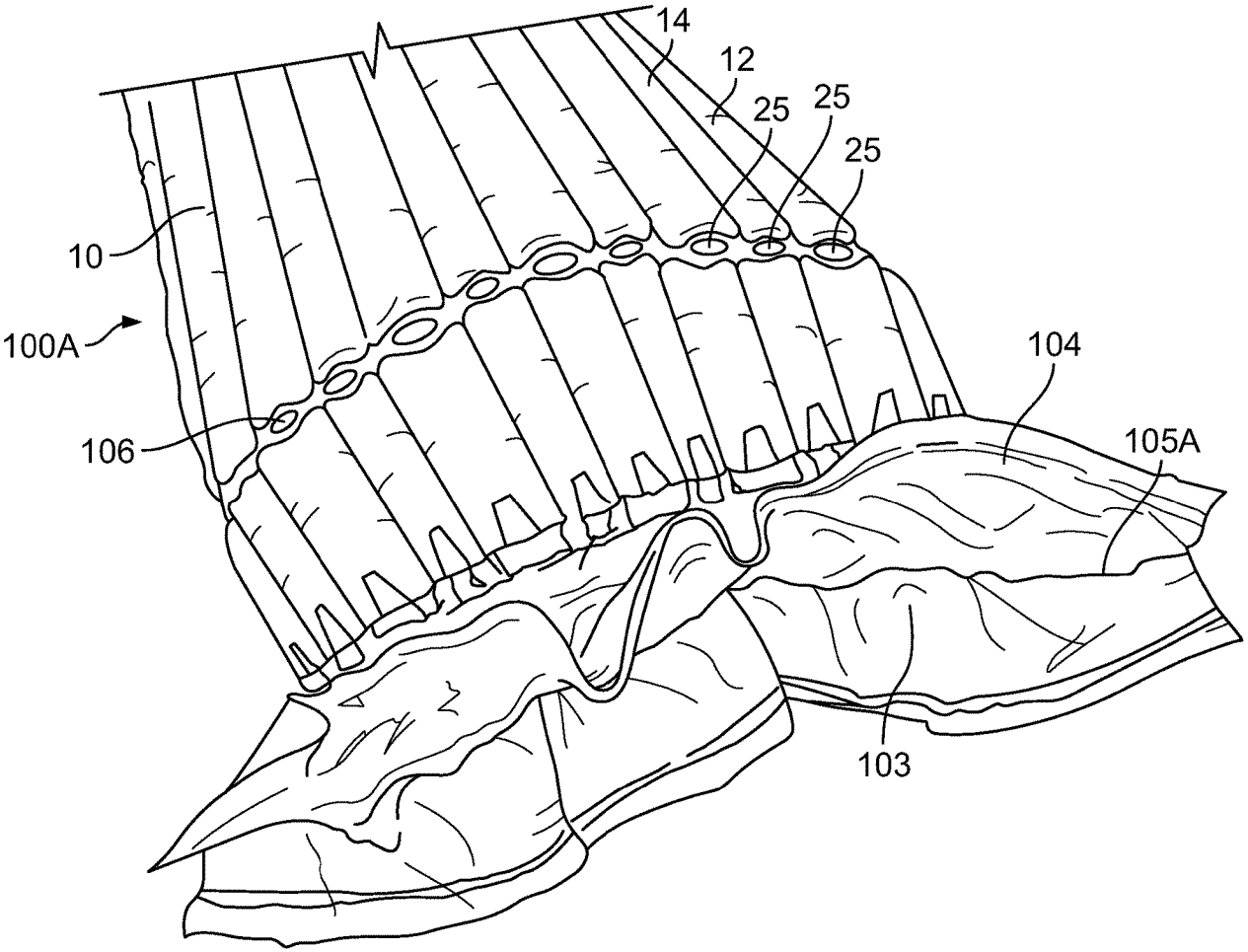
FIG. 13 is an end view of one embodiment of a packaging device formed from a packaging material according to the present invention.

In one embodiment, the material 10 can be made into a bag 100 having an internal cavity 101 for containing an article 102, as shown in FIGS. 11-12. The bag 100 can be constructed by folding the material 10 over upon itself and then forming the side seals 21, 23 along the sides of the material 10, extending through two layers of each of the outer films 16, 18 to form the internal cavity 101 with an open top 103 for insertion of the article 102. In this configuration, the inner surface of the internal cavity 101 is formed by one of the outer films 18 and the cavity 101 is defined by the side seals 21, 23 and the folded bottom of the material 10. After sealing, the inflation port 46 is accessible for inflating the material 10. Typically, the article is placed within the cavity 101 prior to inflation so that the air columns 12, 14 inflate to surround the article 102. An additional closing seal may be made to the bag 100 around the area of the top seal 20 to close the open top 103 of the bag 100. In this embodiment, the bag 100 contains end flaps 104 extending beyond the top seal 20, and the closing seal may be made across the end flaps 104. In another embodiment, the bag 100 may have one elongated end flap that can be folded downward and sealed along the side seals 21, 23 in order to seal the bag 100. Additionally, in this embodiment, the bag 100 has constriction seals 25 in some of the air columns 12, 14 that form joints 106 in the inflated bag 100, as shown in FIG. 13. The joints 106 formed by the constriction seals 25 form a more controlled and flattened bottom of the bag 100.

The bag 100 in FIGS. 11-12 is also configured for vacuum sealing. As shown in FIG. 11, the bag 100 includes the end flaps 104 formed by top and bottom flaps of the material 10 located above the top seal 20 and below the bottom seal 22. Once the article 102 is inserted into the cavity 101 of the bag 100, the bag 100 can be vacuum sealed by applying a vacuum-sealing apparatus to the open top 103 of the bag 100, forming a vacuum seal line 105 across the end flap 104, as shown in FIG. 11. The vacuum sealing evacuates or substantially evacuates air and/or other gases or fluids from the internal cavity 101 and seals the cavity 101 to conform the uninflated bag 100 to the shape of the article 102. After vacuum sealing, the bag 100 is inflated, such as by applying an inflation nozzle to the inflation port 46, as described above. The inflated bag 100 is shown in FIG. 12. The vacuum sealed bag 100 conforms more closely to the shape of the article 102 as compared to existing bags and other packaging materials, which can result in more effective cushioning of the article 102 during transit.

Figure 14:
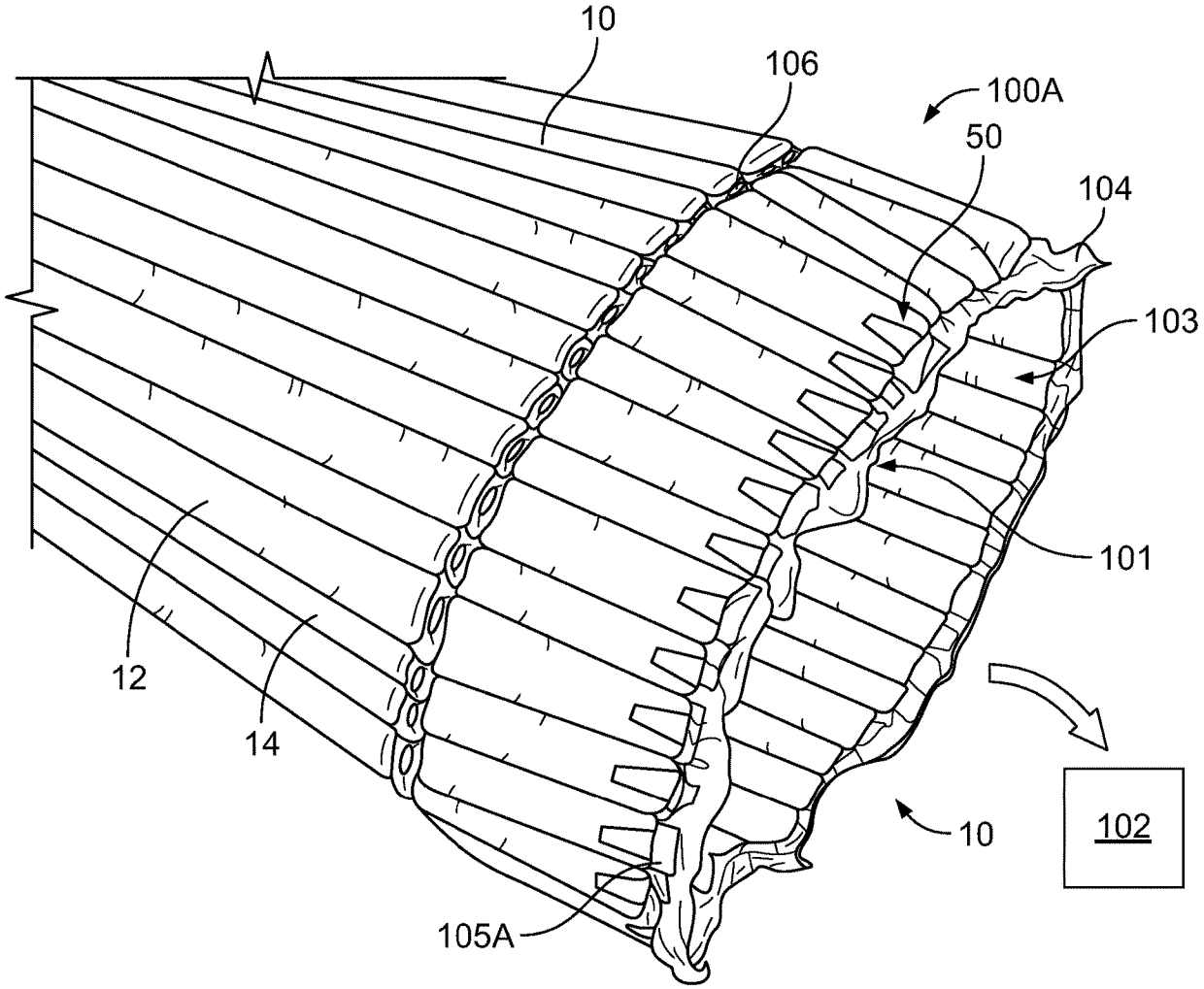
FIG. 14 is a perspective view of the packaging bag of FIG. 13, shown after the bag has been opened and the article removed.

The vacuum sealed and inflated bag 100 can also be opened to allow the article 102 to be removed without rupturing or otherwise deflating the air columns 12, 14, so that the bag 100 can be used again, such as for a return shipment. Opening the bag 100 can be accomplished in a number of ways. For example, the vacuum seal 105 can be pulled apart by a user, such as by gripping free portions of the end flap 104. This method of opening the bag 100 is illustrated in FIG. 14, which depicts an alternate embodiment being opened in a similar manner, as described in more detail below. In one embodiment, the outer films 16, 18 may include a peelable additive to facilitate peeling apart the vacuum seal 105. This peelable additive may be added to the film composition or may be applied as a coating or other external treatment, and the additive may also be included or applied to other films in the material 10. It is understood that the peelable additive may be used in non-vacuum sealed bags and other devices as well, to facilitate opening and other such actions. As another example, the bag 100 can be opened by tearing or cutting across the end flap 104 at a point between the vacuum seal 105 and the top seal 20. Further techniques for opening the bag 100 are also contemplated. After the bag 100 is opened, the article 102 can be removed, and another article can be inserted into the cavity 101. The bag 100 may be sealed or vacuum sealed again for transporting the new article, or may remain open during transit, however the air columns 12, 14 remain inflated to protect the new article. These features enhance the re-usability of the bag 100, which increases its utility in the field of shipping ink cartridges for printers. A new ink cartridge can be shipped to a customer in the vacuum sealed bag, and the used ink cartridge can be returned to the manufacturer in the reused bag 100. Of course, these features may prove advantageous in any number of other fields as well.

The material 10 can be manufactured in a number of different manners. The non-sealable material 60 may be applied to one or more of the valve layers 54, 56, 58 prior to assembly. In one embodiment, the non-sealable material 60 is applied as an ink on both sides of the middle valve layer 58, in the desired pattern. Then, the various layers 16, 18, 54, 56, 58 are placed together in the proper arrangement, with the outer layers 16, 18 on the outside, and the upper, middle, and lower valve layers 54, 58, 56 positioned between the outer layers 16, 18 in that respective order. These layers 16, 18, 54, 56, 58 can be run together from rolls or other bulk supplies of plastic sheet. Once the layers 16, 18, 54, 56, 58 are assembled, at least one heat seal is applied to connect the layers 16, 18, 54, 56, 58 together. In one embodiment, the top seal 20, the bottom seal 22, and the valve seal 28 are all applied prior to further processing, either in a single step or in successive steps. Next, the border seals 24, 26 and optionally other heat seals are applied to the layers 16, 18, 54, 56, 58 in the appropriate locations, which may be done in a single step or in successive steps. In one embodiment, the constriction seals 25, which partially define the shape of the finished product, are also applied at this point, however in other embodiments, at least some of the constriction seals 25 may be applied later, creating more versatility of use for the produced material 10. The material 10 can then be cut to an appropriate width and further sealed, including at least creating the side seals 21, 23, in order to make the finished product. The sealing steps can be performed on a rotary-style sealing machine, a platen-style sealing machine, or another type of sealing machine, or a combination of such sealing machines. Creating the finished product may also include cutting out one or more portions of the material 10 and/or making additional seals, such as constriction seals 25. Forming the bag 100 as described above may require forming at least some constriction seals 25, as well as folding the material 10 over upon itself and sealing the sides of the material to create the internal cavity 101 and the open top 103.

Figure 15:
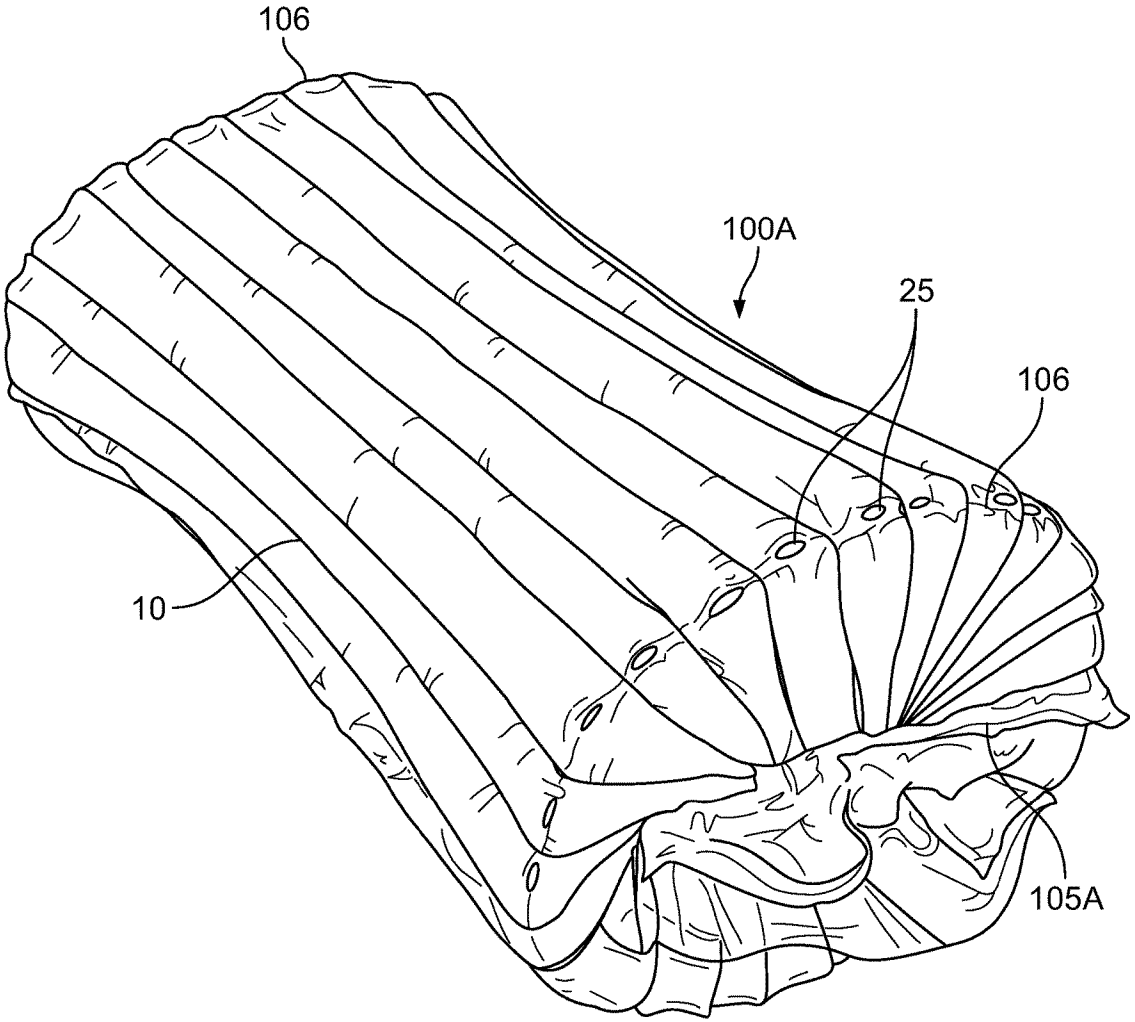
FIG. 15 is another end view of the packaging device of FIG. 13.

FIGS. 13-15 illustrate an alternate embodiment of the bag 100 of FIGS. 11-12, referred to using reference numeral 100A. The bag 100A of FIGS. 13-15 is not vacuum sealed, but rather, is heat sealed along a seal line 105A, without evacuating the cavity 101. The bag 100A of FIGS. 13-15 may be made from the material 10 described above, or a variation of such material, and in one embodiment, the bag 100A may be structurally identical to the bag 100 of FIGS. 11-12. As shown in FIG. 15, after the air columns 12, 14 of the bag 100A are inflated, the flaps 104 can be folded inwardly or cut off, in order to avoid excess material. Additionally, as shown in FIG. 14, the bag 100A can be opened by pulling on the flaps 104 to separate them and break the seal 105A and open the top 103, allowing the article 102 to be removed from the cavity 101.

The material 10 described above and shown in FIGS. 1-10 can also be used to form a number of other packaging devices, such as the embodiments shown in FIGS. 16-30. Each of these embodiments is described in greater detail below.

Figure 16:
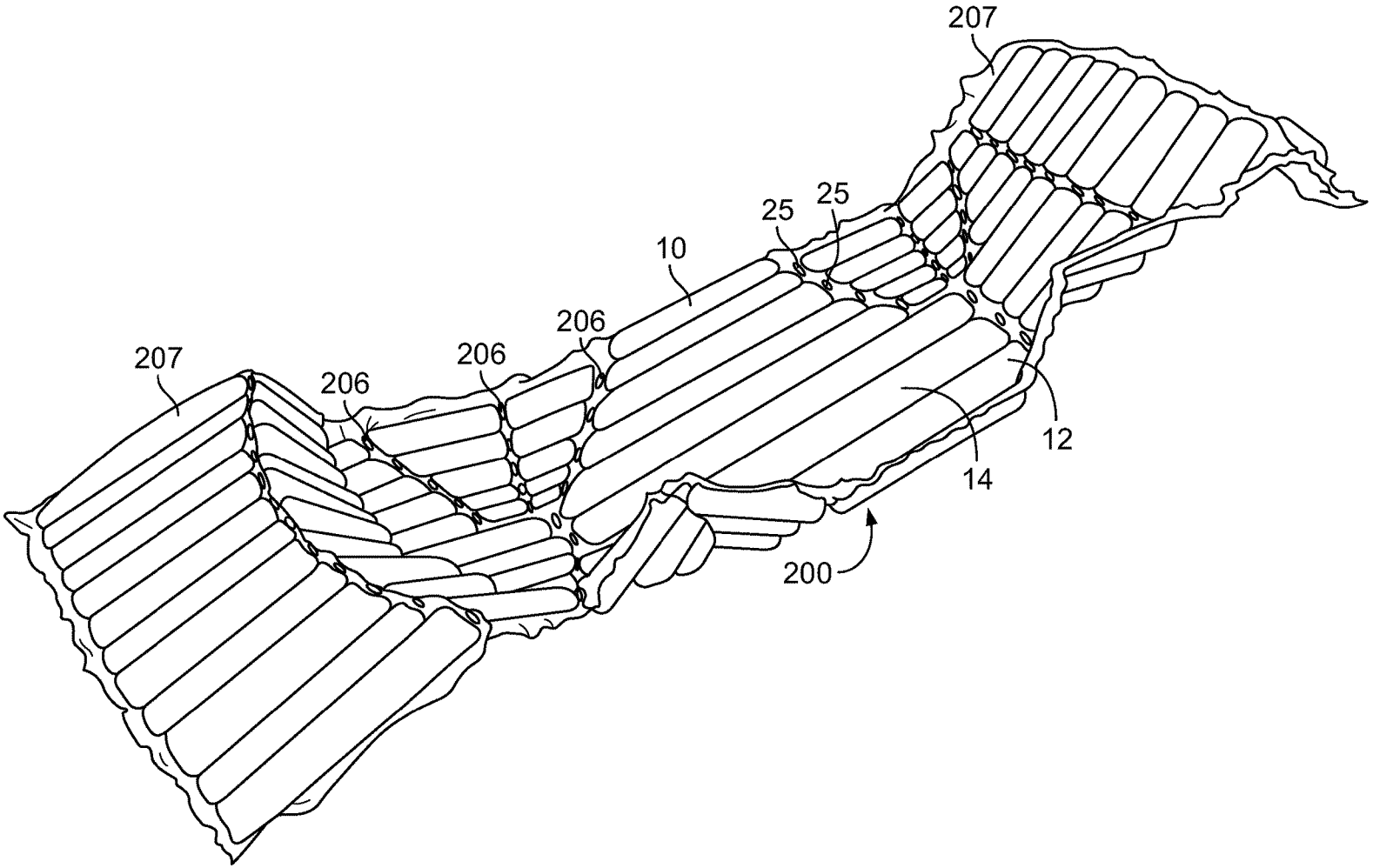
FIG. 16 is a perspective view of another embodiment of a packaging device formed from a packaging material according to the present invention.
Figure 17:
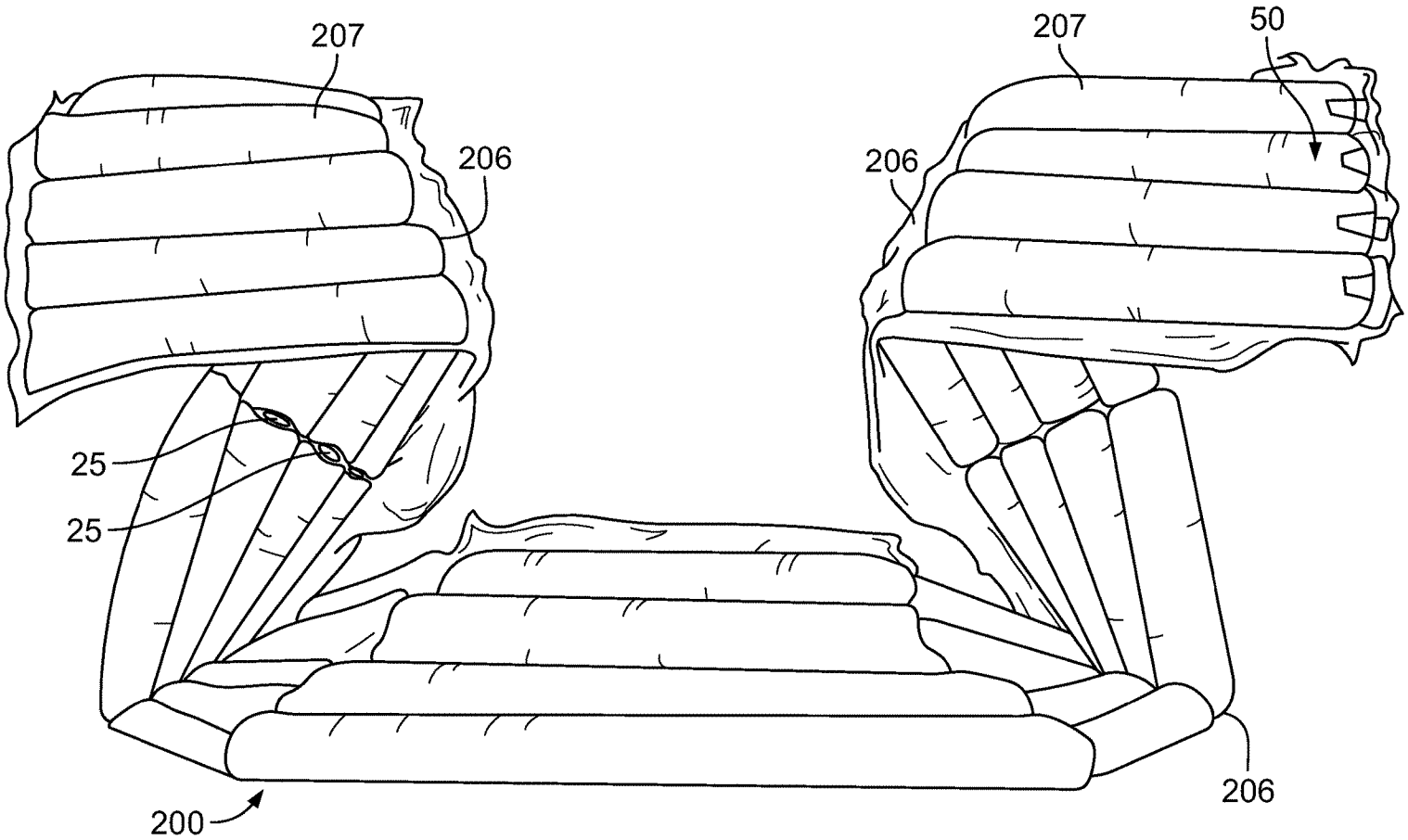
FIG. 17 is a perspective view of the packaging device of FIG. 16, shown in a folded position.

FIGS. 16-17 illustrate one embodiment of a packaging device 200 formed from a packaging material 10 as described above. It is understood that features of the material 10 described above are referenced in FIGS. 16-17 using similar reference numbers, and are not described again with respect to the device 200 for the sake of brevity. The device 200 contains a plurality of constriction seals 25 forming a plurality of joints 206 and creating two arms 207 that are configured to be folded inwardly and back outwardly to form the device 200 into a "double-N" shaped configuration. This device 200 may be used for placing over an end of an article, so that the article is received between the arms 207, and then placed in a box, so that the arms 207 and other portions of the device 200 engage the sides of the box to suspend the article.

Figure 18:
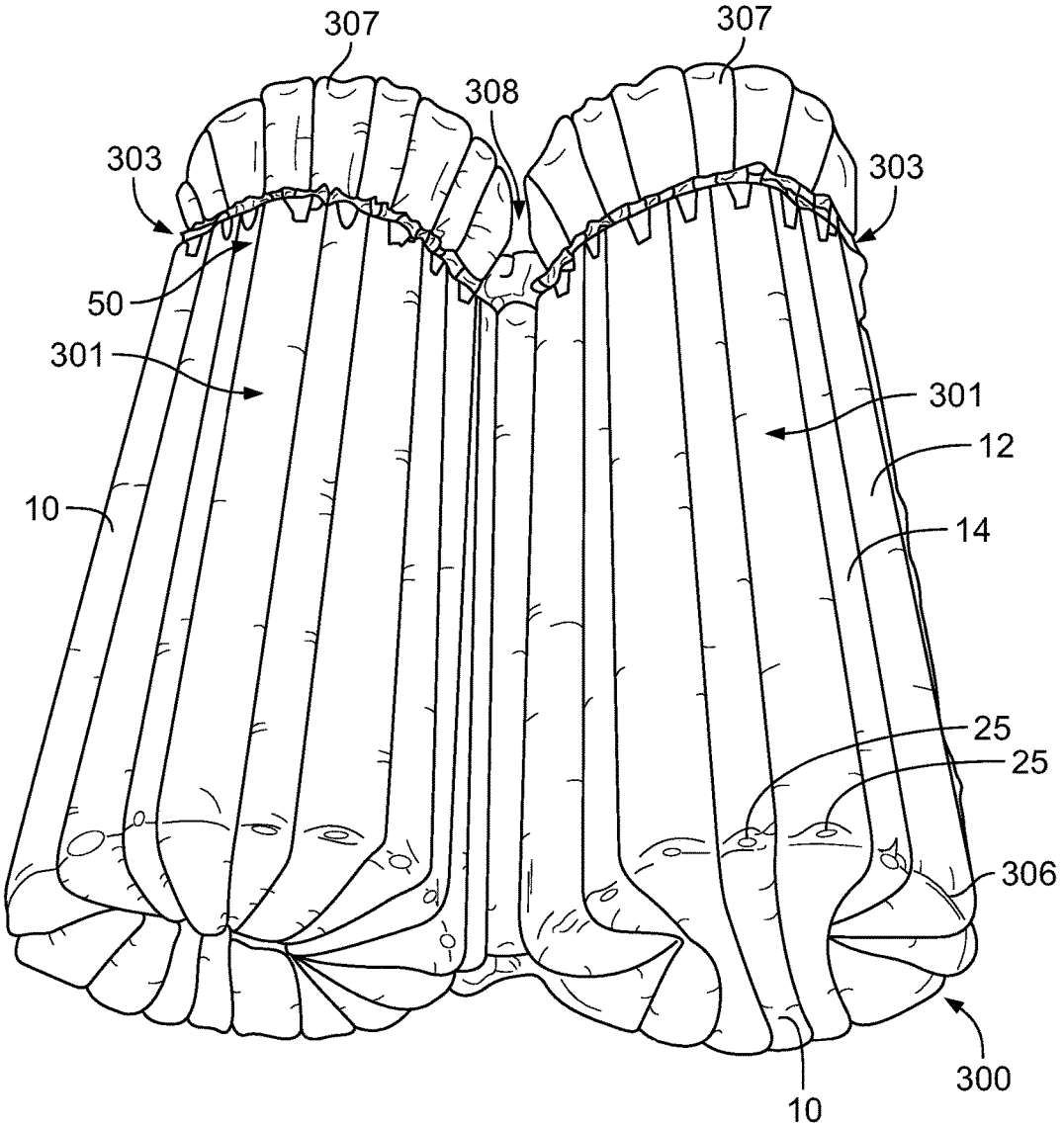
FIG. 18 is a perspective view of another embodiment of a packaging device formed from a packaging material according to the present invention.
Figure 19:
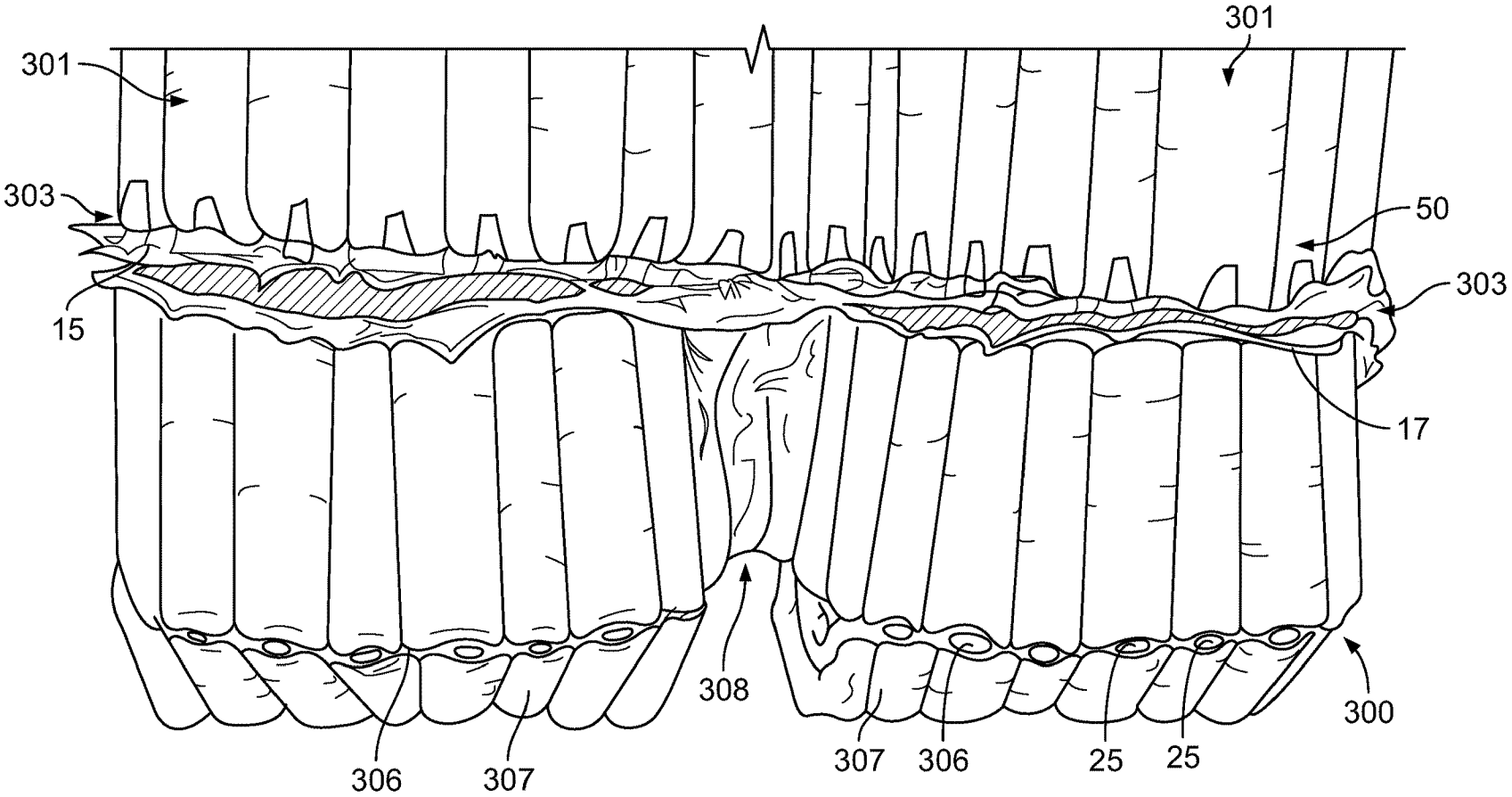
FIG. 19 is an end view of the packaging device of FIG. 18.
Figure 20:
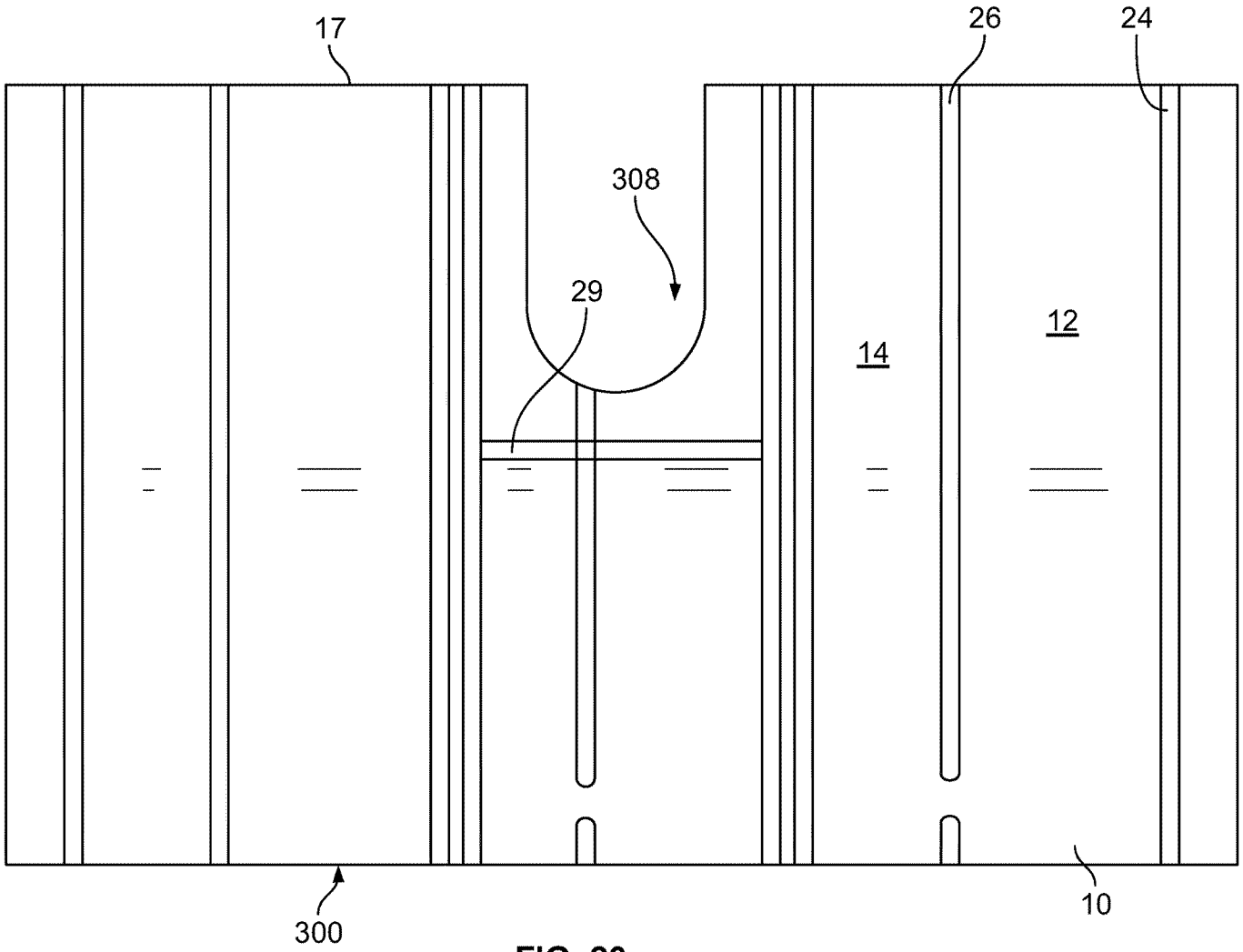
FIG. 20 is a plan view of a portion of the packaging device of FIG. 18, shown in an uninflated state.

FIGS. 18-20 illustrate another embodiment of a packaging device 300 formed from a packaging material 10 as described above. It is understood that features of the material 10 described above are referenced in FIGS. 18-20 using similar reference numbers, and are not described again with respect to the device 300 for the sake of brevity. The device 300 contains a plurality of constriction seals 25 forming a plurality of joints 306 and creating two internal cavities 301 for receiving two articles, such as bottles of wine or another fluid. The joints 306 form a flat bottom, as well as two hinged lid portions 307 to cover the open tops 303 of the cavities 301. Additionally, a portion 308 of the material 10 near the bottom seal 22 is cut out after forming, and portions of the adjacent columns 12, 14 are blocked from inflation to form the lid portions 307, as shown in FIGS. 19-20. The cut out portion 308 may be formed by die cutting, or another technique. The material 10 contains an additional seal 29 to block inflation of the portions of the material 10 around the cut out portion 308, as shown in FIG. 20.

Figure 21:
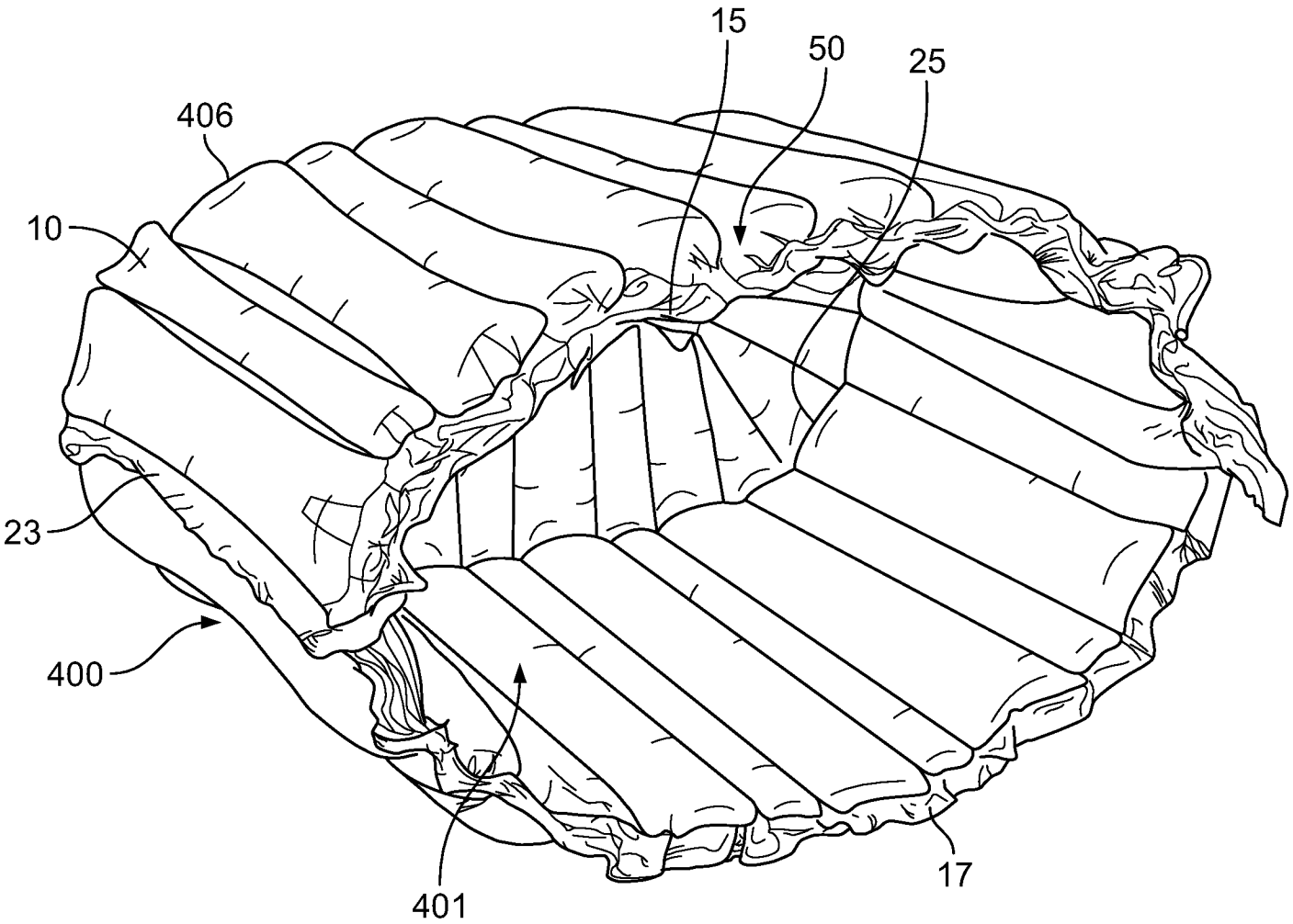
FIG. 21 is a perspective view of another embodiment of a packaging device formed from a packaging material according to the present invention.

FIG. 21 illustrates another embodiment of a packaging device 400 formed from a packaging material 10 as described above. It is understood that features of the material 10 described above are referenced in FIG. 21 using similar reference numbers, and are not described again with respect to the device 400 for the sake of brevity. The device 400 is folded over on itself to create an internal cavity 401, similar to the bag 100 in FIGS. 11-15. However, in this embodiment, the constriction seals 25 and the resultant joints 406 are configured to create an oval-shaped, flattened bottom and to open up the cavity 401 upon inflation. The device 400 can be used as an "end cap" for placing over the end of an article during transit. Another similar device 400 can be used as another end cap on the opposite end of the article to provide balance and further protection.

Figure 22:
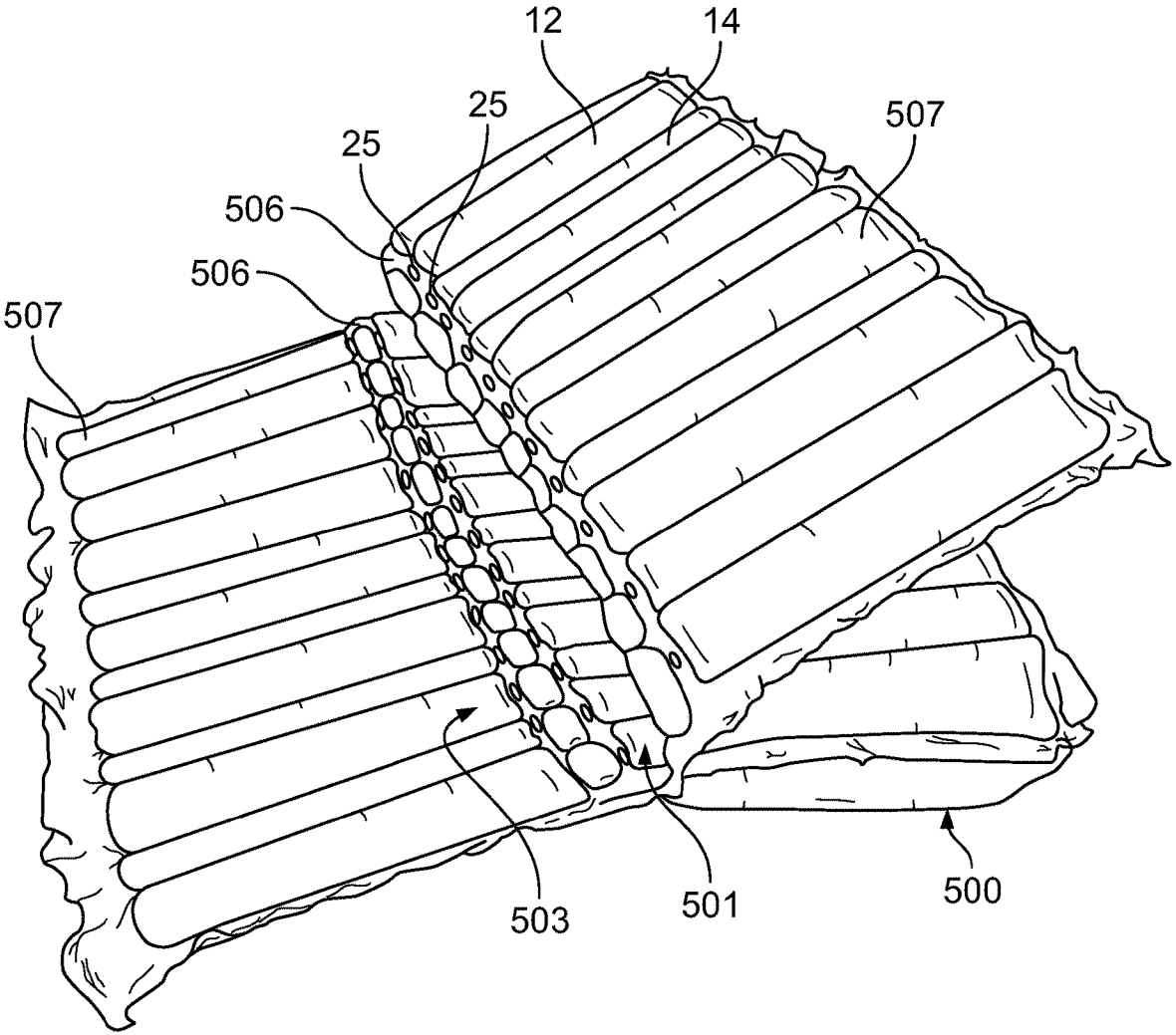
FIG. 22 is a perspective view of another embodiment of a packaging device formed from a packaging material according to the present invention.
Figure 23:
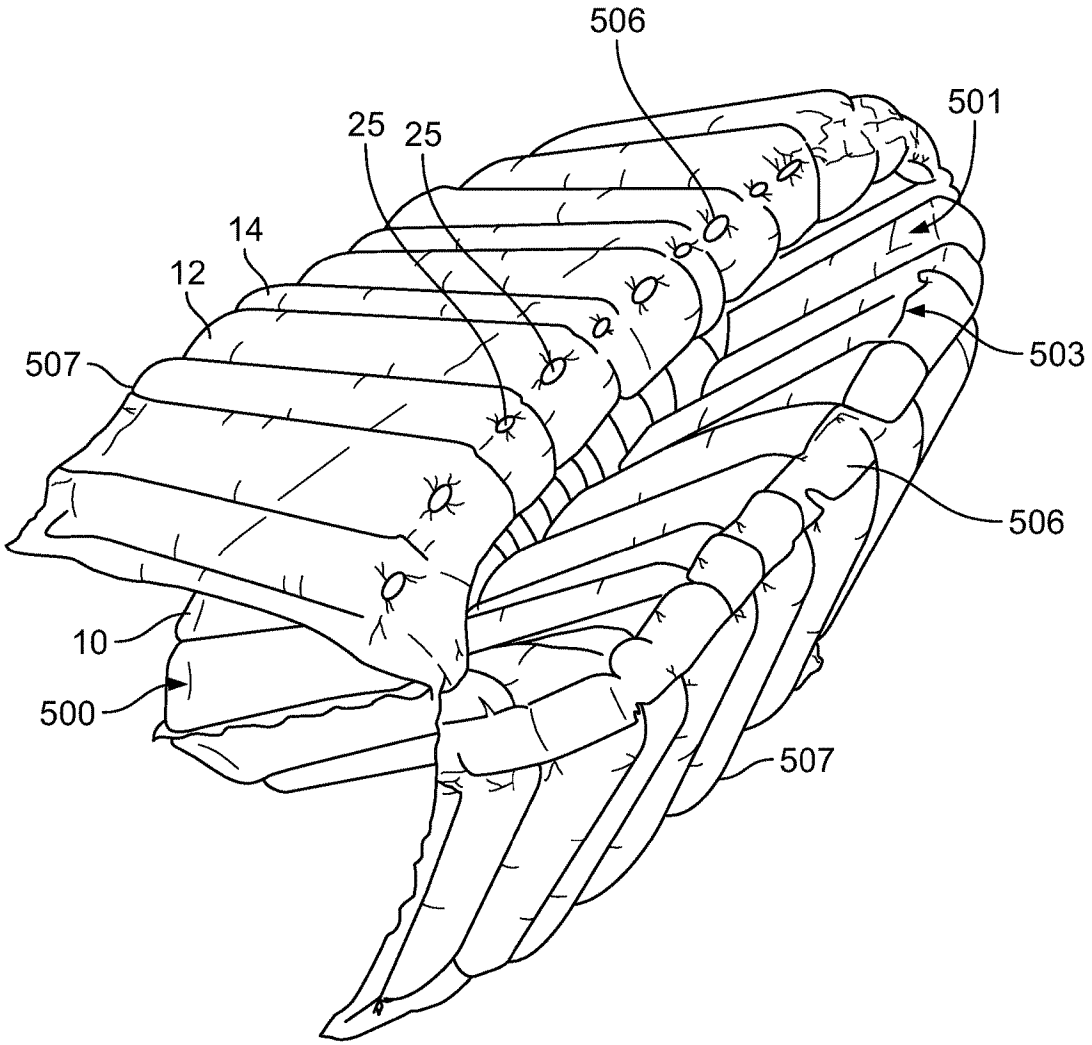
FIG. 23 is an end view of the packaging device of FIG. 22.

FIGS. 22-23 illustrate another embodiment of a packaging device 500 formed from a packaging material 10 as described above. It is understood that features of the material 10 described above are referenced in FIGS. 22-23 using similar reference numbers, and are not described again with respect to the device 500 for the sake of brevity. The device 500 is folded over on itself to create an internal cavity 501, similar to the bag 100 in FIGS. 11-15. However, in this embodiment, the side seals 21, 23 only connect the folded portions of the material 10 over a portion of the length of the material, creating two arms 507 at the open top 503 of the device 500. The constriction seals 25 and the resultant joints 506 are configured to permit the arms 507 to be foldable and spreadable. The device 500 can be used as an "end cap" for placing over the end of an article during transit, as described above, or can also be used as a complete protective covering for an article.

Figure 24:
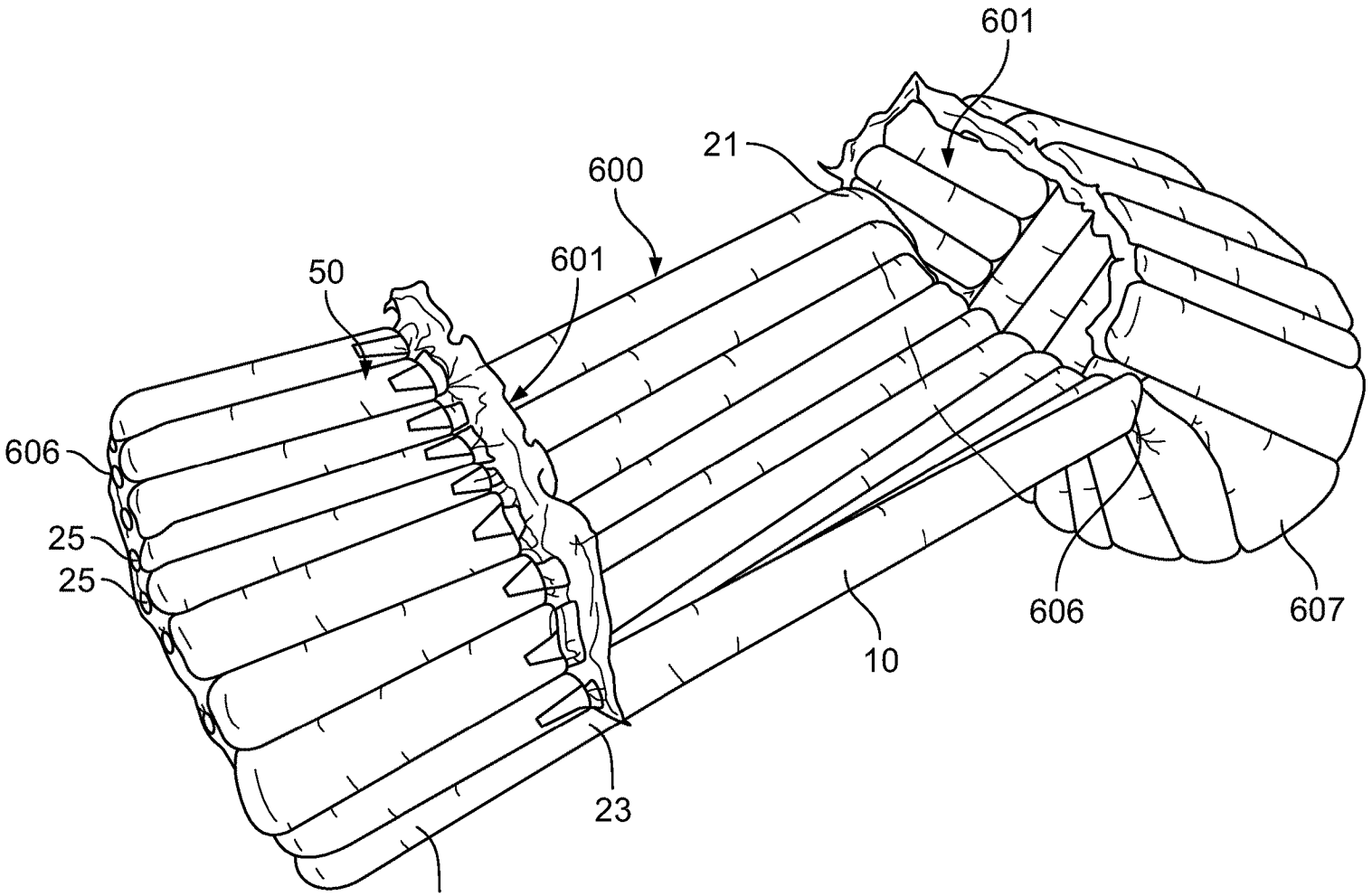
FIG. 24 is a perspective view of another embodiment of a packaging device formed from a packaging material according to the present invention.
Figure 25:
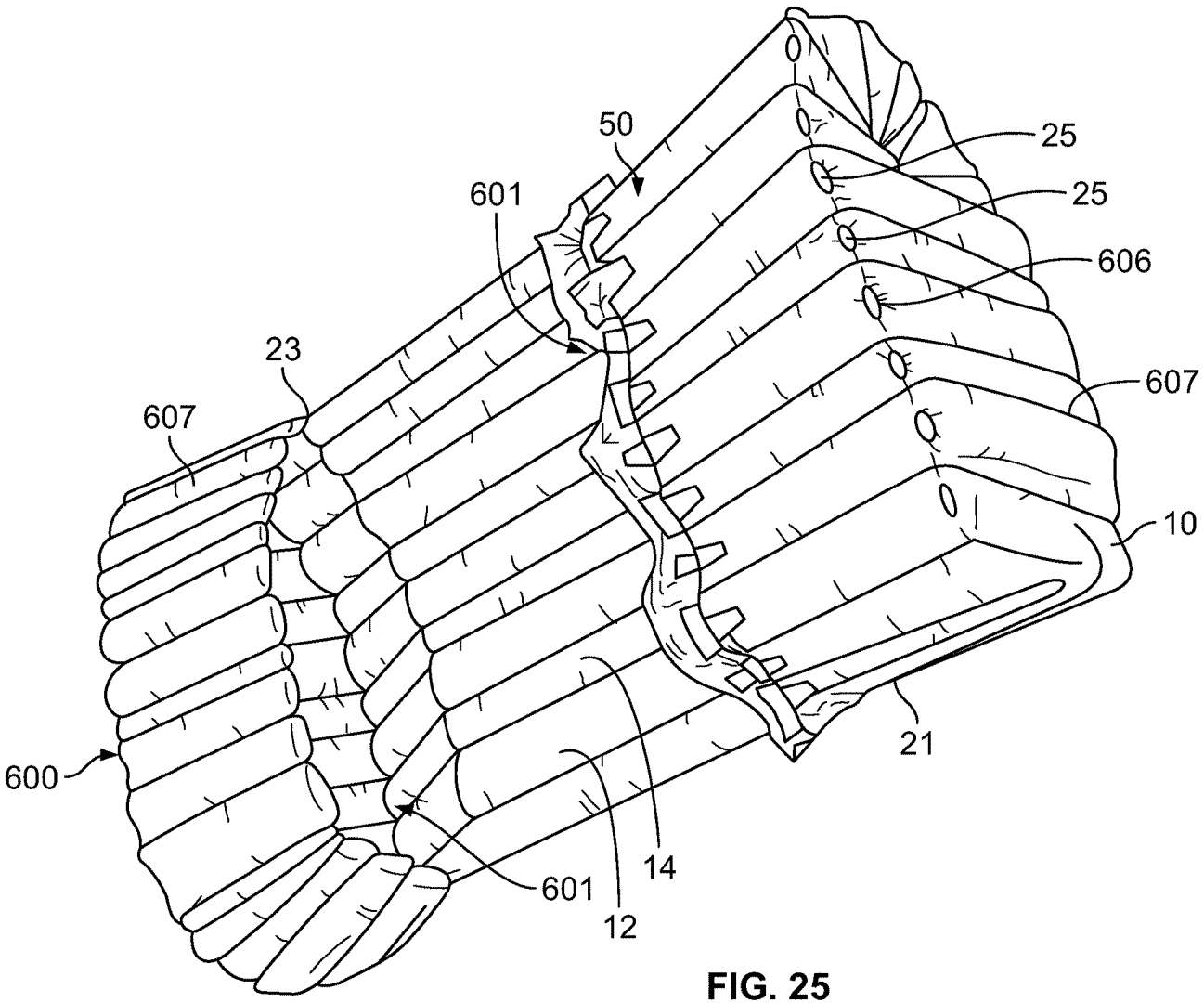
FIG. 25 is another perspective view of the packaging device of FIG. 24.

FIGS. 24-25 illustrate another embodiment of a packaging device 600 formed from a packaging material 10 as described above. It is understood that features of the material 10 described above are referenced in FIGS. 24-25 using similar reference numbers, and are not described again with respect to the device 600 for the sake of brevity. The device 600 contains a plurality of constriction seals 25 forming a plurality of joints 606 and creating two internal cavities 601 for receiving one or more articles, such as a bottle of wine or another fluid or another elongated article. The joints 606 and side seals 21, 23 create two end caps 607, each having a relatively flat bottom surface and defining one of the cavities 601 therein. Additionally, the device 600 has an open portion between the two end caps 607. The end caps 607 can be hinged, similarly to the lid portions 307 described above with respect to FIGS. 18-20. FIG. 24 illustrates one of the end caps 607 hinged backward to receive an article.

Figure 26:
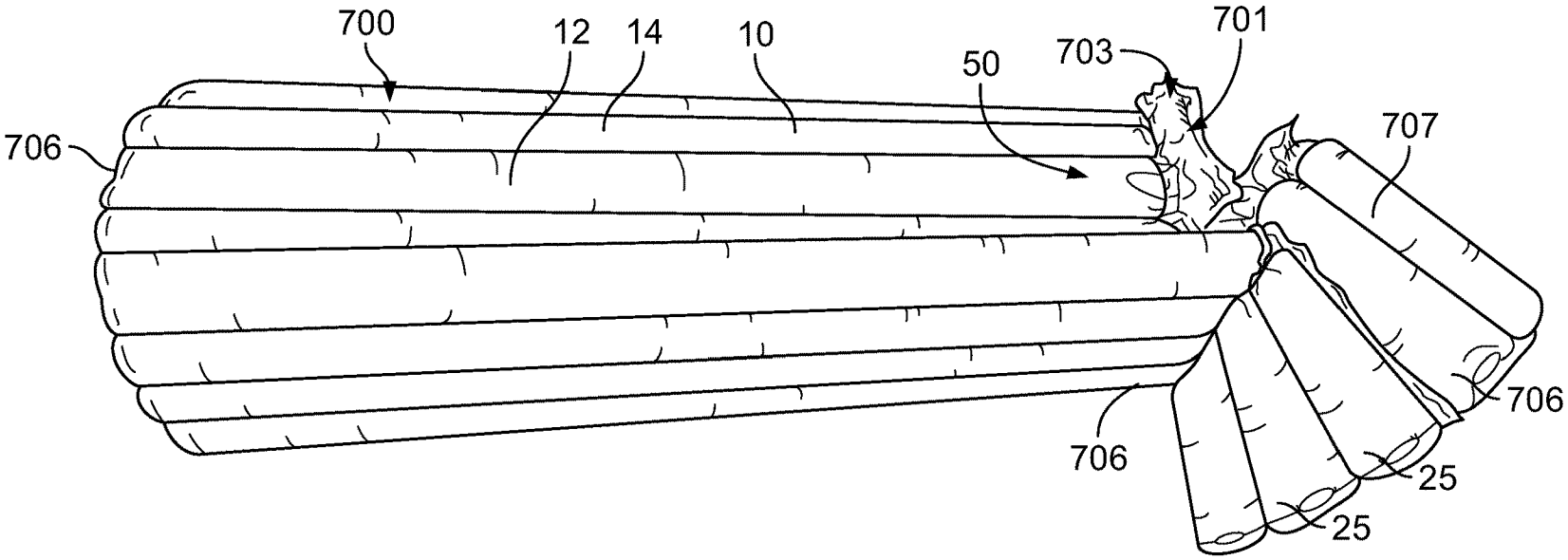
FIG. 26 is a side view of another embodiment of a packaging device formed from a packaging material according to the present invention.
Figure 27:
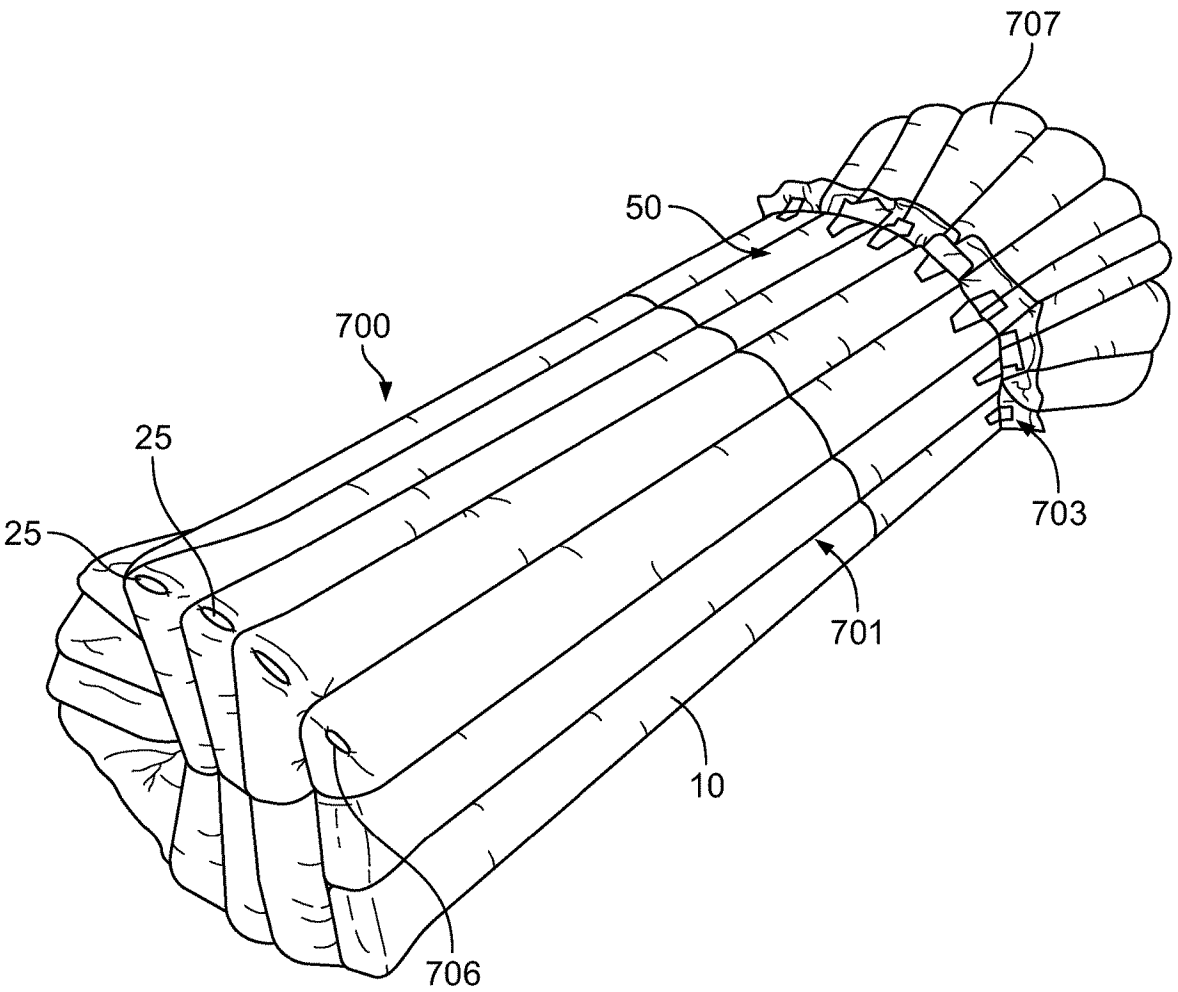
FIG. 27 is a perspective view of the embodiment of the packaging device of FIG. 26.

FIGS. 26-27 illustrate another embodiment of a packaging device 700 formed from a packaging material 10 as described above. It is understood that features of the material 10 described above are referenced in FIGS. 26-27 using similar reference numbers, and are not described again with respect to the device 700 for the sake of brevity. The device 700 contains a plurality of constriction seals 25 forming a plurality of joints 706 and creating an internal cavity 701 for receiving one or more articles. The joints 706 form a flat bottom, as well as a hinged lid portion 707 to cover the open top 703 of the cavity 701. The hinged lid portion 707 can be opened and closed for insertion or removal of an article from the cavity 701, and also protects the top of the article.

Figure 28:
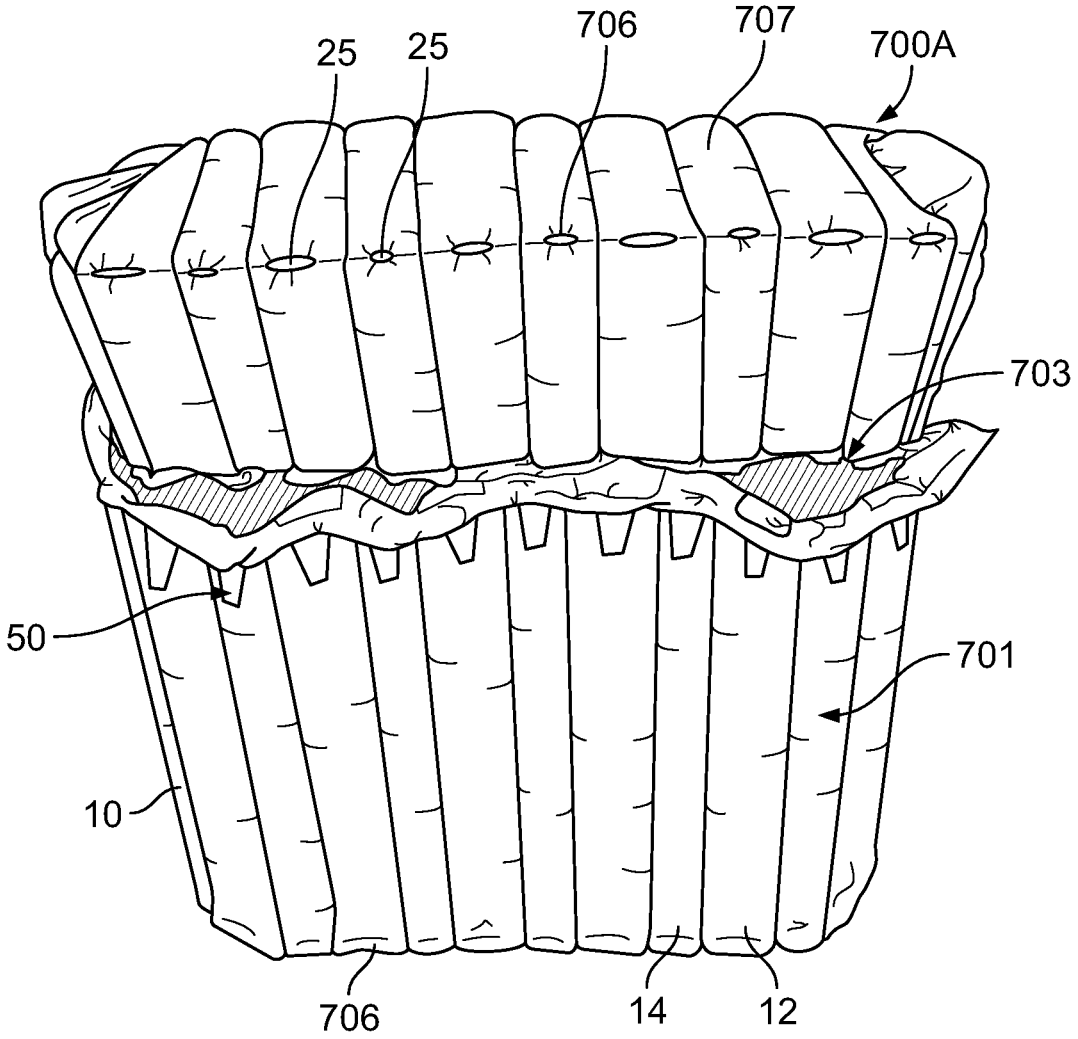
FIG. 28 is an end view of an alternate embodiment of the packaging device of FIG. 26.

FIG. 28 illustrates an alternate embodiment of the packaging device 700 of FIGS. 26-27. The packaging device 700A of FIG. 28 has a wider internal cavity 701, which can accommodate larger or more numerous articles. The device 700A of FIG. 28 contains similar components to the device 700 of FIGS. 26-27, but is folded and sealed in order to create the larger cavity 701 and a correspondingly wider lid 707. In one example, the packaging device 700 of FIGS. 26-27 can be configured to hold a single wine bottle, while the packaging device 700A of FIG. 28 may hold a hard drive or other larger article.

Figure 29:
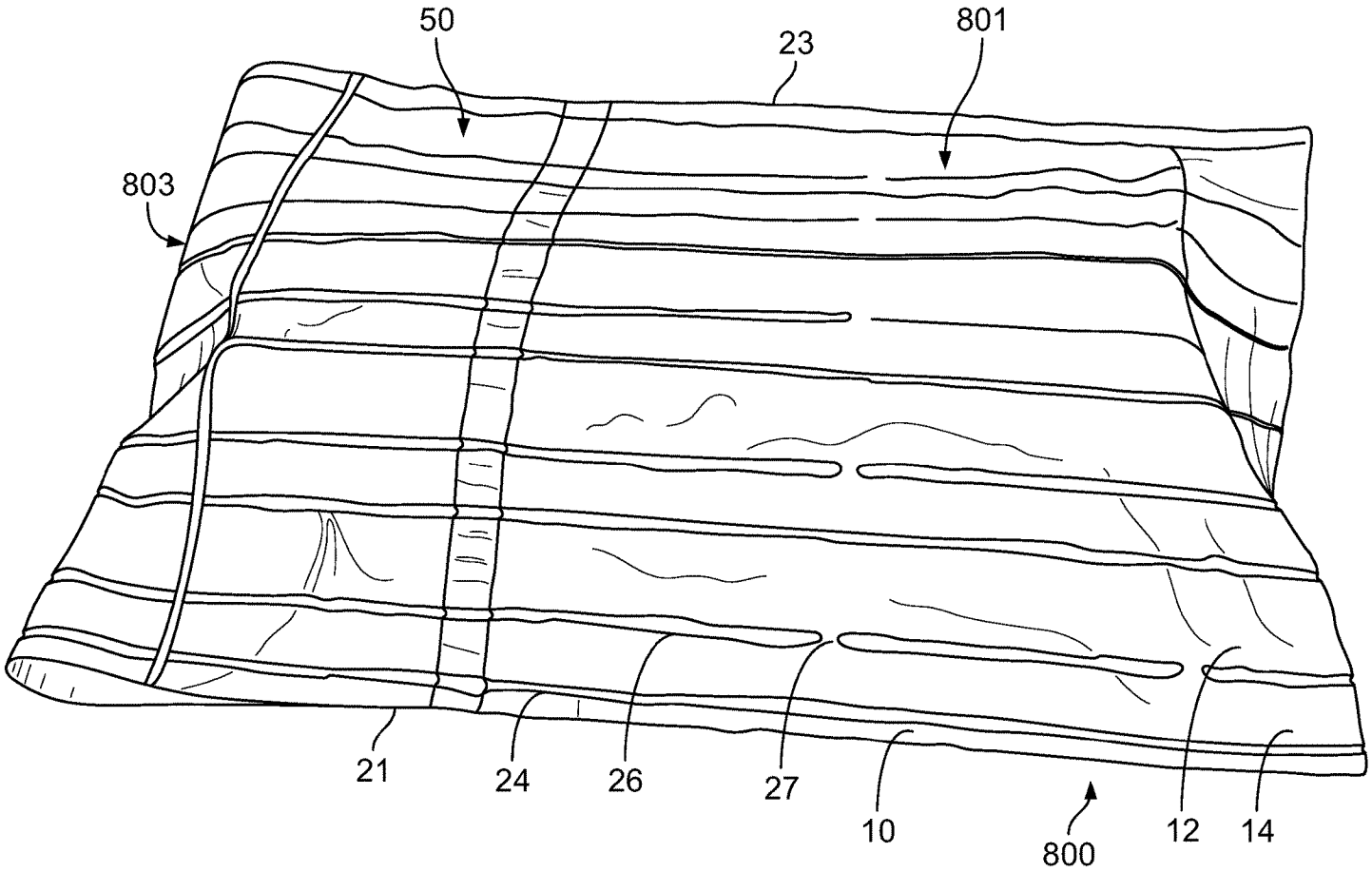
FIG. 29 is a perspective view of another embodiment of a packaging device formed from a packaging material according to the present invention, shown in an uninflated state.
Figure 29A:
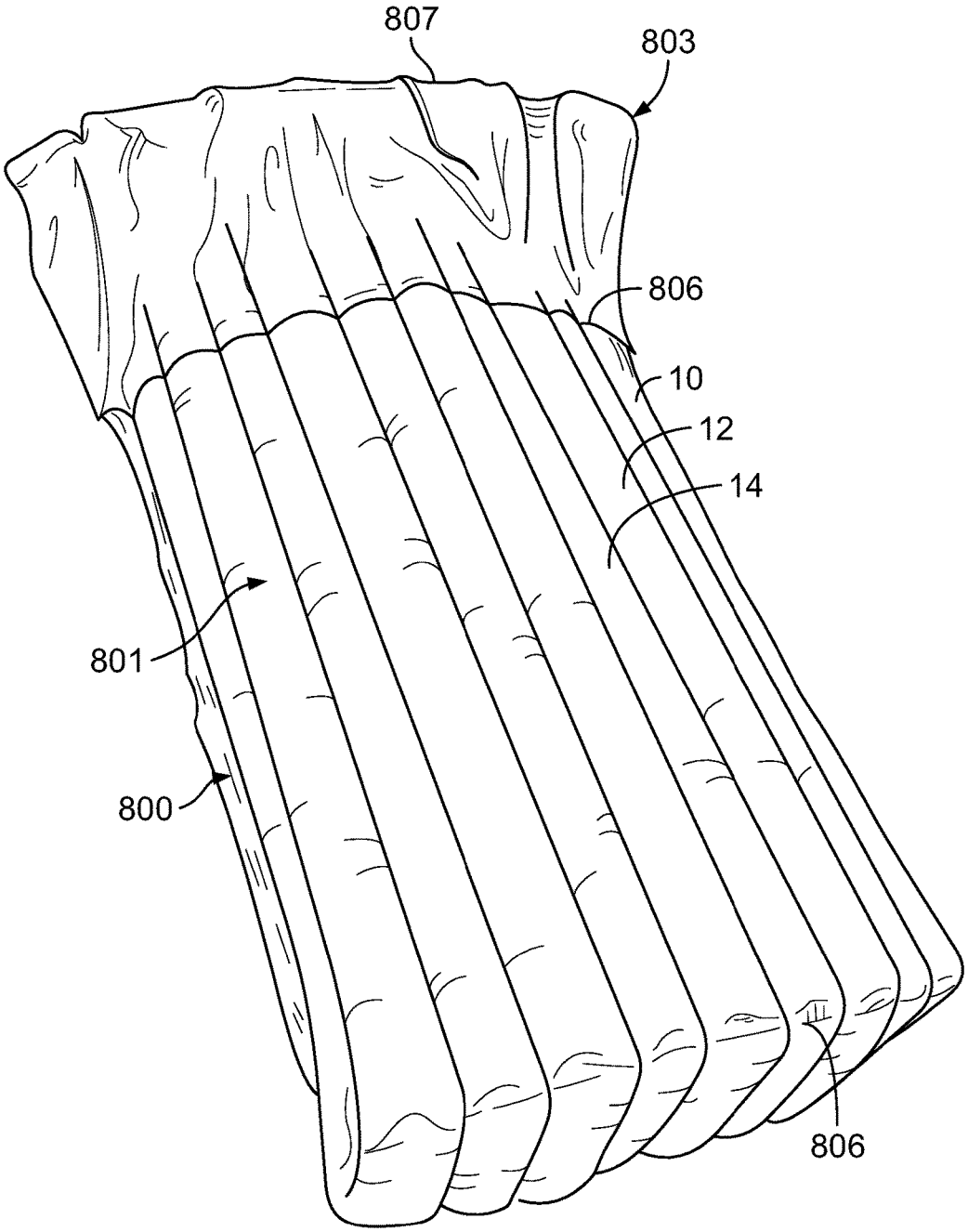
FIG. 29A is a perspective view of the embodiment of the packaging device of FIG. 29, shown in an inflated state.

FIGS. 29 and 29A illustrate another embodiment of a packaging device 800 formed from a packaging material 10 as described above. It is understood that features of the material 10 described above are referenced in FIGS. 29 and 29A using similar reference numbers, and are not described again with respect to the device 800 for the sake of brevity. The device 800 contains a plurality of constriction seals 25 forming a plurality of joints 806 and creating an internal cavity 801 for receiving one or more articles. The joints 806 form a flat bottom of the device 800. The device 800 also includes a foldable, uninflated lid portion 807 that can be folded over and adhered to the outer surface of the material 10 to cover the open top 803 of the cavity 801. A piece of tape, an adhesive substance, or other technique may be used to adhere the lid portion 807 to the outer surface of the material 10. The lid portion 807 can be opened and closed for insertion or removal of an article from the cavity 801, and also protects the top of the article.

Figure 30:
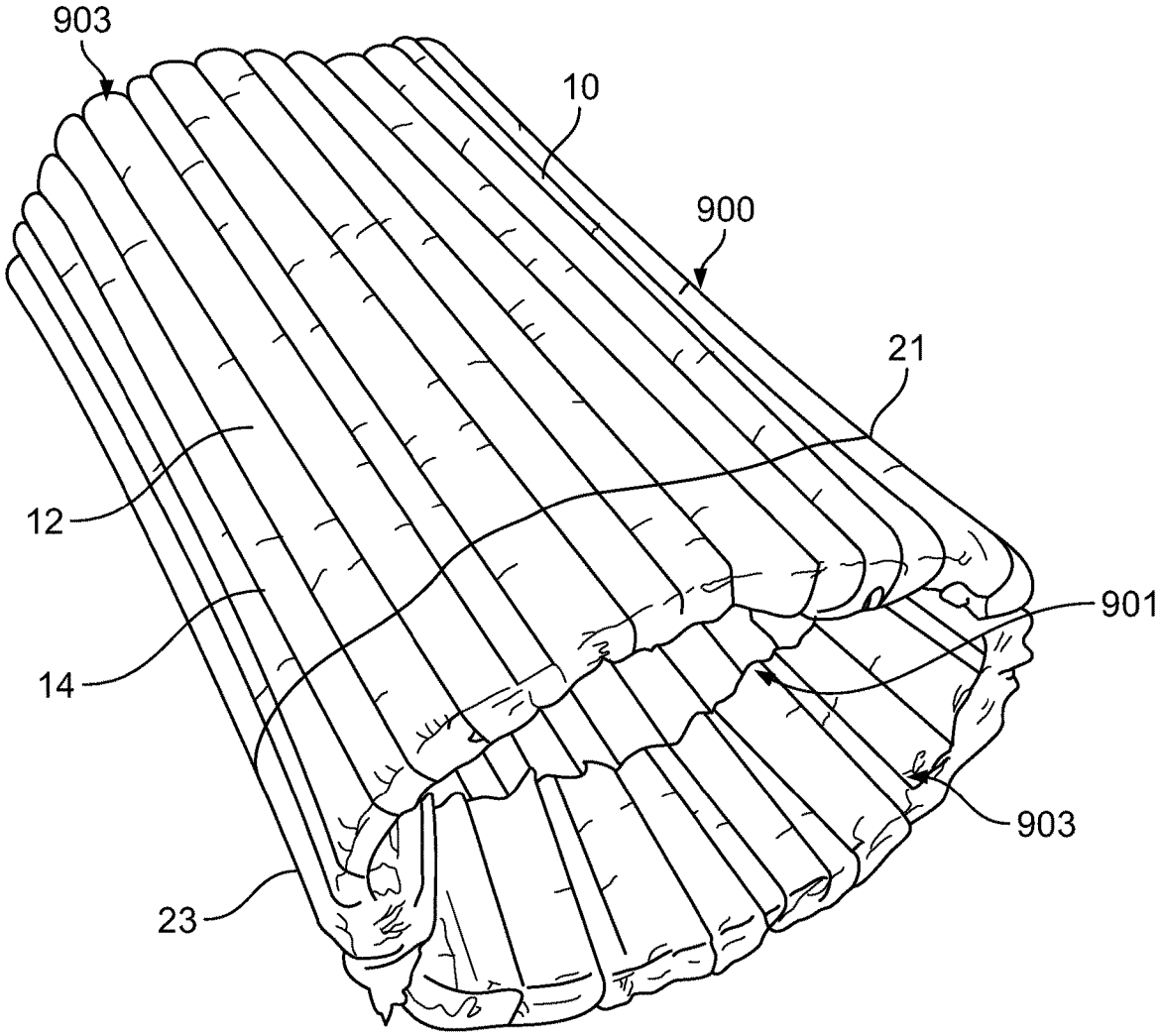
FIG. 30 is a perspective view of another embodiment of a packaging device formed from a packaging material according to the present invention.

FIG. 30 illustrates another embodiment of a packaging device 900 formed from a packaging material 10 as described above. It is understood that features of the material 10 described above are referenced in FIG. 30 using similar reference numbers, and are not described again with respect to the device 900 for the sake of brevity. The device 900 has the side seals 21, 23 formed together so that the material 10 wraps around into a tube configuration, creating an internal cavity 901 for receiving an article. The cavity 901 has two open ends 903 and serves to wrap around at least a portion of the article, and at least a portion of the article may protrude from one of the open ends 903.

A packaging material 110 according to another embodiment of the invention is illustrated in FIGS. 33-38. The material 110 as shown in FIGS. 33-38 contains many components and features that are similar to features shown and described with respect to the material 10 in FIGS. 1-10. Accordingly, similar reference numerals are used to describe such common components and features with respect to the material 110 in FIGS. 33-38, using the "lxx" series of reference numerals. Additionally, many components and features of the material 110 that have already been described above may not be re-described below for sake of brevity. It is understood that any and all variations and embodiments of the material 10 described above and shown in FIGS. 1-10 may be incorporated into the embodiment of FIGS. 33-38.

As seen in FIGS. 33-38, the material 110 is an inflatable packaging material having a plurality of air columns 112, 114 that are configured to be filled with air to form a protective structure. Like the material 10 described above, the material 110 is formed of a plurality of plastic films, including upper and lower outer films 116, 118 positioned in confronting relation to each other and sealed together by a plurality of heat seals, including a top seal 120 extending proximate the top edge 115 of the material 110 and a bottom seal 122 extending proximate the bottom edge 117 of the material 110, as well as a plurality of border seals 124, 126 located inwardly of the outer periphery of the material 110. The material 110 also includes an inflation assembly 140, containing a valve assembly 150 including a plurality of check valves 152, as also described in further detail below.

The outer films 116, 118 have a plurality of air columns 112, 114 formed therebetween, in a structure similar or identical to the air columns 12, 14 described above. As similarly described above, the material 110 has border seals, including unbroken primary border seals 124 and secondary (broken) border seals 126 having air conduits 127 therethrough. The border seals 124, 126 are positioned in alternating arrangement to create pairs of interconnected air columns including one main air column 112 and one auxiliary air column 114 in fluid communication with each other. The air columns 112, 114 of the material 110 in FIGS. 33-38 function in the same manner described above with respect to FIGS. 1-10. Other features and variations of the air columns 12, 14 described above with respect to FIGS. 1-10 are also included in this embodiment, including constriction seals 125.

The material 110 includes an inflation assembly 140 configured for inflation of the air columns 112, 114, and the inflation assembly 140 contains a valve assembly 150. Similar to the material 10 in FIGS. 1-10, the inflation assembly 140 includes an inflation passage 142 defined between the top seal 120 and the valve seal 128, which allows air to flow between the outer films 116, 118 and across the top of the material 110 to be distributed to a plurality of check valves 152 of the valve assembly 150 that are in communication with the inflation passage 142. In the finished packaging product, the inflation passage 142 typically has one closed end 144 and one open end 146 that functions as an inflation port, as described above.

Figure 2:
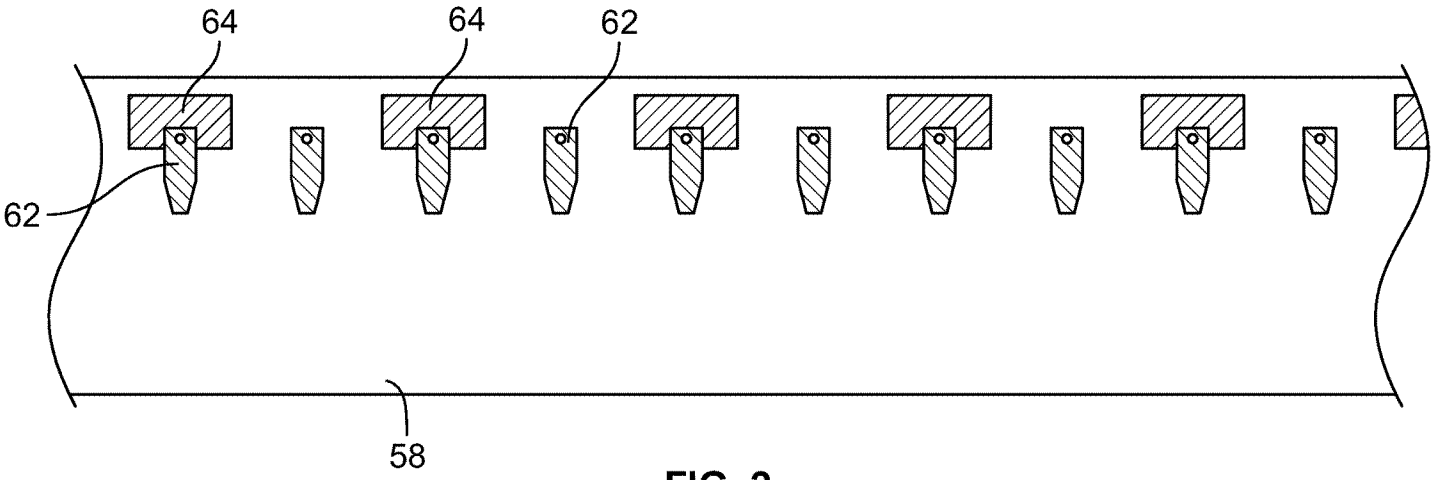
FIG. 2 is a plan view of a valve assembly of the packaging material of FIG. 1.
Figure 3:
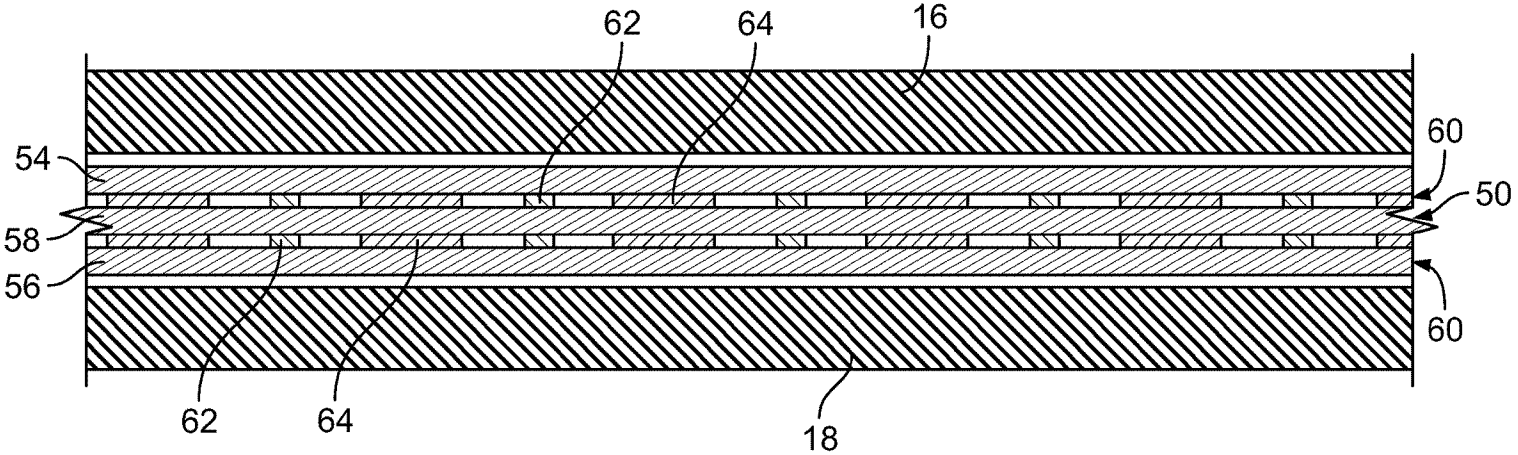
FIG. 3 is a cross-sectional view taken along lines 3-3 of FIG. 1.
Figure 34:
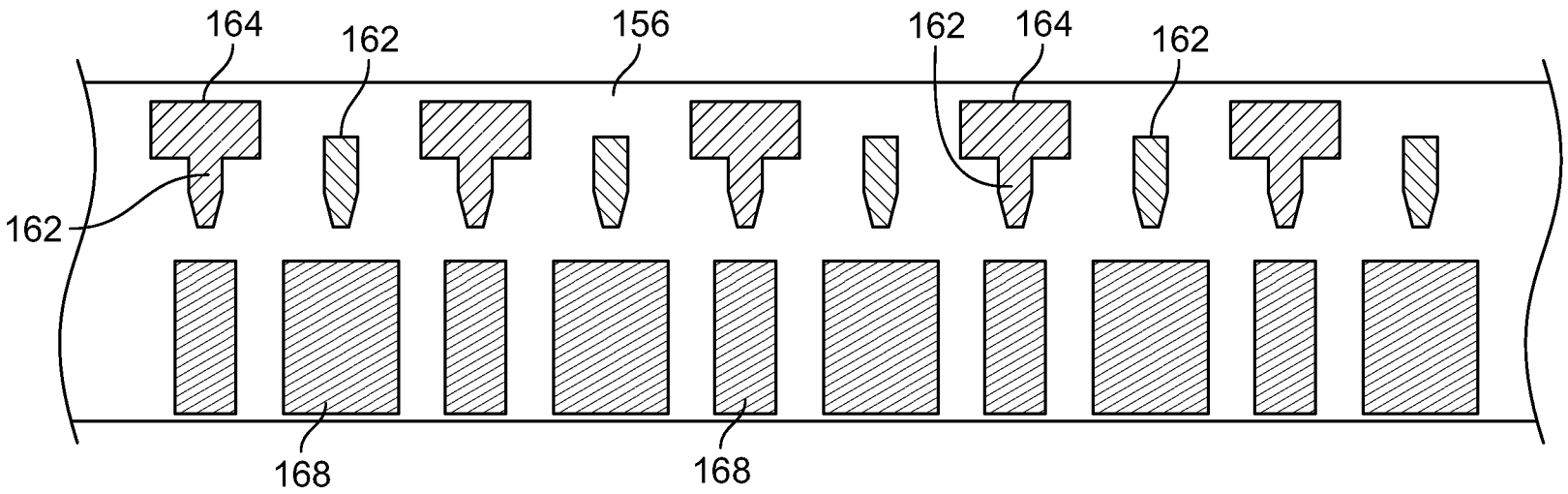
FIG. 34 is a plan view of a portion of a valve assembly of the packaging material of FIG. 33.
Figure 35:
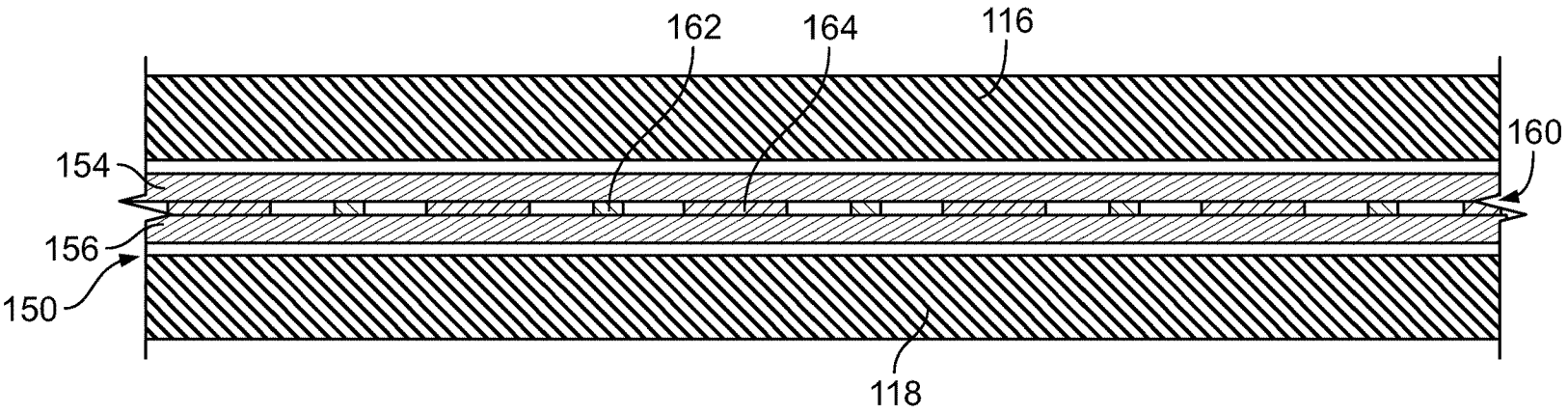
FIG. 35 is a cross-sectional view taken along lines 35-35 of FIG. 33.
Figure 36:
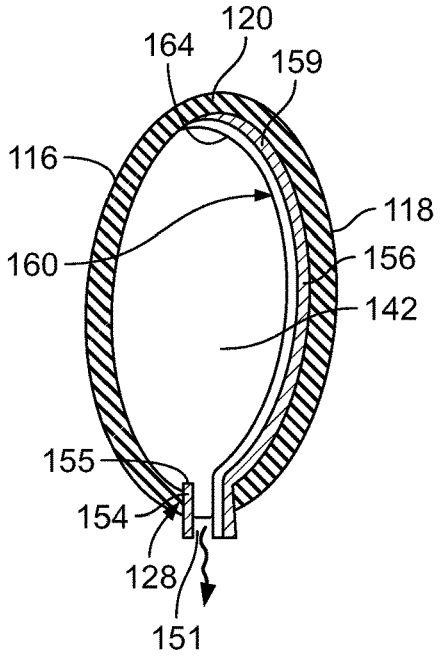
FIG. 36 is a cross-sectional view taken along lines 36-36 of FIG. 33.
Figure 37:
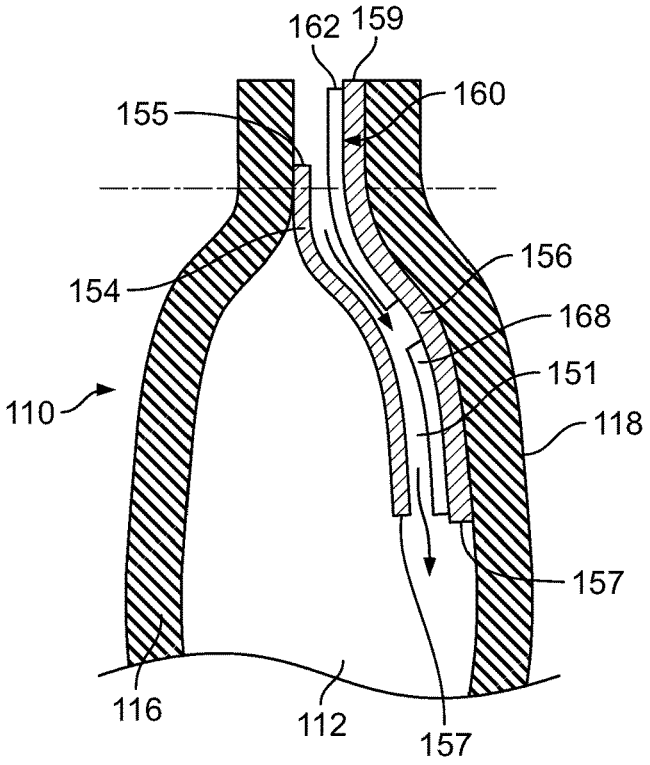
FIG. 37 is a cross-sectional view taken along lines 37-37 of FIG. 33, shown during inflation.
Figure 38:
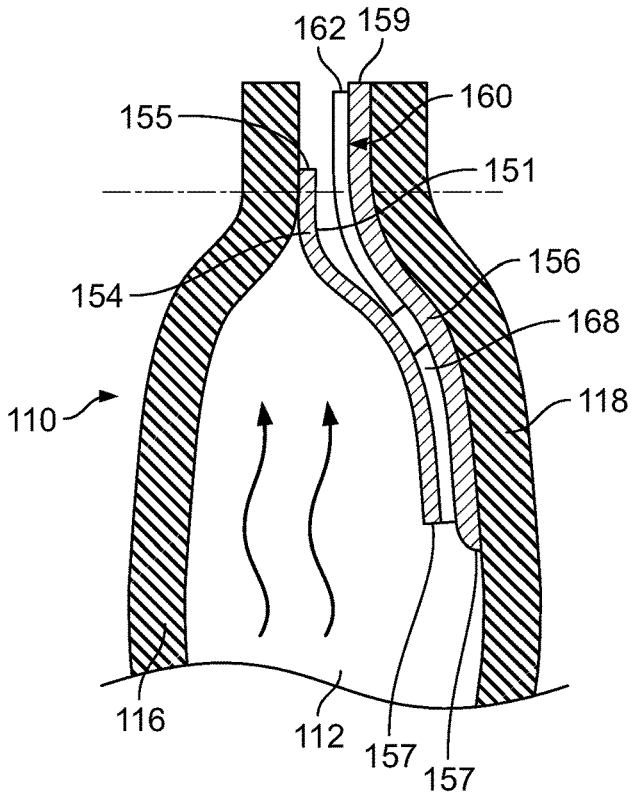
FIG. 38 is a cross-sectional view of the packaging material as illustrated in FIG. 37, shown after inflation is complete.

The valve assembly 150 includes a plurality of valve films positioned between the outer films 116, 118, and creates a plurality of one-way check valves 152. Each of the air columns 112, 114 has a check valve 152 located at the top end thereof, adjacent the valve seal 128. In the embodiment shown in FIGS. 33-38, the material 110 includes two valve films: an upper valve film 154 and a lower valve film 156. Unlike the embodiment shown in FIGS. 1-10, the material 110 does not include a middle valve film 58, but in another embodiment, a middle valve film may be included. The valve films 154, 156 are positioned in surface-to-surface contact with each other, and areas of a non-sealable material 160 are positioned between the valve films 154, 156, as shown in FIGS. 36-38. As shown in FIGS. 36-38, the non-sealable material 160 is positioned on the side of the lower valve film 156 that confronts the upper valve film 154, and may be applied by printing on one side of the lower valve film 156 before assembly of the valve assembly 150. As similarly described above, the non-sealable material 160 is arranged in at least a plurality of valve portions 162 positioned along the valve seal 128 extending through the check valves 152, and a plurality of passage portions 164 positioned along the inflation passage 142 with gaps 165 between the passage portions 164, shown in FIG. 34. In this embodiment, the top ends of the valve portions 162 extend to approximately the same level on the valve film 156 as the bottom ends of the passage portions 164, as shown in FIG. 34. This arrangement differs from the arrangement as shown in FIG. 2, where the top ends of the valve portions 62 overlap slightly with the bottom ends of the passage portions 64. The arrangement of the valve and passage portions 162, 164 in FIG. 34 can facilitate the printing process.

Figure 39:
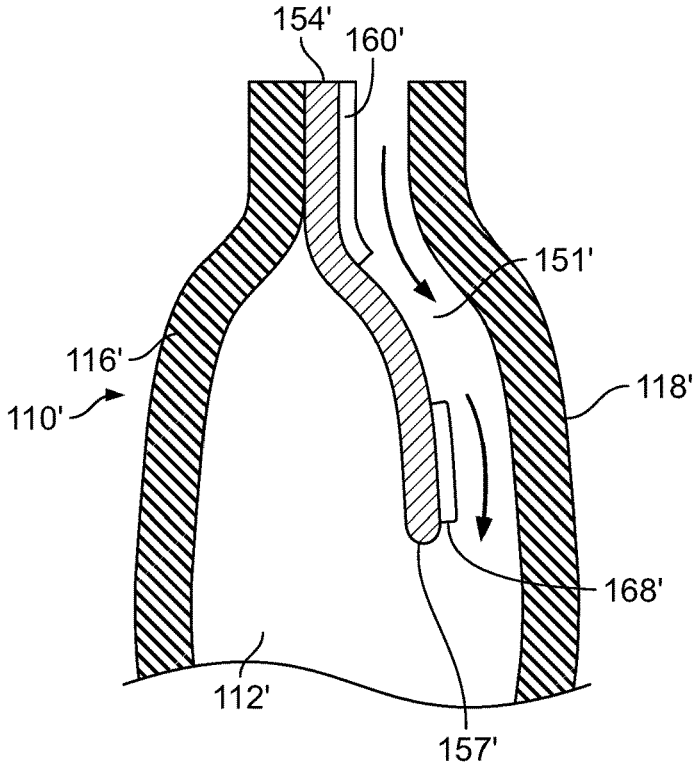
FIG. 39 is a cross-sectional view of another embodiment of a packaging material according to the present invention, shown during inflation.

Additionally, in this embodiment, the lower valve film 156 extends further into the inflation passage 142 than the upper valve film 154. As shown in FIGS. 37-39, the lower film 156 has an extending portion 159 that extends beyond the top end 155 of the upper film 154, similarly to the extending portion 59 of the middle valve film 58 described above and shown in FIGS. 7-9. This configuration can assist in keeping the air passage 151 open between the films 154, 156 to further ensure successful inflation. The extending portion 159 of the lower film 158 also provides a surface for connection of the passage portions 164 of the non-sealable material 160. The extending portion 159 may hang loosely within the inflation passage 142 or may extend into the top seal 120 to be fixed in place, in different embodiments.

In this embodiment, the valve assembly 150 of FIGS. 33-38 further includes a tacky material 168 positioned between the upper and lower valve films 154, 156. As shown in FIGS. 36-38, the tacky material 168 is positioned on the same side of the lower valve film 156 as the non-sealable material 160, but located below the valve seal 128 and farther into the air columns 112, 114. The tacky material 168 may be any material that is capable of forming a non-permanent bond between the valve films 154, 156, such as an adhesive-like material, a static-based bonding material, a tacky surface of the valve film 156 created by a surface treatment, or other tacky material. In this embodiment, the placement of the tacky material 168 within the valve assembly 150 is outlined in FIGS. 33-35. The tacky material 168 can be applied to the lower valve film 156 by printing, or another method, and in one embodiment may be printed simultaneously with the non-sealable material 160. As described in greater detail below, the tacky material 168 is configured to weakly bond the upper and lower valve films 154, 156 together, but allow the valve films 154, 156 to separate with sufficient air pressure applied from the inflation passage 142. It is understood that the non-sealable material 160 and the tacky material 168 may alternately be positioned on the upper valve film 154, in which case, the materials 160, 168 would be positioned on the side facing the lower valve film 156. It is also understood that the tacky material 168 may be used in connection with the material 10 of FIGS. 1-10, and that the tacky material 168 may be positioned between the middle valve film 58 and at least one of the upper and lower valve films 54, 56. In one embodiment, the tacky material 168 may be printed on both sides of the middle valve film 58, similarly to the non-sealable material 60.

The valve films 154, 156 are positioned between the outer films 116, 118 and are sealed together with the upper and lower films 116, 118 at the valve seal 128, as described above, to form a single valve passage 151. The valve films 154, 156 are also sealed to one or both of the upper and lower films 116, 118 within the top ends of the air columns 112, 114 by the border seals 124, 126, as well as a plurality of airflow seals 166A-C. In this embodiment, the airflow seals 166A-C include elongated seals 166A forming a tapered tunnel adjacent the valve passage 151, a central seal 166B positioned adjacent the ends of the elongated seals 166A, and a plurality of parallel seals 166C near the bottom ends 157 of the valve films 154, 156. The parallel seals 166C may also include arms 166D extending from the seals 166C to the adjacent border seals 124, 126, unlike the parallel seals 66C in FIG. 1. Additionally, the central seals 166B are shaped differently than the central seals 66B in FIG. 1, and the central seals 166B of the primary air columns 112 are different from the central seals 166B of the secondary air columns 114 in this embodiment.

FIGS. 36-38 illustrate the functioning of the check valves 152 of the valve assembly 150. As shown in FIG. 36, air flows along the inflation passage 142 and through the air passage 151 between the valve films 154, 156 created by the non-sealable material 160. Additionally, as shown in FIG. 37, the air flows through the air passage 151 between the valve films 154, 156 and into the air column 114. After the inflation airflow is ceased, the air columns 112, 114 are pressurized, and the air pressure within the columns 112, 114 forces the valve films 154, 156 into contact with each other and against the lower outer film 118 to prevent air from escaping back through the air passage 151, as shown in FIG. 38. The tacky material 168 adheres the valve films 154, 156 to each other to assist in closing the passage and resisting the reverse flow of air. As shown in FIG. 38, when sufficient air pressure is present in the inflation passage 142, the tacky material 168 releases to allow air to flow from the inflation passage 142 through the air passage 151 and into the air column 114. The airflow seals 166A-C may assist in guiding the flow of any air that may enter between the valve films 154, 156 away from the air passage 151, so that the air becomes trapped in pockets 167 between the elongated seals 166A and the border seals 124, 126, rather than passing through the air passage 151. It is understood that FIGS. 36-38 are conceptual drawings and are not drawn to scale, and in particular, that the degree or extent of movement of the films 154, 156 in FIGS. 36-38 may be exaggerated.

Figure 40:
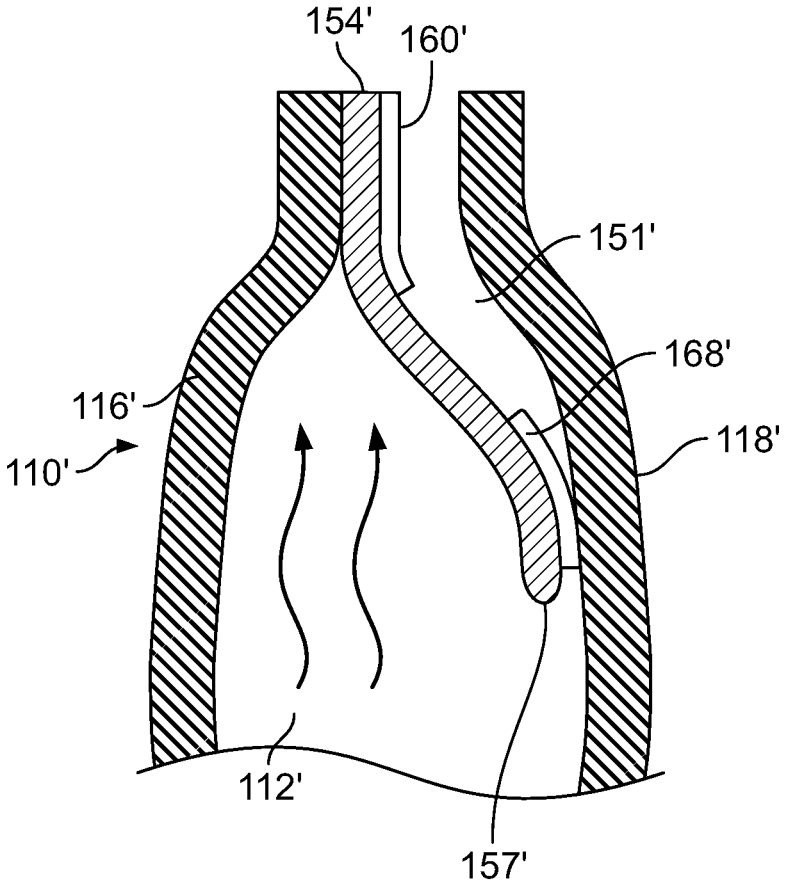
FIG. 40 is a cross-sectional view of the packaging material as illustrated in FIG. 39, shown after inflation is complete.

In an alternate embodiment, illustrated in FIGS. 39-40, the material 110' may have only one valve film 154', with the non-sealable material 160' and the tacky material 168' positioned on one side of the valve film 154'. In this embodiment, similarly to the embodiment of FIGS. 33-38, only a single air passage 151' is formed for introduction of air into the column 112'. Additionally, the non-sealable material 160' and the tacky material 168' may be arranged in the same or a similar pattern to the non-sealable material 160 and tacky material 168 described above and shown in FIGS. 33-38. In this embodiment, as shown in FIG. 39, the tacky material 168' causes the single valve film 154' to non-permanently bond to the lower outer film 118', to resist reverse flow of air through the air passage 151', as similarly described above. As shown in FIG. 40, when sufficient air pressure is present in the inflation passage (not shown), the tacky material 168' releases to allow air to flow from the inflation passage through the air passage 151' and into the air column 112', as also similarly described above. Other features of the material 110 described above may be incorporated into the embodiment of the material 110' in FIGS. 39-40, including any variations or alternate embodiments described herein.

Figure 41:
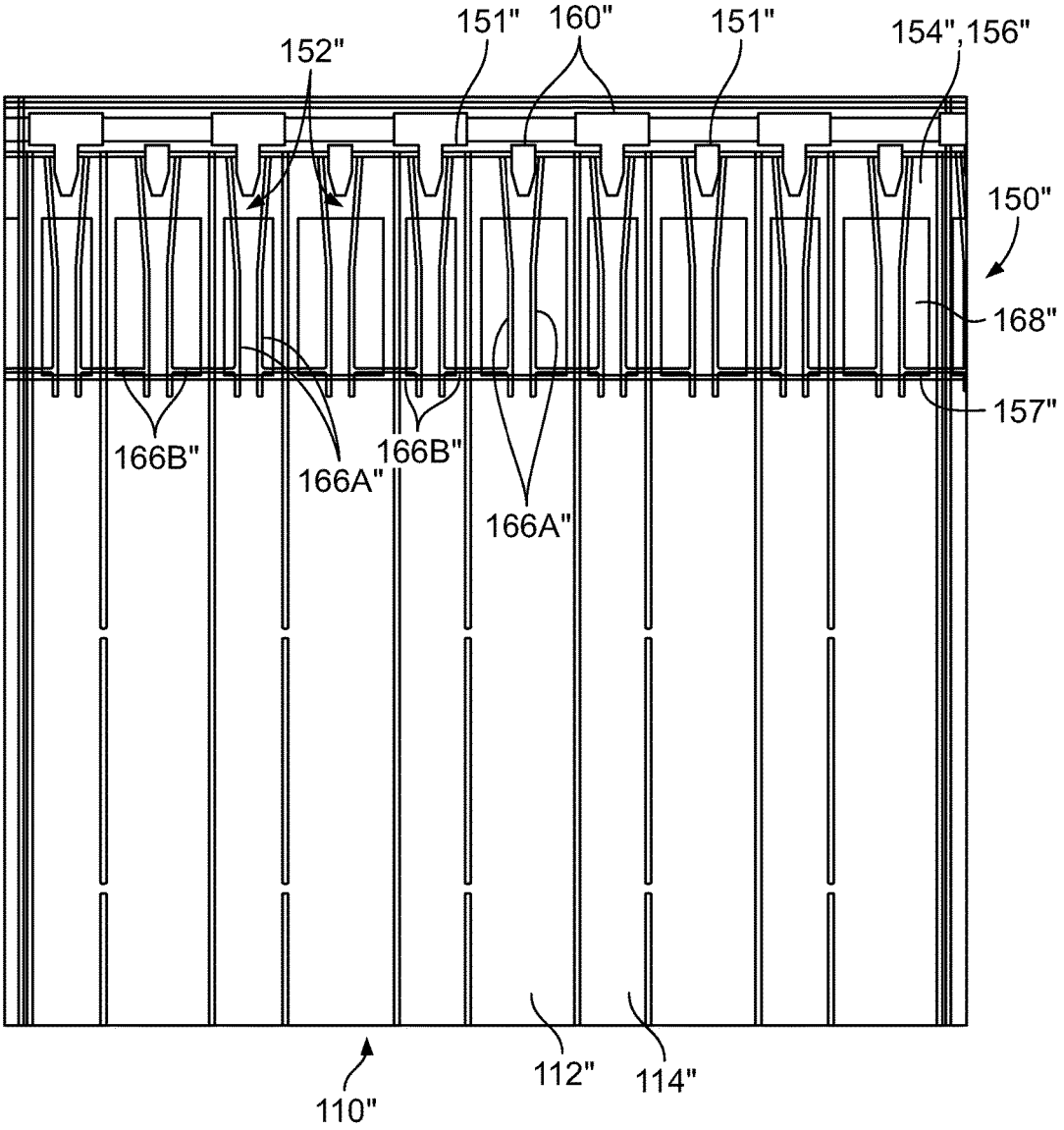
FIG. 41 is a plan view of another embodiment of a packaging material according to the present invention.

In another alternate embodiment, illustrated in FIG. 41, the material 110" may have a valve assembly 150" with a different arrangement of airflow seals 166A-B" than the material 110 of FIGS. 33-38. The airflow seals 166A-B" in this embodiment include elongated seals 166A" forming a tapered tunnel adjacent the valve passage 151" and blocking seals 166B" near the bottom ends 157" of the valve films 154", 156". The blocking seals 166B" block airflow to ensure that the only pathway for airflow through the valve assembly 150" is between the elongated seals 166A". In this embodiment, the valve assembly 150" is otherwise constructed in the same way described above with respect to the material 110 of FIGS. 33-38, with two valve films 154", 156", and a printed pattern of non-sealable material 160" and tacky material 168". The material 110" also functions in the same way described above with respect to the material 110 of FIGS. 33-38. Other features of the material 110 described above may be incorporated into the embodiment of the material 110" in FIG. 41, including any variations or alternate embodiments described herein.

It is understood that any of the packaging devices described herein, including the packaging devices in FIGS. 11-30, can be made using any of the various embodiments of packaging materials described herein, including the packaging materials 10', 110, 110', 110" shown in FIGS. 31-41 and described above. It is also understood that any of the variations or alternate embodiments described herein may be applicable to any other embodiment of the packaging material or packaging device described herein.

Figure 42:
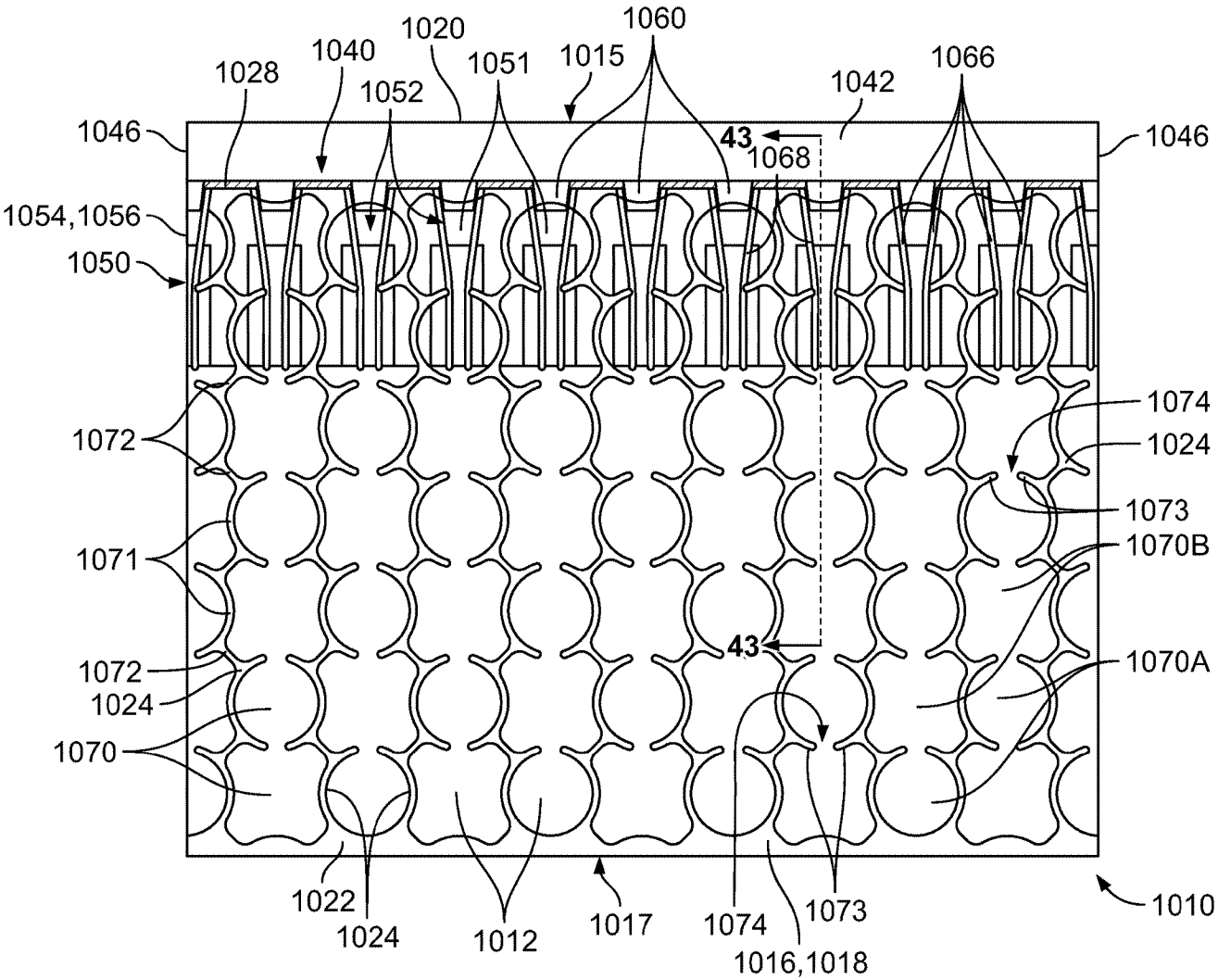
FIG. 42 is a plan view of one embodiment of an inflatable-bubble packaging material according to the present invention.
Figure 43:
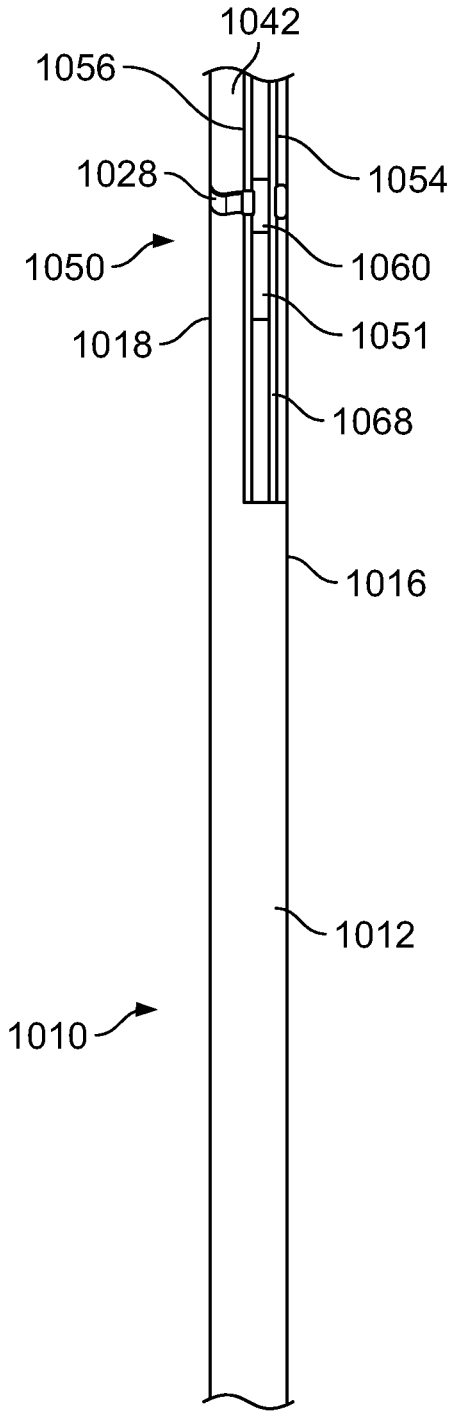
FIG. 43 is a cross-sectional view taken along lines 43-43 of FIG. 42.

FIGS. 42-47 illustrate embodiments of a different type of packaging material according to aspects of the present invention, in the form of inflatable-bubble packaging materials. FIGS. 42-43 illustrate one such embodiment of an inflatable-bubble packaging material 1010. The material 1010 as shown in FIGS. 42-43 contains many components and features that are similar to features shown and described with respect to the materials 10, 110 in FIGS. 1-10 and 33-38. Accordingly, similar reference numerals are used to describe such common components and features with respect to the material 1010 in FIGS. 42-43, using the "10xx" series of reference numerals. Additionally, many components and features of the material 1010 that have already been described above may not be re-described below for sake of brevity. It is understood that any and all variations and embodiments of the materials 10, 110 described above and shown in FIGS. 1-10 and 33-38, as well as any other features shown and/or described herein, may be incorporated into the embodiment of FIGS. 42-43.

As seen in FIGS. 42-43, the material 1010 is an inflatable packaging material having a plurality of air columns 1012 that are configured to be filled with air to form a protective structure. Like the material 10 described above, the material 1010 is formed of a plurality of plastic films, including upper and lower outer films 1016, 1018 positioned in confronting relation to each other and sealed together by a plurality of heat seals, including a top seal 1020 extending proximate the top edge 1015 of the material 1010 and a bottom seal 1022 extending proximate the bottom edge 1017 of the material 1010, as well as a plurality of border seals 1024 located inwardly of the outer periphery of the material 1010. The material 1010 also includes an inflation assembly 1040, containing a valve assembly 1050 including a plurality of check valves 1052, as also described in further detail below.

The outer films 1016, 1018 have a plurality of air columns 1012 formed therebetween, with each air column 1012 being formed as a series of interconnected air bubbles 1070. The material 1010 has a plurality of border seals 1024 separating each air column 1012 from the adjacent air columns 1012, and forming the structure of the air bubbles 1070. Each border seal 1024 is formed of a plurality of curved or semi-circular segments 1071 that are connected to each other by connecting segments 1072 along the length of the border seal 1024. In this embodiment, most of the curved segments 1071 are similar or substantially identical to each other (except for the segments 1071 at the top and bottom of each border seal), with adjacent curved segments 1071 facing opposite directions. As seen in FIG. 42, this arrangement forms an alternating pattern of curved segments 1071 facing left, right, left, right, etc. Additionally, adjacent border seals 1024 are arranged in opposing relation to each other, so that the most adjacent curved segments 1071 of two adjacent border seals 1024 are always facing opposite (either toward or away from) each other. This arrangement forms an alternating pattern of air bubbles 1070 in each air column 1012, with alternate bubbles having either convex or concave sides. As shown in FIG. 42, the bubbles 1070A with convex sides are substantially circular in appearance, and alternate with the bubbles 1070B having concave sides. Further, the curved segments 1071 have protruding ends 1073 that protrude into the air columns 1024 to define the air bubbles 1070, and the protruding ends 1073 of opposing curved segments 1071 extend proximate each other to create narrowed air conduits 1074 connecting the air bubbles 1070 of each column 1012 in sequence.

The material 1010 includes an inflation assembly 1040 configured for inflation of the air columns 1012, and the inflation assembly 1040 contains a valve assembly 1050. Similar to the material 10 in FIGS. 1-10, the inflation assembly 1040 includes an inflation passage 1042 defined between the top seal 1020 and the valve seal 1028, which allows air to flow between the outer films 1016, 1018 and across the top of the material 1010 to be distributed to a plurality of check valves 1052 of the valve assembly 1050 that are in communication with the inflation passage 1042. In the finished packaging product, the inflation passage 1042 typically has two open ends 1046 that function to allow passage of air into and out of the inflation passage 1042 for inflation of a series of packaging materials 1010 on a roll, as described in greater detail below. In another embodiment, the material 1010 may be inflatable as described above, and may have an inflation passage 1042 with one open end and one closed end, similar to the material 10 of FIGS. 1-10.

The valve assembly 1050 includes a plurality of valve films positioned between the outer films 1016, 1018, to create a plurality of one-way check valves 1052. Each of the air columns 1012 has a check valve 1052 located at the top end thereof, adjacent the valve seal 1028. In the embodiment shown in FIG. 43, the material 1010 includes two valve films: an upper valve film 1054 and a lower valve film 1056, similar to the embodiment of the material 110 described above and shown in FIGS. 33-38. In another embodiment (not shown), a middle valve film may be included, similar to the embodiment of the material 10 described above and shown in FIGS. 1-10. The valve films 1054, 1056 are positioned in surface-to-surface contact with each other, and areas of a non-sealable material 1060 are positioned between the valve films 1054, 1056, as shown in FIGS. 42-43. The non-sealable material 1060 is positioned on the side of the lower valve film 1056 that confronts the upper valve film 1054, and may be applied by printing on one side of the lower valve film 1056 before assembly of the valve assembly 1050. The non-sealable material 1060 is arranged in discrete portions along the valve seal 1028 extending through the check valves 1052, to prevent the valve seal 1028 from sealing the check valves 1052 closed. Additionally, in this embodiment, both the upper and lower valve films 1054, 1056 extend a significant distance into the inflation passage 1042. In another embodiment, one of the valve films 1054, 1056 may extend further into the inflation passage 1042 than the other, similarly to the embodiment shown in FIGS. 37-39.

In this embodiment, the valve assembly 1050 of FIGS. 42-43 further includes a tacky material 1068 positioned between the upper and lower valve films 1054, 1056, similar to the embodiment shown in FIGS. 36-38. As shown in FIG. 43, the tacky material 1068 is positioned on the same side of the lower valve film 1056 as the non-sealable material 1060, but located below the valve seal 1028 and farther into the air columns 1012. The tacky material 1068 may be any material that is capable of forming a non-permanent bond between the valve films 1054, 1056, such as an adhesive-like material, a static-based bonding material, a tacky surface of the valve film 1056 created by a surface treatment, or other tacky material. In this embodiment, the placement of the tacky material 1068 within the valve assembly 1050 is outlined in FIG. 42, and shown in cross-section in FIG. 43. The tacky material 1068 can be applied to the lower valve film 1056 by printing or another method, and in one embodiment may be printed simultaneously with the non-sealable material 1060. As described above with respect to the embodiment of the material 110 shown in FIGS. 33-38, the tacky material 1068 is configured to weakly bond the upper and lower valve films 1054, 1056 together, but to allow the valve films 1054, 1056 to separate with sufficient air pressure applied from the inflation passage 1042. It is understood that the non-sealable material 1060 and the tacky material 1068 may alternately be positioned on the upper valve film 1054, in which case, the materials 1060, 1068 would be positioned on the side facing the lower valve film 1056.

The valve films 1054, 1056 are positioned between the outer films 1016, 1018 and are sealed together with the upper and lower films 1016, 1018 at the valve seal 1028, as described above, to form a single valve passage 1051. The valve films 1054, 1056 are also sealed to one or both of the upper and lower films 1016, 1018 within the top ends of the air columns 1012, 1014 by the border seals 1024, as well as a plurality of airflow seals 1066. In this embodiment, the airflow seals 1066 are elongated seals forming a tapered tunnel adjacent the valve passage 1051, through which the air flows from the check valve 1052 to the air column 1012.

Figure 44:
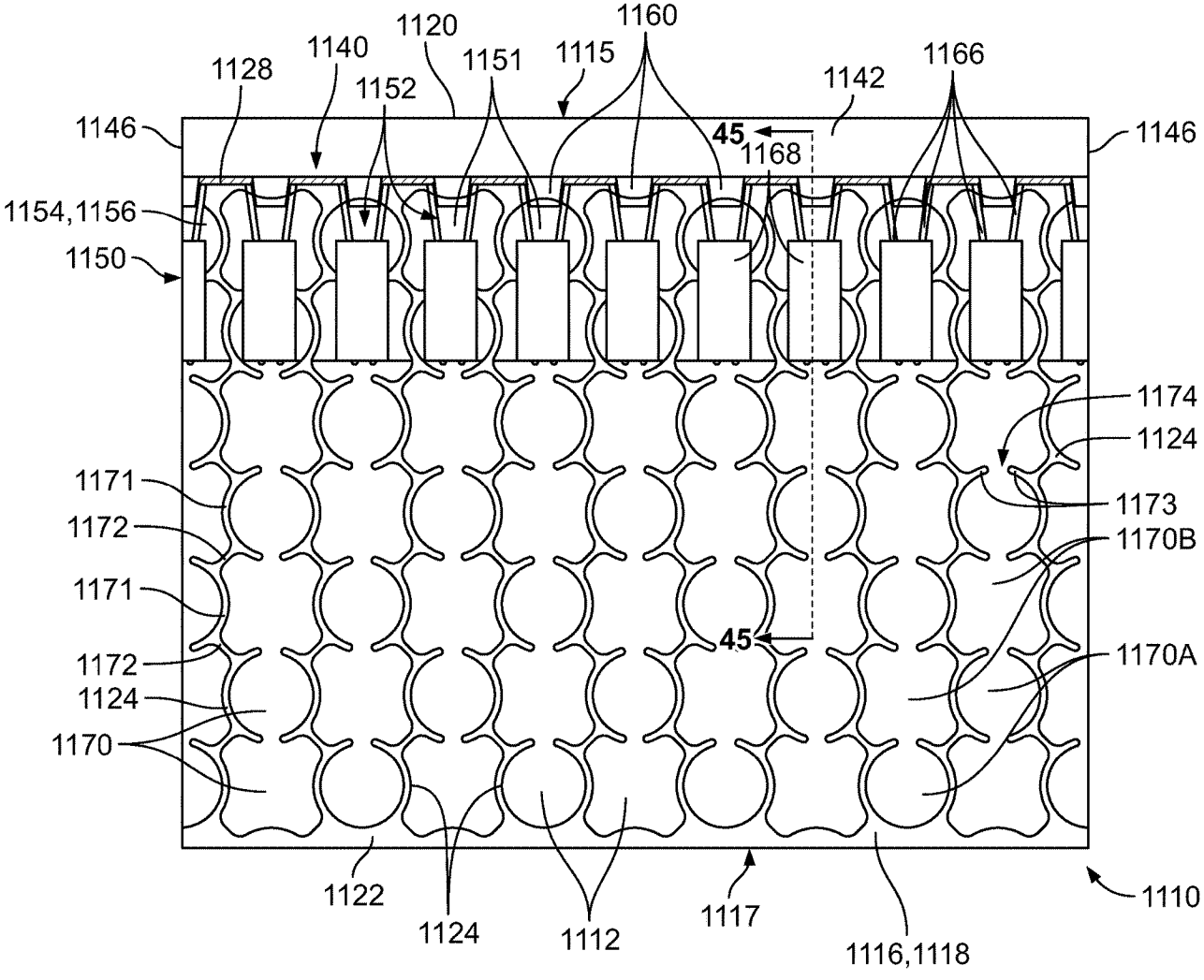
FIG. 44 is a plan view of another embodiment of an inflatable-bubble packaging material according to the present invention.
Figure 45:
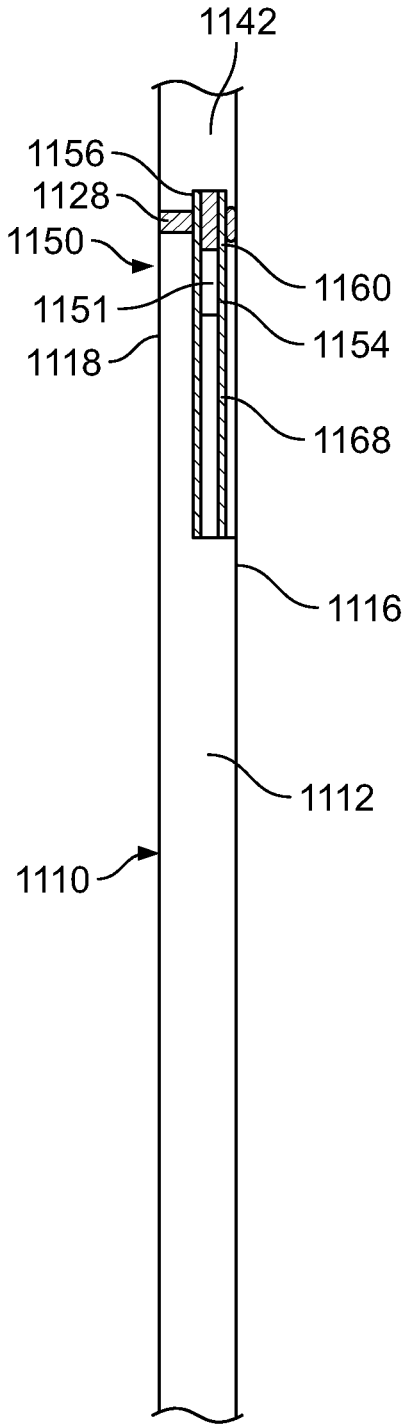
FIG. 45 is a cross-sectional view taken along lines 45-45 of FIG. 44.

FIGS. 44-45 illustrate another embodiment of an inflatable-bubble packaging material 1110. The material 1110 as shown in FIGS. 44-45 contains many components and features that are similar to features shown and described with respect to the materials 10, 110 in FIGS. 1-10 and 33-38 and the material 1010 in FIGS. 42-43. Accordingly, similar reference numerals are used to describe such common components and features with respect to the material 1110 in FIGS. 44-45, using the "11xx" series of reference numerals. Additionally, many components and features of the material 1110 that have already been described above may not be re-described below for sake of brevity. It is understood that any and all variations and embodiments of the materials 10, 110, 1010 described above and shown in FIGS. 1-10, 33-38, and 42-43 as well as any other features shown and/or described herein, may be incorporated into the embodiment of FIGS. 44-45.

The material 1110 of FIGS. 44-45 has a similar size and construction as the material 1010 in FIGS. 42-43. The seals of the material 1110 are located and structured similarly to the seals of the material 1010 of FIGS. 42-43, including the top seal 1120, the bottom seal 1122, the valve seal 1128, the airflow seals 1166, and the plurality of border seals 1124, including the curved segments 1171 with protruding ends 1173, and the connecting segments 1172. These seals define a plurality of air columns 1112, each formed of a plurality of air bubbles 1170 connected by air conduits 1174, including an alternating pattern of convex-sided air bubbles 1170A and concave-sided air bubbles 1170B, and a plurality of check valves 1152 in communication with an inflation passage 1142.

The material 1110 of FIGS. 44-45 has a valve assembly 1150 that is different from the material 1010 of FIGS. 42-43. Like the material 1010 of FIGS. 42-43, the material 1110 has two valve films, including an upper valve film 1154 and a lower valve film 1156 that are positioned between the outer films 1116, 1118 to form the check valves 1152. Additionally, like the material 1010 of FIGS. 42-43, the material 1110 has a non-sealable material 1160 and a tacky material 1168 positioned on the side of the lower valve film 1156 that faces the upper valve film 1154. However, in the material 1110 of FIGS. 44-45, the valve layers 1154, 1156 do not extend significant distances into the inflation passage 1142, and, as seen in FIG. 45, the valve layers 1154, 1156 extend only a very small distance, if any, beyond the valve seal 1128. The valve layers 1154, 1156 function in the same manner as the valve layers 1054, 1056 described above, to allow airflow from the inflation passage 1142 through the check valves 1152 and into the air columns 1112, and blocking airflow out of the air columns 1112.

Figure 46:
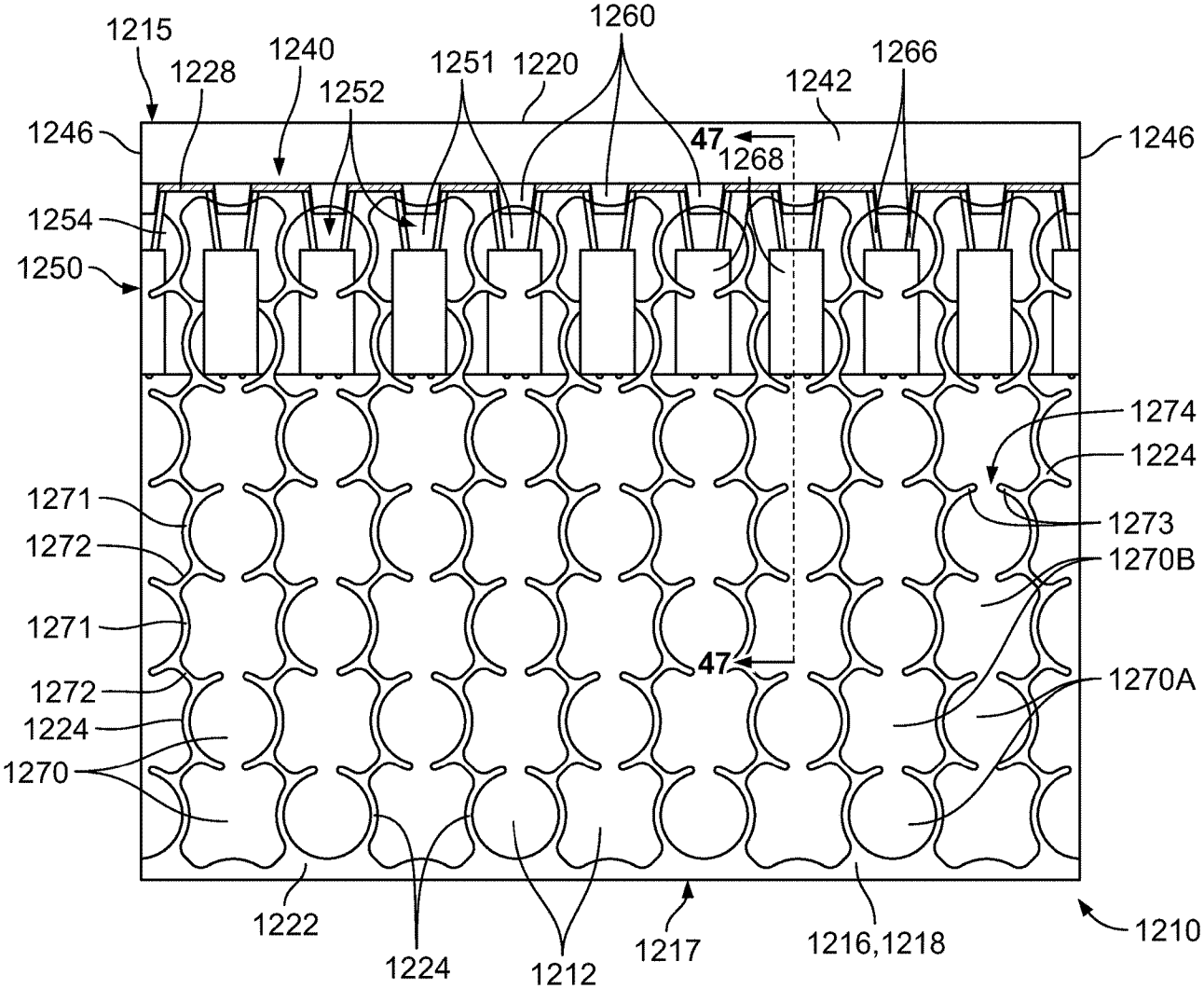
FIG. 46 is a plan view of another embodiment of an inflatable-bubble packaging material according to the present invention.
Figure 47:
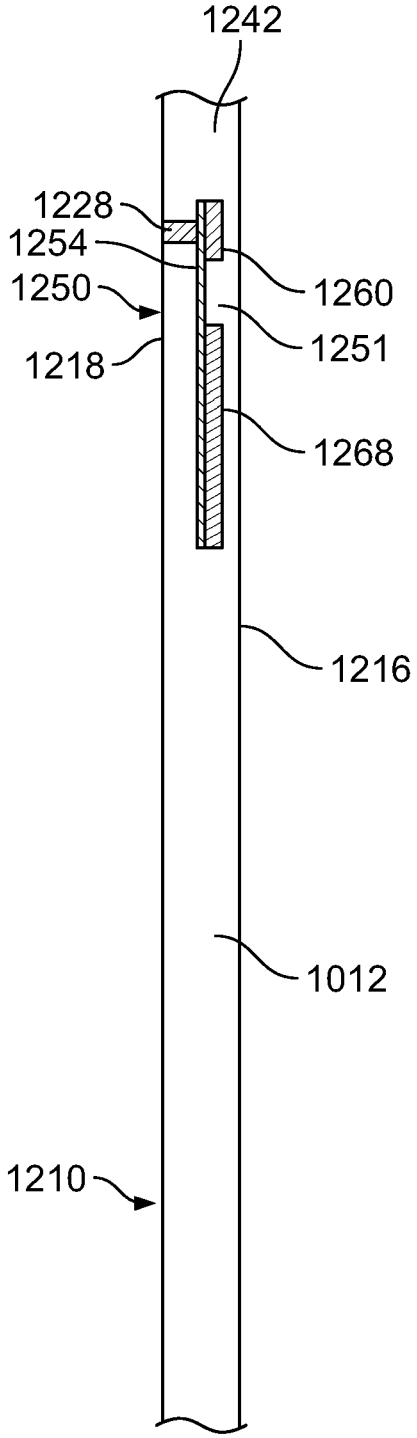
FIG. 47 is a cross-sectional view taken along lines 47-47 of FIG. 46.

FIGS. 46-47 illustrate another embodiment of an inflatable-bubble packaging material 1210. The material 1210 as shown in FIGS. 46-47 contains many components and features that are similar to features shown and described with respect to the materials 10, 110 in FIGS. 1-10 and 33-38 and the materials 1010, 1110 in FIGS. 42-45. Accordingly, similar reference numerals are used to describe such common components and features with respect to the material 1210 in FIGS. 46-47, using the "12xx" series of reference numerals. Additionally, many components and features of the material 1210 that have already been described above may not be re-described below for sake of brevity. It is understood that any and all variations and embodiments of the materials 10, 110, 1010, 1110 described above and shown in FIGS. 1-10, 33-38, and 42-45 as well as any other features shown and/or described herein, may be incorporated into the embodiment of FIGS. 46-47.

The material 1210 of FIGS. 46-47 has a similar size and construction as the materials 1010, 1110 in FIGS. 42-45. The seals of the material 1210 are located and structured similarly to the seals of the materials 1010, 1110 of FIGS. 42-45, including the top seal 1220, the bottom seal 1222, the valve seal 1228, the airflow seals 1266, and the plurality of border seals 1224, including the curved segments 1271 with protruding ends 1273, and the connecting segments 1272. These seals define a plurality of air columns 1212, each formed of a plurality of air bubbles 1270 connected by air conduits 1274, including an alternating pattern of convex-sided air bubbles 1270A and concave-sided air bubbles 1270B, and a plurality of check valves 1252 in communication with an inflation passage 1242.

The material 1210 of FIGS. 46-47 has a valve assembly 1250 that is different from the materials 1010, 1110 of FIGS. 42-45. Like the material 110' of FIGS. 39-40, the material 1210 has a single valve film 1254 positioned between the outer films 1216, 1218 to form the check valves 1252. Additionally, like the material 110' of FIGS. 39-40, the material 1210 has a non-sealable material 1260 and a tacky material 1268 positioned on one side of the valve film 1254. Further, in the material 1210 of FIGS. 46-47, the valve layer 12154 does not extend a significant distance into the inflation passage 1242, and, as seen in FIG. 45, the valve layer 1254 extends only a very small distance, if any, beyond the valve seal 1228. The valve layer 1254 functions in the same manner as the valve layer 154' described above in the material 110' of FIGS. 39-40, to allow airflow from the inflation passage 1242 through the check valves 1252 and into the air columns 1212, and blocking airflow out of the air columns 1212.

Figure 48:
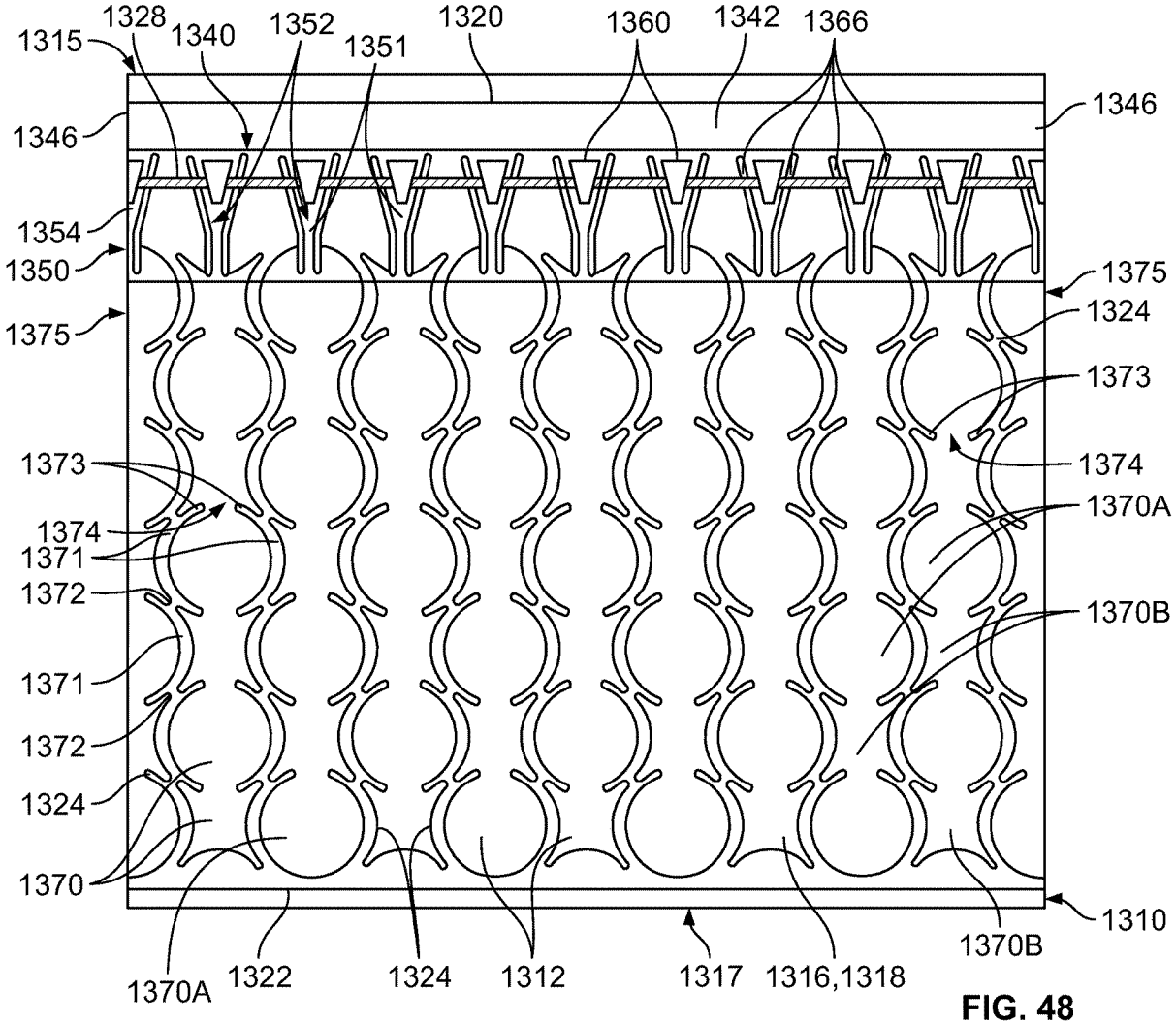
FIG. 48 is a plan view of another embodiment of an inflatable-bubble packaging material according to the present invention.

FIG. 48 illustrates another embodiment of an inflatable-bubble packaging material 1310. The material 1310 as shown in FIG. 48 contains many components and features that are similar to features shown and described with respect to the materials 10, 110 in FIGS. 1-10 and 33-38 and the materials 1010, 1110, 1210 in FIGS. 42-47. Accordingly, similar reference numerals are used to describe such common components and features with respect to the material 1310 in FIG. 48, using the "13xx" series of reference numerals. Additionally, many components and features of the material 1310 that have already been described above may not be re-described below for sake of brevity. It is understood that any and all variations and embodiments of the materials 10, 110, 1010, 1110, 1210 described above and shown in FIGS. 1-10, 33-38, and 42-47 as well as any other features shown and/or described herein, may be incorporated into the embodiment of FIG. 48. In particular, the valve structure of any of the materials 10, 110, 1010, 1110, 1210 of FIGS. 1-10, 33-38, and 42-47 can be utilized in the material 1310 of FIG. 48.

The material 1310 of FIG. 48 has a different seal configuration as the material 1010 in FIGS. 42-43. Like the material 1010 of FIGS. 42-43, the material 1310 has a top seal 1320, a bottom seal 1322, a valve seal 1328, airflow seals 1366, and a plurality of border seals 1324, including curved segments 1371 with protruding ends 1373 and connecting segments 1372. These seals define a plurality of air columns 1312, each formed of a plurality of air bubbles 1370 connected by air conduits 1374, including an alternating pattern of convex-sided air bubbles 1370A and concave-sided air bubbles 1370B, and a plurality of check valves 1352 in communication with an inflation passage 1342. The configuration of the border seals 1324 is different from the border seals 1024 in FIGS. 42-43. In the embodiment of FIG. 48, the curved segments 1371 of the border seals 1324 have tapered widths, being narrower near the ends 1373 and wider at the middle, as compared to the curved segments 1071 in FIG. 42. Additionally, the connecting segments 1372 of the border seals 1324 are shorter than the connecting segments 1072 in FIG. 42. As a result, the convex-sided air bubbles 1370A are slightly larger than the concave-sided air bubbles 1370B, in contrast to the material 1010 of FIG. 42, where the convex-sided air bubbles 1070A are slightly smaller than the concave-sided air bubbles 1070B. The air columns 1312 otherwise function similarly to the air columns 1012 of the material 1010 of FIGS. 42-43.

The valve assembly 1350 of the material 1310 of FIG. 48 can utilize a single-layer, dual-layer, or triple-layer construction, as described herein, including all variations thereof. As seen in FIG. 48, the valve layer(s) 1354 of the valve assembly 1350 has a smaller width measured from the top 1315 to the bottom 1317 of the material 1310 as compared to the valve layers of the embodiments of FIGS. 42-47. In this embodiment, the valve layer(s) 1354 extend slightly above the valve seal 1328, and into the inflation passage 1342. Additionally, the valve layer(s) 1354 of the material 1310 have a non-sealable material 1360 to prevent sealing of the check valves 1352, as described above. The valve layer(s) 1354 of the material 1310 may also utilize a tacky material (not shown), as similarly described above.

Figure 49:
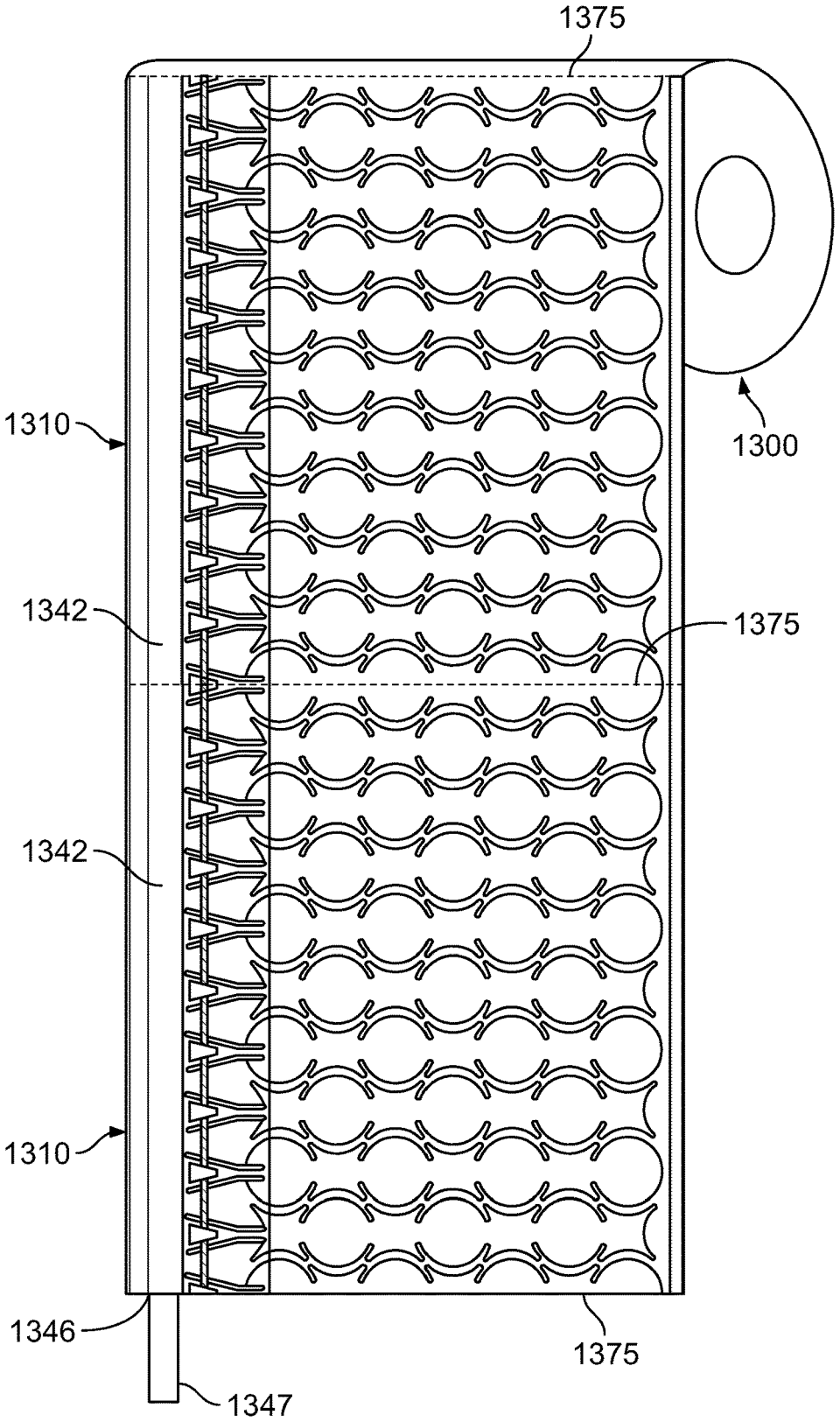
FIG. 49 is a plan view of a sheet containing a plurality of inflatable-bubble packaging materials as shown in FIG. 48.

The materials 1010, 1110, 1210, 1310 of FIGS. 42-48 can be formed as a sheet material containing a plurality of such materials 1010, 1110, 1210, 1310 connected together, which can be separated by cutting, tearing, etc. FIG. 49 illustrates one embodiment of a sheet material 1300 formed of a plurality of materials 1310 as shown in FIG. 48. In this embodiment, each material 1310 has perforated left and right side edges 1375 that are connected to the side edges 1375 of adjacent materials 1310 on either side. The materials 1310 can be separated by tearing along the perforated edges 1375. Additionally, in this embodiment, the perforated edges 1375 each extend approximately down the center of an air column 1312, between the airflow seals 1366 and through the air conduits 1374. It is contemplated that the perforated edges 1375 may be positioned differently in another embodiment, or that the material 1310 may have no perforated edges 1375 and may need to be cut to size. The material 1310 of FIG. 48 can be cut or perforated at the edges 1375 to be any desired length, however in one embodiment, the length of each piece of material 1310 is 16 inches (which becomes approximately 12 inches after inflation). It is understood that the sheet material 1300 may have sufficient length to roll the uninflated material to form a roll of material, as described below. It is further understood that the materials 1010, 1110, 1210 of FIGS. 42-47 can also be formed as a sheet and/or roll in a similar manner.

The materials 1010, 1110, 1210, 1310 of FIGS. 42-48 can be inflated through the inflation passage 1042, 1142, 1242, 1342, as described below with respect to the material 1042 of FIGS. 42-43. It is understood that the materials 1110, 1210, 1310 of FIGS. 44-48 can be inflated in a similar manner. In general, a supply of air is connected to the inflation passage 1042 such that the air flows down the inflation passage 1042 and enters the check valves 1052. As described above with respect to the materials 10, 10', 110, and 110', the air is permitted to flow from the inflation passage 1042 through valve passage 1051 between the valve layers 1054, 1056 of each check valve 1052 and into the respective air column 1012. Once inflation is complete, the combination of internal pressure in the air column 1012 and the adherence of the tacky material 1068 presses the valve layers 1054, 1056 together against one of the outer films 1016, 1018 to prevent air flow back through the check valve 1052. The air supply can be connected to the inflation passage 1042 in any manner described herein. In one embodiment, a plurality of pieces of the material can be inflated as a rolled sheet of the material 1010, as shown in FIG. 49 with respect to the material 1310 of FIG. 48. One example embodiment of such an inflation method is shown in FIG. 50 and described below.

Figure 50:
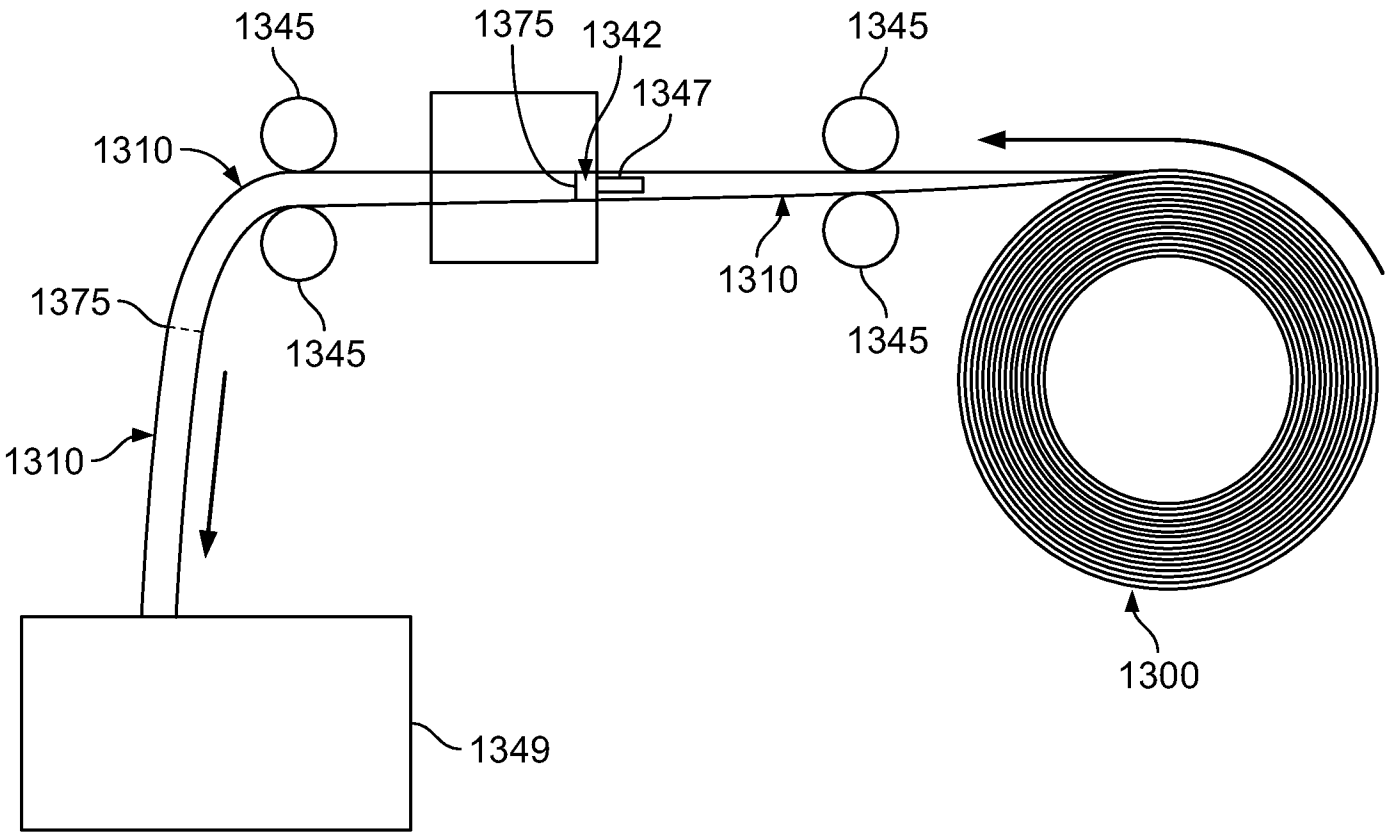
FIG. 50 is a schematic view of a method for inflating the inflatable-bubble packaging material of FIG. 48.
Figure 51:
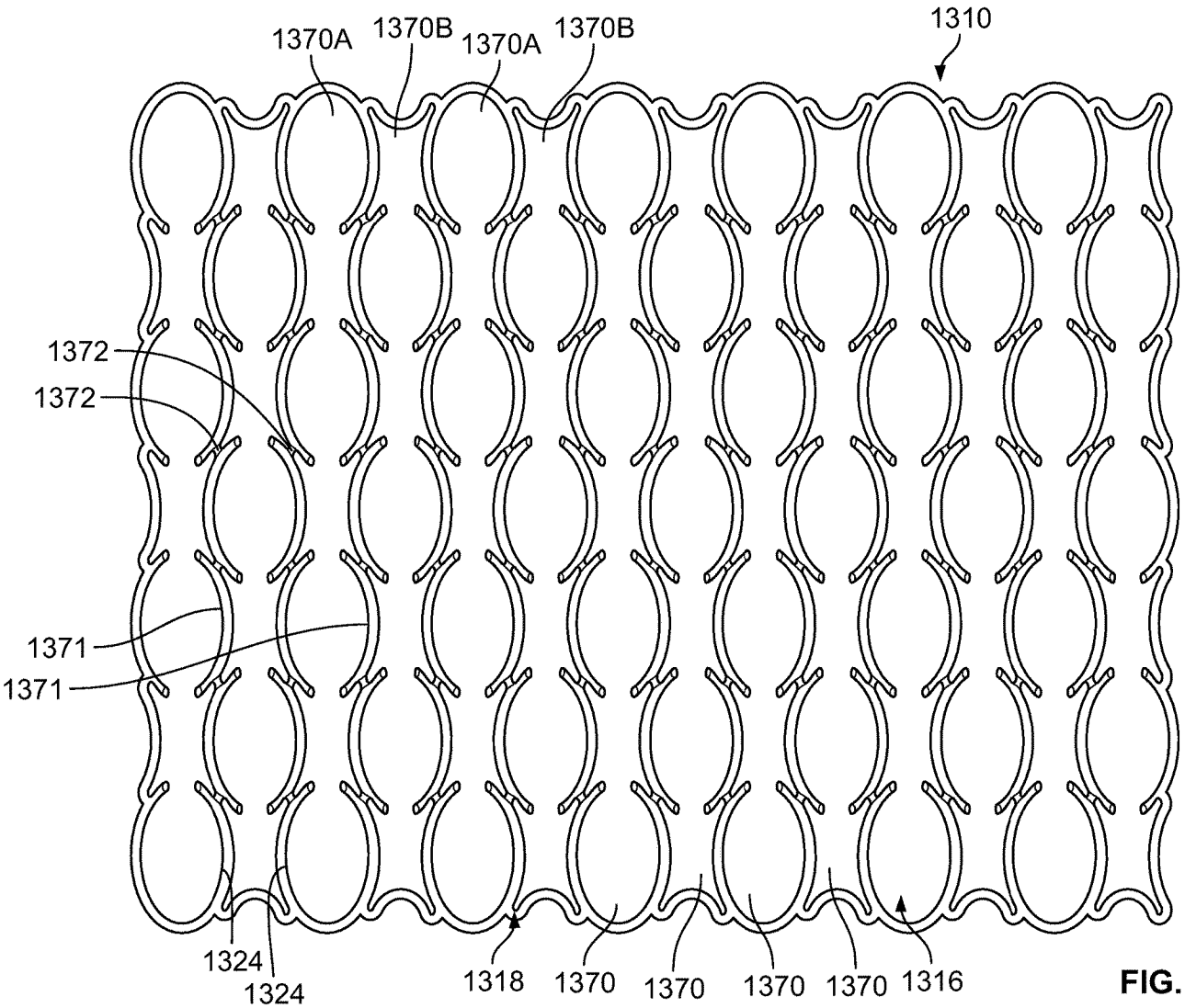
FIG. 51 is a perspective view of a portion of the material of FIG. 48 after inflation.

As shown in FIG. 50, the material 1310 is in the form of a rolled sheet 1300 of sequentially connected pieces of material 1310. In this form, the inflation passages 1342 of all of the sequential pieces of material 1310 are aligned with each other and in communication with each other, forming a long, single inflation passage. The inflation passage 1342 of the first piece of material 1310, at the front of the rolled sheet 1300, forms an inflation port 1346 that is connected to an inflation nozzle 1347 that applies air flow to the inflation passage 1342. Connection of the inflation nozzle 1347 to the inflation port 1346 is also illustrated in FIG. 49. The airflow inflates the air columns 1312 of the first piece of material 1310. As the roll 1300 is unrolled, the material 1310 is fed past the inflation nozzle 1347, such as by rollers or feeders 1345, and the inflation nozzle 1347 continuously applies airflow to the inflation passage 1342. The air flows through the inflation passage 1342 of the additional material 1310 that comes free of the roll 1300 and inflates the air columns 1312 of the additional material 1310. The material 1310 is generally completely inflated before it reaches the inflation nozzle 1347, and the nozzle 1347 breaks open the inflation passage 1342 to allow the material 1310 to pass by the nozzle 1347, such as by tearing or separating the upper and/or lower films 1316, 1318 proximate the top edge 1315. The material 1310 that remains on the roll 1300 is generally uninflated, as the tension of the roll 1300 typically provides sufficient compression to seal off air flow through the inflation passage 1342 and prevent inflation until the material 1310 comes free of the roll 1300. The inflated material 1310 drops down into a bin 1349 positioned below the roll 1300 for collection. After sufficient material 1310 is inflated, the inflated pieces of material 1310 can be torn away from the sheet/roll 1300 along the perforated sides 1375. The inflated pieces of material 1310 can also be torn apart from each other along the perforated sides 1375. An example of the material 1310 of FIG. 48 after inflation is shown in FIG. 51. Once inflated, the material 1310 can be used in a variety of different applications, including packaging applications, for protecting and cushioning items during shipping.

Further embodiments of packaging materials 1410, 1510, 1610 according to another embodiment of the invention is illustrated in FIGS. 52-67. The materials 1410, 1510, 1610 as shown in FIGS. 52-67 contain many components and features that are similar to features shown and described with respect to the materials 10, 10', 110, 110', 110", 1010, 1110, 1210, 1310. Accordingly, similar reference numerals are used to describe such common components and features with respect to the materials 1410, 1510, 1610 in FIGS. 53-67, using the "14xx," "15xx," and "16xx" series of reference numerals, respectively. Additionally, many components and features of the materials 1410, 1510, 1610 that have already been described above may not be re-described below for sake of brevity. It is understood that any and all variations and embodiments of the material 10, 10', 110, 110', 110", 1010, 1110, 1210, 1310 described above and shown in FIGS. 1-10 and 31-51 may be incorporated into the embodiments of FIGS. 52-67.

The material 1410 shown in FIGS. 52-55 is an inflatable packaging material having a plurality of air columns 1412 that are configured to be filled with air to form a protective structure. Like the material 10 described above, the material 1410 is formed of a plurality of plastic films, including upper and lower outer films 1416, 1418 positioned in confronting relation to each other and sealed together by a plurality of heat seals. The material 1410 also includes an inflation assembly, containing a valve assembly 1450 including a plurality of check valves 1452, as also described above. The outer films 1416, 1418 define the air columns 1412 therebetween, in a structure similar or identical to the air columns 12, 14 described above, and may include both main and auxiliary air columns in fluid communication with each other. The air columns 1412 of the material 1410 in FIGS. 52-55 function in the same manner described above with respect to FIGS. 1-10. The material 1410 includes the inflation assembly configured for inflation of the air columns 1412, and the inflation assembly contains a valve assembly 1450. Similar to the material 10 in FIGS. 1-10, the inflation assembly includes an inflation passage 1442 defined above the check valves 1452, which allows air to flow between the outer films 1416, 1418 and across the top of the material 1410 to be distributed to a plurality of check valves 1452 of the valve assembly 1450 that are in communication with the inflation passage 1442. The inflation passage 1442 may be configured in any manner described above herein.

In the embodiment illustrated in FIGS. 52-55, the valve assembly 1450 includes three valve films positioned between the outer films 1416, 1418: an upper valve film 1454, a lower valve film 1456, and a middle valve film 1458, similar to the material 10 as shown in FIGS. 1-10. Unlike the embodiment shown in FIGS. 1-10, all three valve layers 1454, 1456, 1458 have the same or similar lengths. The valve films 1454, 1456, 1458 are positioned in surface-to-surface contact with each other, and areas of a non-sealable material 1460 are positioned between the valve films 1454, 1456, 1458. The non-sealable material 1460 can be positioned on opposite sides of the middle valve film 1458, as in the embodiment of FIGS. 1-10, and may be applied by printing on the valve film 1458 before assembly of the valve assembly 1450. In other embodiments, one or both of the areas of non-sealable material 1460 can be positioned on the side of the lower valve film 1456 that confronts the middle valve film 1458 and/or the side of the upper valve film 1454 that confronts the middle valve film 1458. The non-sealable material 1460 can be shaped, configured, and positioned in any manner described above. The valve films 1454, 1456 are sealed together with the outer films 1416, 1418 at the valve seal, as described above, to form two valve passages 1451 between the middle valve film 1458 and the upper and lower valve films 1454, 1456.

Figure 52:
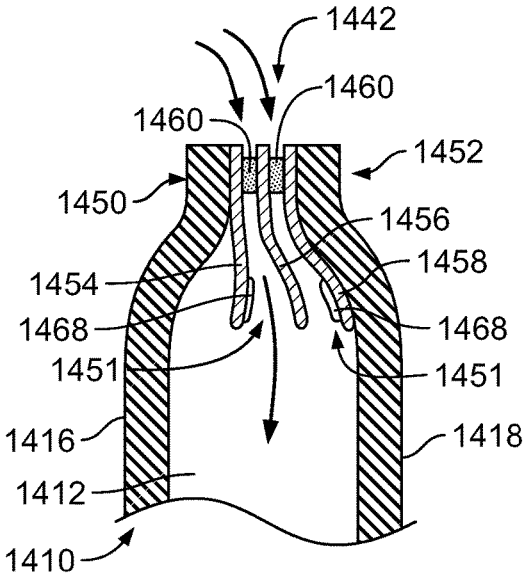
FIG. 52 is a cross-sectional view of another embodiment of a packaging material according to the present invention, shown during inflation.
Figure 53:
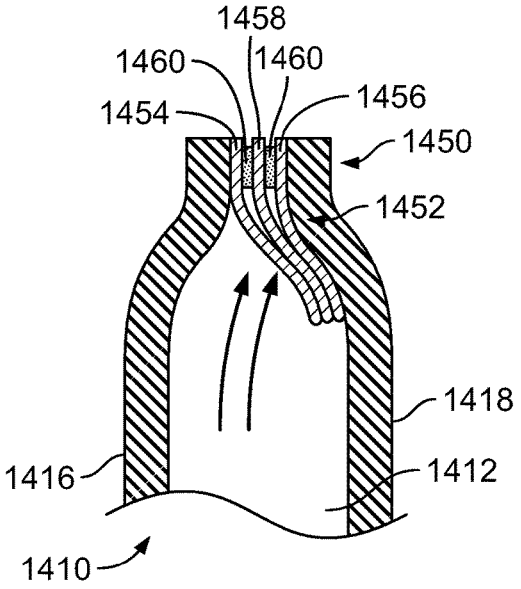
FIG. 53 is a cross-sectional view of the packaging material as illustrated in FIG. 52, shown after inflation is complete.
Figure 54:
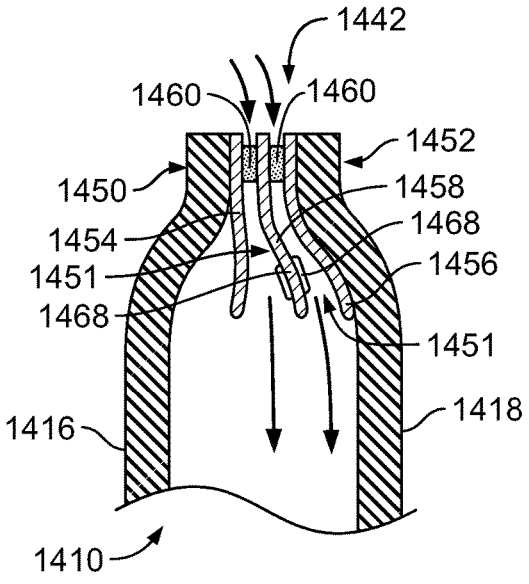
FIG. 54 is a cross-sectional view of another embodiment of a packaging material according to the present invention, shown during inflation.
Figure 55:
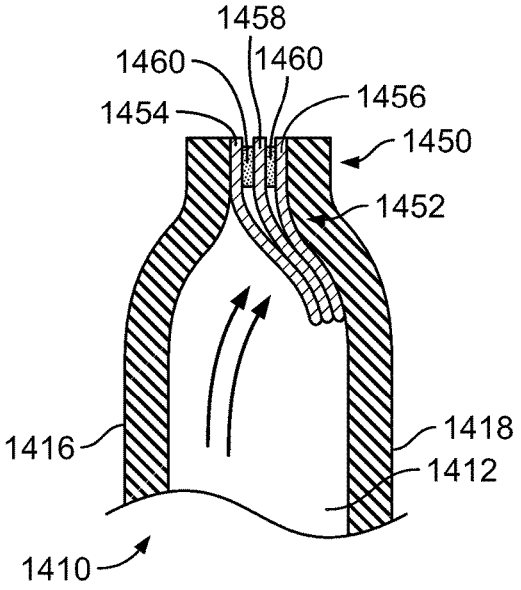
FIG. 55 is a cross-sectional view of the packaging material as illustrated in FIG. 54, shown after inflation is complete.

In this embodiment, the valve assembly 1450 of FIGS. 52-55 further includes a tacky material 1468 positioned between the middle valve film 1458 and the upper and lower valve films 1454, 1456. As shown in FIGS. 52-53, the tacky material 1468 can be positioned on the sides of the upper and lower valve films 1454, 1456 facing the middle valve film 1458. Alternately, as shown in FIGS. 54-55, the tacky material 1468 as described above can be positioned on the sides of the middle valve film 1458 facing the upper and lower valve films 1454, 1456. In further embodiments, the tacky material 1468 can be positioned on any combination of the valve films 1454, 1456, 1458, and in one embodiment, the material 1410 may include only one area of tacky material 1468. The tacky material 1468 can be any material discussed above, and can applied to one or more of the valve films 1454, 1456, 1458 as described above.

The check valves 1452 of the valve assembly 1450 function similarly to the check valves 52 of the material 10 described above. As shown in FIGS. 52 and 54, air flows along the inflation passage 1442, through the air passages 1451 between the valve films 1454, 1456, 1458 created by the non-sealable material 1460, and into the air columns 1412. After the inflation airflow is ceased, the air columns 1412 are pressurized, and the air pressure within the columns 1412 forces the valve films 1454, 1456, 1458 into contact with each other and against one of the outer films 1416, 1418 to prevent air from escaping back through the air passages 1451, as shown in FIGS. 53-55. The tacky material 1468 adheres the valve films 1454, 1456, 1458 to each other to assist in closing the passage and resisting the reverse flow of air, as described above. As also described above, when sufficient air pressure is present in the inflation passage 1442, the tacky material 1468 releases to allow air to flow from the inflation passage 1442 through the air passage 1451 and into the air columns 1412.

The material 1510 shown in FIGS. 56-63 is an inflatable packaging material having a plurality of air columns 1512 that are configured to be filled with air to form a protective structure. Like the material 10 described above, the material 1510 is formed of a plurality of plastic films, including upper and lower outer films 1516, 1518 positioned in confronting relation to each other and sealed together by a plurality of heat seals. The material 1510 also includes an inflation assembly, containing a valve assembly 1550 including a plurality of check valves 1552, as also described above. The outer films 1516, 1518 define the air columns 1512 therebetween, in a structure similar or identical to the air columns 12, 14 described above, and may include both main and auxiliary air columns in fluid communication with each other. The air columns 1512 of the material 1510 in FIGS. 56-63 function in the same manner described above with respect to FIGS. 1-10. The material 1510 includes the inflation assembly configured for inflation of the air columns 1512, and the inflation assembly contains a valve assembly 1550. Similar to the material 10 in FIGS. 1-10, the inflation assembly includes an inflation passage 1542 defined above the check valves 1552, which allows air to flow between the outer films 1516, 1518 and across the top of the material 1510 to be distributed to a plurality of check valves 1552 of the valve assembly 1550 that are in communication with the inflation passage 1542. The inflation passage 1542 may be configured in any manner described above herein.

Figure 58:
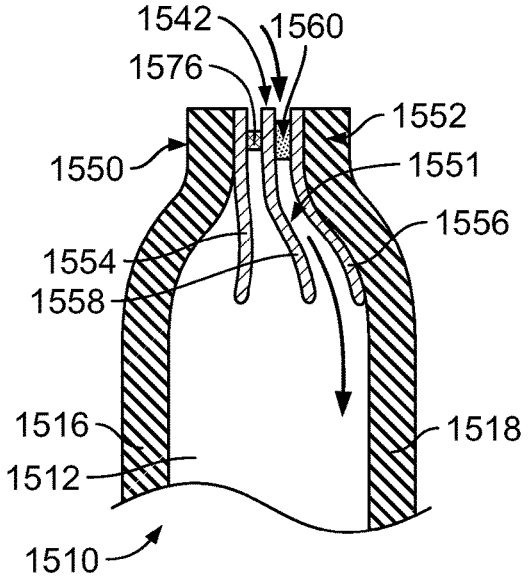
FIG. 58 is a cross-sectional view of another embodiment of a packaging material according to the present invention, shown during inflation.
Figure 59:
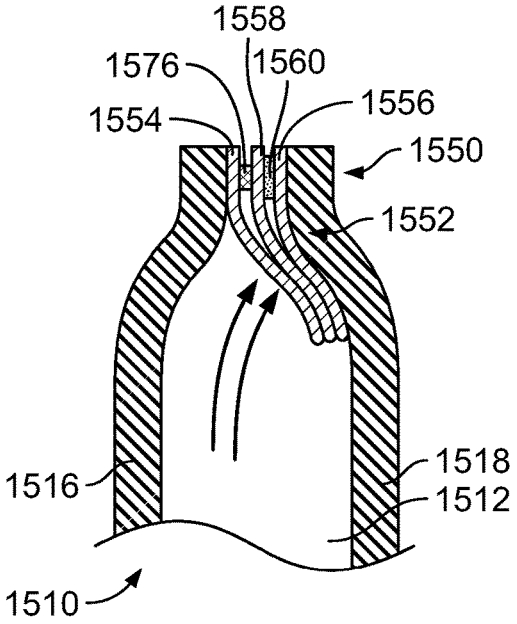
FIG. 59 is a cross-sectional view of the packaging material as illustrated in FIG. 58, shown after inflation is complete.
Figure 60:
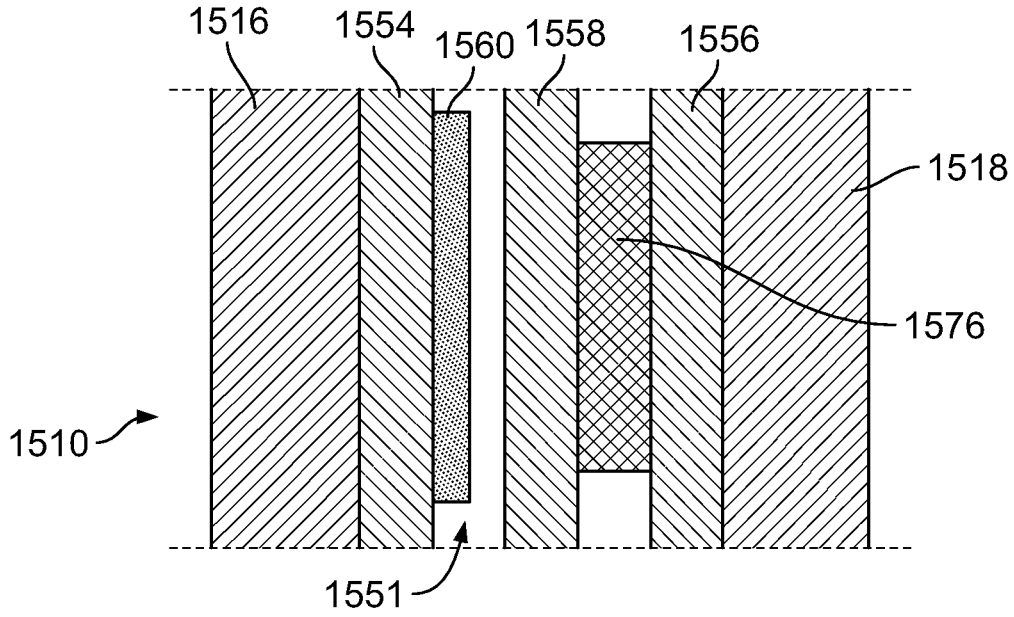
FIG. 60 is a magnified view of a portion of one embodiment of a packaging material as shown in FIGS. 56-57.
Figure 61:
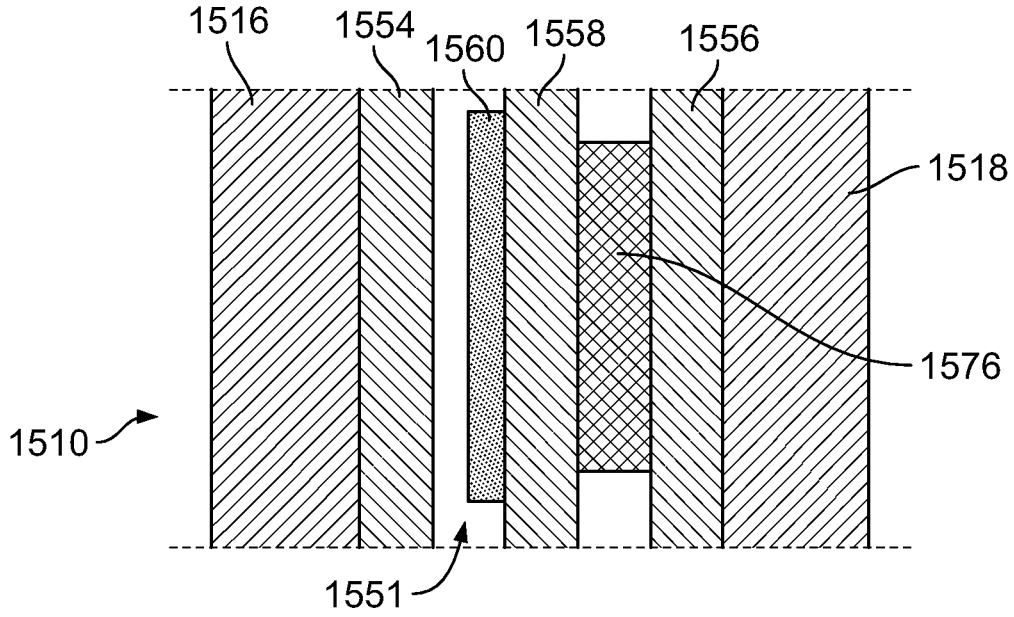
FIG. 61 is a magnified view of a portion of another embodiment of a packaging material as shown in FIGS. 56-57.
Figure 62:
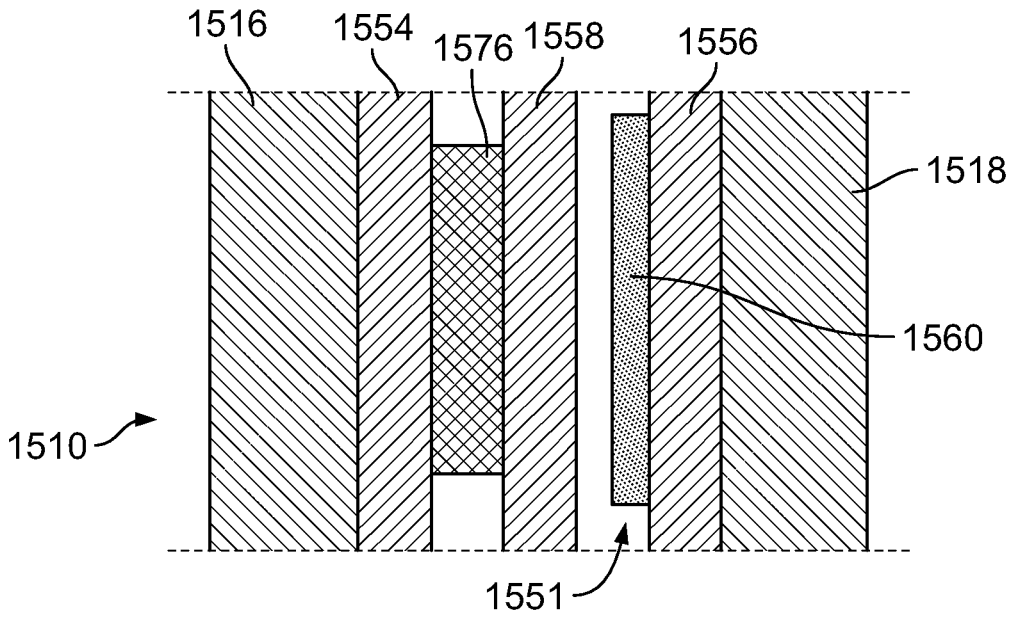
FIG. 62 is a magnified view of a portion of one embodiment of a packaging material as shown in FIGS. 58-59.
Figure 63:
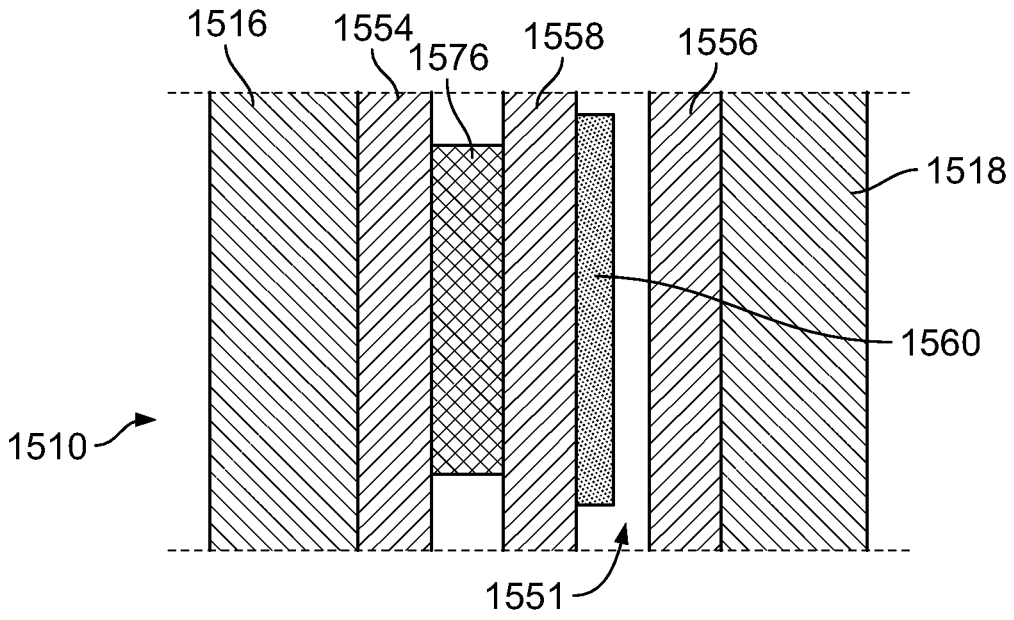
FIG. 63 is a magnified view of a portion of one embodiment of a packaging material as shown in FIGS. 58-59.

In the embodiment illustrated in FIGS. 56-63, the valve assembly 1550 includes three valve films positioned between the outer films 1516, 1518: an upper valve film 1554, a lower valve film 1556, and a middle valve film 1558, similar to the material 10 as shown in FIGS. 1-10. Unlike the embodiment shown in FIGS. 1-10, all three valve layers 1554, 1556, 1558 have the same or similar lengths. The valve films 1554, 1556, 1558 are positioned in surface-to-surface contact with each other, and areas of a non-sealable material 1560 are positioned between only two of the three valve films 1554, 1556, 1558, and may be applied by printing on one or more of the valve film 1554, 1556, 1558 before assembly of the valve assembly 1550. In one embodiment, as shown in FIGS. 56-57 and 60-61, the non-sealable material 1560 can be positioned between the middle valve film 1558 and the upper valve film 1554. As a result, in this embodiment, the lower and middle valve films 1556, 1558 are sealed together during the creation of the valve seal, forming a seal 1576, and the valve assembly 1550 has only a single valve passage 1551 between the upper and middle valve films 1554, 1558. Additionally, in this embodiment, the non-sealable material 1560 can be positioned on the side of the upper valve film 1554 facing the middle valve film 1558, as shown in FIG. 60, or on the side of the middle valve film 1558 facing the upper valve film 1554, as shown in FIG. 61. In another embodiment, as shown in FIGS. 58-59 and 62-63, the non-sealable material 1560 can be positioned between the middle valve film 1558 and the lower valve film 1556. As a result, in this embodiment, the upper and middle valve films 1554, 1558 are sealed together during the creation of the valve seal, forming a seal 1576, and the valve assembly 1550 has only a single valve passage 1551 between the lower and middle valve films 1556, 1558. Additionally, in this embodiment, the non-sealable material 1560 can be positioned on the side of the lower valve film 1556 facing the middle valve film 1558, as shown in FIG. 62, or on the side of the middle valve film 1558 facing the lower valve film 1556, as shown in FIG. 63. The non-sealable material 1560 can be shaped, configured, and positioned in any manner described above.

Figure 56:
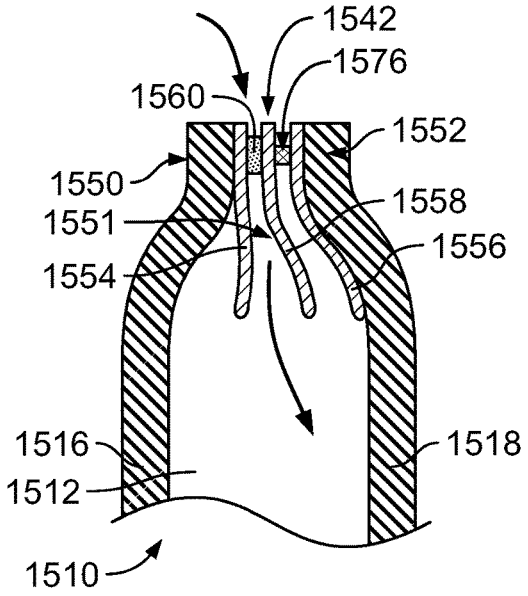
FIG. 56 is a cross-sectional view of another embodiment of a packaging material according to the present invention, shown during inflation.
Figure 57:
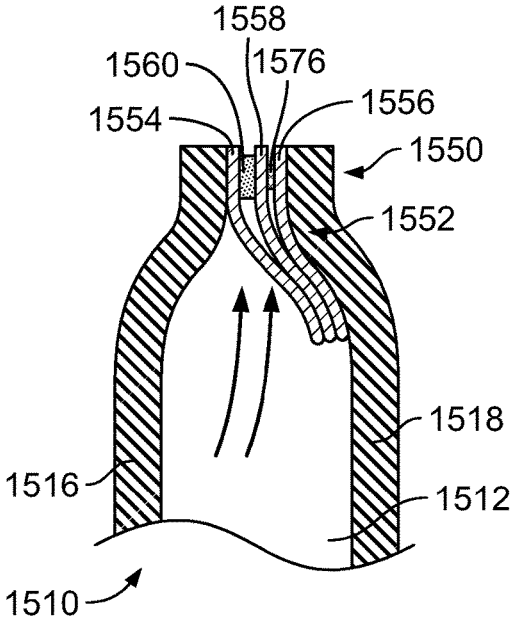
FIG. 57 is a cross-sectional view of the packaging material as illustrated in FIG. 56, shown after inflation is complete.

The check valves 1552 of the valve assembly 1550 function similarly to the check valves 52 of the material 10 described above. As shown in FIGS. 56 and 58, air flows along the inflation passage 1542, through the air passage 1551 between the valve films 1554, 1556, 1558 created by the non-sealable material 1560, and into the air columns 1512. After the inflation airflow is ceased, the air columns 1512 are pressurized, and the air pressure within the columns 1512 forces the valve films 1554, 1556, 1558 into contact with each other and against one of the outer films 1516, 1518 to prevent air from escaping back through the air passage 1551, as shown in FIGS. 57 and 59.

The material 1610 shown in FIGS. 64-67 is an inflatable packaging material having a plurality of air columns 1612 that are configured to be filled with air to form a protective structure. Like the material 10 described above, the material 1610 is formed of a plurality of plastic films, including upper and lower outer films 1616, 1618 positioned in confronting relation to each other and sealed together by a plurality of heat seals. The material 1610 also includes an inflation assembly, containing a valve assembly 1650 including a plurality of check valves 1652, as also described above. The outer films 1616, 1618 define the air columns 1612 therebetween, in a structure similar or identical to the air columns 12, 14 described above, and may include both main and auxiliary air columns in fluid communication with each other. The air columns 1612 of the material 1610 in FIGS. 64-67 function in the same manner described above with respect to FIGS. 1-10. The material 1610 includes the inflation assembly configured for inflation of the air columns 1612, and the inflation assembly contains a valve assembly 1650. Similar to the material 10 in FIGS. 1-10, the inflation assembly includes an inflation passage 1642 defined above the check valves 1652, which allows air to flow between the outer films 1616, 1618 and across the top of the material 1610 to be distributed to a plurality of check valves 1652 of the valve assembly 1650 that are in communication with the inflation passage 1642. The inflation passage 1642 may be configured in any manner described above herein.

In the embodiment illustrated in FIGS. 64-67, the valve assembly 1650 includes three valve films positioned between the outer films 1616, 1618: an upper valve film 1654, a lower valve film 1656, and a middle valve film 1658, similar to the material 10 as shown in FIGS. 1-10. Unlike the embodiment shown in FIGS. 1-10, all three valve layers 1654, 1656, 1658 have the same or similar lengths. The valve films 1654, 1656, 1658 are positioned in surface-to-surface contact with each other, and areas of a non-sealable material 1660 are positioned between only two of the three valve films 1654, 1656, 1658, and may be applied by printing on one or more of the valve film 1654, 1656, 1658 before assembly of the valve assembly 1650. In this embodiment, the non-sealable material 1660 can be positioned between the middle valve film 1658 and the upper valve film 1654, similar to the embodiment shown in FIGS. 56-57 and 60-61. As a result, in this embodiment, the lower and middle valve films 1656, 1658 are sealed together during the creation of the valve seal, forming a seal 1676, and the valve assembly 1650 has only a single valve passage 1651 between the upper and middle valve films 1654, 1658. The non-sealable material 1660 can be positioned in any manner shown in FIGS. 60-61. Alternately, the features of the embodiment of FIGS. 64-67 can be utilized in connection with the configurations shown in FIGS. 58-59 and 62-63. The non-sealable material 1660 can be shaped, configured, and positioned in any manner described above.

Figure 64:
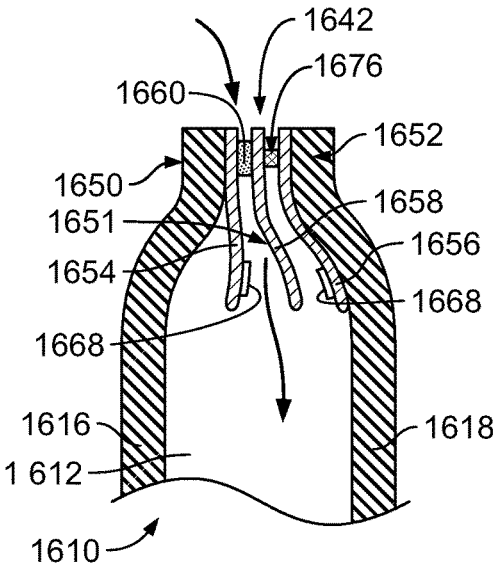
FIG. 64 is a cross-sectional view of another embodiment of a packaging material according to the present invention, shown during inflation.
Figure 65:
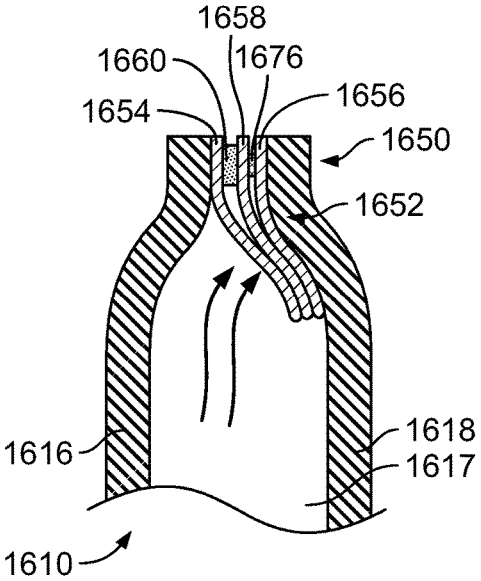
FIG. 65 is a cross-sectional view of the packaging material as illustrated in FIG. 64, shown after inflation is complete.
Figure 66:
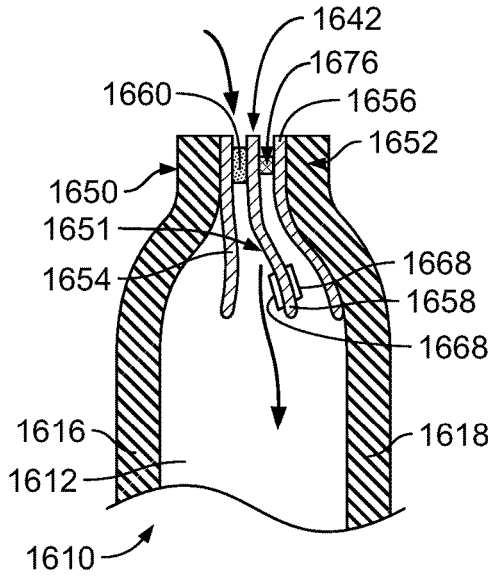
FIG. 66 is a cross-sectional view of another embodiment of a packaging material according to the present invention, shown during inflation.
Figure 67:
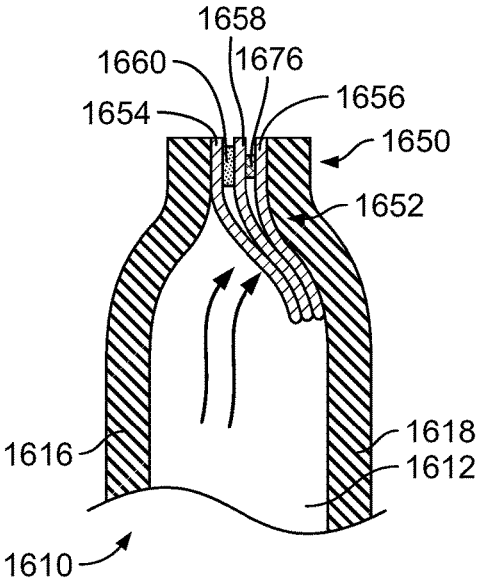
FIG. 67 is a cross-sectional view of the packaging material as illustrated in FIG. 66, shown after inflation is complete.

In this embodiment, the valve assembly 1650 of FIGS. 64-67 further includes a tacky material 1668 positioned between the middle valve film 1658 and the upper and lower valve films 1654, 1656. As shown in FIGS. 64-65, the tacky material 1668 can be positioned on the sides of the upper and lower valve films 1654, 1656 facing the middle valve film 1658. Alternately, as shown in FIGS. 66-67, the tacky material 1668 as described above can be positioned on the sides of the middle valve film 1658 facing the upper and lower valve films 1654, 1656. In further embodiments, the tacky material 1668 can be positioned on any combination of the valve films 1654, 1656, 1658, and in one embodiment, the material 1610 may include only one area of tacky material 1668. The tacky material 1668 can be any material discussed above, and can applied to one or more of the valve films 1654, 1656, 1658 as described above.

The check valves 1652 of the valve assembly 1650 function similarly to the check valves 52 of the material 10 described above. As shown in FIGS. 64 and 66, air flows along the inflation passage 1642, through the air passage 1651 between the upper and middle valve films 1654, 1658 created by the non-sealable material 1660, and into the air columns 1612. After the inflation airflow is ceased, the air columns 1612 are pressurized, and the air pressure within the columns 1612 forces the valve films 1654, 1656, 1658 into contact with each other and against one of the outer films 1616, 1618 to prevent air from escaping back through the air passage 1651, as shown in FIGS. 65 and 67. The tacky material 1668 adheres the valve films 1654, 1656, 1658 to each other to assist in closing the passage and resisting the reverse flow of air, as described above. As also described above, when sufficient air pressure is present in the inflation passage 1642, the tacky material 1668 releases to allow air to flow from the inflation passage 1642 through the air passage 1651 and into the air columns 1612.

It is understood that any of the features of the embodiments of the material 1410, 1510, 1610 shown in FIGS. 52-67 and described above can be used in connection with any of the embodiments described above and shown in FIGS. 1-51. It is further understood that any of the features of the embodiments described above and shown in FIGS. 1-51 can be used in connection with the embodiments of the material 1410, 1510, 1610 shown in FIGS. 52-67 and described above.

The packaging materials and methods as described herein provide many benefits and advantages over existing products and methods. For example, as described above, the various embodiments of valve assemblies can provide superior inflation capabilities, as well as superior sealing of the check valves, to reduce or eliminate air leakage out of the inflated material. The design of the airflow seals, the use of the tacky material, and other features of different embodiments disclosed herein can also assist in reducing or eliminating air leakage. As another example, the spaced configuration of the non-sealable material allows for the packaging material to be cut to nearly any desired width, increasing the versatility of the material. This feature can also simplify subsequent processing of the material, such as by reducing the amount of necessary equipment, as well as making subsequent processing more efficient. As another example, the communicating main and auxiliary air columns provide better cushioning and decrease the chance of rupturing the air columns, as described above. As a further example, the vacuum sealing method and associated features of the packaging material provide for more secure packaging, better cushioning, and greater ease and effectiveness of use and re-use as compared to existing packaging materials. As yet another example, the various configurations of packaging devices that can be made from the packaging material provide great versatility in packaging a large variety of different articles. As an additional example, the capability of inflating a sheet of interconnected pieces of material allows for quicker and more efficient inflation of a large amount of the material, particularly in comparison to existing packaging pillows, which must be inflated and then heat sealed to prevent air loss. Further, the materials and the associated continuous inflation methods allow for continuous inflation of a desired quantity of material on demand. The materials described herein offer advantages over such heat sealed packaging pillows, including lower safety risk, due to the fact that high temperature equipment is not necessary for inflation, as well as requiring fewer service staff to inflate as compared to the heat sealed packaging. Still further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An inflatable packaging material comprising:

first and second outer films positioned in confronting relation to each other and sealed together by a perimeter seal and a plurality of border seals located inward of the perimeter seal, the perimeter seal comprising a top seal and a bottom seal, wherein the border seals define a plurality of parallel air columns, wherein alternate ones of the border seals each have an air conduit therethrough, such that the air columns are arranged in a plurality of pairs of air columns, each of the pairs of air columns comprising a main air column and an auxiliary air column in communication with each other via the air conduit, wherein the main air column of each pair has a width that is greater than a width of the auxiliary air column of the pair;

a valve assembly positioned between the first and second outer films, the valve assembly comprising a first valve film, a second valve film, and a non-sealable material positioned between the first and second valve films;

a valve seal extending parallel to the top seal and spaced from the top seal, the valve seal connecting the first and second outer films and the first and second valve films, such that the top seal and the valve seal define an inflation passage therebetween, and the valve seal forms a top end of each of the air columns, wherein the non-sealable material is arranged to form a plurality of valve passages through the valve seal, with each air column having one of the valve passages located at the top end thereof to allow airflow into each air column; and a plurality of airflow seals within each air column connecting the first and second valve films to the first outer film and adapted to guide airflow between the first and second valve films, wherein the plurality of airflow seals within each air column comprises a pair of elongated seals adjacent the valve seal and extending into the air column and a central seal positioned adjacent distal ends of the pair of elongated seals, wherein the elongated seals of each pair are angled toward each other to define a tapered tunnel, and wherein each central seal has curved lateral edges defining a maximum width that is greater than a spacing between the distal ends of the elongated seals adjacent to the central seal, wherein the first and second valve films form a one-way valve, such that airflow from the inflation passage through the valve passages is permitted, and the first and second valve films cooperate to obstruct airflow from the air columns through the valve passages.

2. The inflatable packaging material of claim 1, wherein the valve assembly further comprises a third valve film positioned between the first and second valve films, wherein the non-sealable material is positioned between the third valve film and the first and second valve films, wherein the plurality of airflow seals within each air column connect the first, second, and third valve films to the first outer film, and wherein the first, second, and third valve films cooperate to obstruct airflow from the air columns through the valve passages.

3. The inflatable packaging material of claim 1, wherein the airflow seals in each of the air columns are identical to the airflow seals in all other of the air columns.

4. The inflatable packaging material of claim 1, wherein the airflow seals in each of the main air columns are identical to the airflow seals in all other of the main air columns, and the airflow seals in each of the auxiliary air columns are identical to the airflow seals in all other of the auxiliary air columns.

5. The inflatable packaging material of claim 1, wherein at least one of the airflow seals in each of the main air columns is structured differently from at least one of the airflow seals in each of the auxiliary air columns.

6. The inflatable packaging material of claim 1, wherein the plurality of airflow seals within each air column further comprise a plurality of parallel seals that are parallel to the border seals and extend to a bottom end of at least one of the first and second valve films distal from the valve seal, wherein the plurality of parallel seals and the border seals defining the air column combine to define a plurality of airflow passages therebetween.

7. The inflatable packaging material of claim 6, wherein the maximum width of each central seal is greater than a width of any of the airflow passages in the air column.

8. The inflatable packaging material of claim 6, wherein the central seal, the elongated seals, and the parallel seals in each air column are separate from each other.

9. The inflatable packaging material of claim 1, wherein the central seal in each air column is separate from the elongated seals in the air column.

10. An inflatable packaging material comprising:

first and second outer films positioned in confronting relation to each other and sealed together by a perimeter seal and a plurality of border seals located inward of the perimeter seal, the perimeter seal comprising a top seal and a bottom seal, wherein the border seals define a plurality of parallel air columns, wherein alternate ones of the border seals each have an air conduit therethrough, such that the air columns are arranged in a plurality of pairs of air columns, each of the pairs of air columns comprising a main air column and an auxiliary air column in communication with each other via the air conduit, wherein the main air column of each pair has a width that is greater than a width of the auxiliary air column of the pair;

a valve assembly positioned between the first and second outer films, the valve assembly comprising a first valve film, a second valve film, and a non-sealable material positioned between the first and second valve films;

a valve seal extending parallel to the top seal and spaced from the top seal, the valve seal connecting the first and second outer films and the first and second valve films, such that the top seal and the valve seal define an inflation passage therebetween, and the valve seal forms a top end of each of the air columns, wherein the non-sealable material is arranged to form a plurality of valve passages through the valve seal, with each air column having one of the valve passages located at the top end thereof to allow airflow into each air column; and a plurality of airflow seals within each air column connecting the first and second valve films to the first outer film and adapted to guide airflow between the first and second valve films, wherein the plurality of airflow seals within each air column comprises a pair of elongated seals adjacent the valve seal and extending into the air column, wherein the elongated seals of each pair are angled toward each other to define a tapered tunnel, and a plurality of parallel seals that are parallel to the border seals and extend to a bottom end of at least one of the first and second valve films distal from the valve seal, wherein the plurality of parallel seals and the border seals defining the air column combine to define a plurality of airflow passages therebetween, wherein the first and second valve films form a one-way valve, such that airflow from the inflation passage through the valve passages is permitted, and the first and second valve films cooperate to obstruct airflow from the air columns through the valve passages.

11. The inflatable packaging material of claim 10, wherein the airflow seals in each of the air columns are identical to the airflow seals in all other of the air columns.

12. The inflatable packaging material of claim 10, wherein the airflow seals in each of the main air columns are identical to the airflow seals in all other of the main air columns, and the airflow seals in each of the auxiliary air columns are identical to the airflow seals in all other of the auxiliary air columns.

13. The inflatable packaging material of claim 10, wherein at least one of the airflow seals in each of the main air columns is structured differently from at least one of the airflow seals in each of the auxiliary air columns.

14. The inflatable packaging material of claim 10, wherein the plurality of airflow seals within each air column further comprise a central seal positioned between the elongated seals and the parallel seals, and wherein each central seal has curved lateral edges defining a maximum width that is greater than a spacing between distal ends of the elongated seals adjacent to the central seal.

15. The inflatable packaging material of claim 14, wherein the maximum width of each central seal is greater than a width of any of the airflow passages in the air column.

16. The inflatable packaging material of claim 14, wherein the central seal, the elongated seals, and the parallel seals in each air column are separate from each other.

17. The inflatable packaging material of claim 10, wherein the central seal in each air column is separate from the elongated seals in the air column.

18. An inflatable packaging material comprising:

first and second outer films positioned in confronting relation to each other and sealed together by a perimeter seal and a plurality of border seals located inward of the perimeter seal, the perimeter seal comprising a top seal and a bottom seal, wherein the border seals define a plurality of parallel air columns, wherein alternate ones of the border seals each have an air conduit therethrough, such that the air columns are arranged in a plurality of pairs of air columns, each of the pairs of air columns comprising a main air column and an auxiliary air column in communication with each other via the air conduit, wherein the main air column of each pair has a width that is greater than a width of the auxiliary air column of the pair;

a valve assembly positioned between the first and second outer films, the valve assembly comprising a first valve film, a second valve film, and a non-sealable material positioned between the first and second valve films;

a valve seal extending parallel to the top seal and spaced from the top seal, the valve seal connecting the first and second outer films and the first and second valve films, such that the top seal and the valve seal define an inflation passage therebetween, and the valve seal forms a top end of each of the air columns, wherein the non-sealable material is arranged to form a plurality of valve passages through the valve seal, with each air column having one of the valve passages located at the top end thereof to allow airflow into each air column; and a plurality of airflow seals within each air column connecting the first and second valve films to the first outer film and adapted to guide airflow between the first and second valve films, wherein the plurality of airflow seals within each air column comprises a plurality of parallel seals that are parallel to the border seals and extend to a bottom end of at least one of the first and second valve films distal from the valve seal, wherein the plurality of parallel seals and the border seals defining the air column combine to define a plurality of airflow passages therebetween, and a central seal located between the valve seal and the parallel seals, wherein each central seal has curved lateral edges defining a maximum width that is greater than a width of any of the airflow passages in the air column, wherein the first and second valve films form a one-way valve, such that airflow from the inflation passage through the valve passages is permitted, and the first and second valve films cooperate to obstruct airflow from the air columns through the valve passages.

19. The inflatable packaging material of claim 18, wherein the airflow seals in each of the air columns are identical to the airflow seals in all other of the air columns.

20. The inflatable packaging material of claim 18, wherein the airflow seals in each of the main air columns are identical to the airflow seals in all other of the main air columns, and the airflow seals in each of the auxiliary air columns are identical to the airflow seals in all other of the auxiliary air columns.

21. The inflatable packaging material of claim 18, wherein at least one of the airflow seals in each of the main air columns is structured differently from at least one of the airflow seals in each of the auxiliary air columns.

22. The inflatable packaging material of claim 18, wherein the plurality of airflow seals within each air column comprises a pair of elongated seals adjacent the valve seal and extending into the air column, wherein the elongated seals of each pair are angled toward each other to define a tapered tunnel.

23. The inflatable packaging material of claim 22, wherein the maximum width of the central seal in each air column is greater than a spacing between distal ends of the elongated seals in the air column.

24. The inflatable packaging material of claim 22, wherein the central seal, the elongated seals, and the parallel seals in each air column are separate from each other.

25. The inflatable packaging material of claim 18, wherein the central seal in each air column is separate from the parallel seals in the air column.

* * * * *